US009043215B2

(12) United States Patent
Neuendorf et al.

(10) Patent No.: US 9,043,215 B2
(45) **Date of Patent: *May 26, 2015**

(54) MULTI-RESOLUTION SWITCHED AUDIO ENCODING/DECODING SCHEME

(71) Applicants: Fraunhofer-Gesellschaft zur Foerderung der angewandten Forschung e.V., Munich (DE); Voiceage Corporation, Montreal, Quebec (CA)

(72) Inventors: Max Neuendorf, Nuremberg (DE); Stefan Bayer, Nuremberg (DE); Jeremie Lecomte, Fuerth (DE); Guillaume Fuchs, Erlangen (DE); Julien Robilliard, Nuremberg (DE); Nikolaus Rettelbach, Nuremberg (DE); Frederik Nagel, Nuremberg (DE); Ralf Geiger, Ilmenau (DE); Markus Multrus, Nuremberg (DE); Bernhard Grill, Lauf (DE); Philippe Gournay, Sherbrooke (CA); Redwan Salami, Saint-Laurent (CA)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 155 days.

This patent is subject to a terminal disclaimer.

(21) Appl. No.: 13/707,192

(22) Filed: Dec. 6, 2012

(65) Prior Publication Data

US 2013/0096930 A1 Apr. 18, 2013

Related U.S. Application Data

(63) Continuation of application No. 13/081,223, filed on Apr. 6, 2011, now Pat. No. 8,447,620, and a continuation of application No. PCT/EP2009/007205, filed on Oct. 7, 2009.

(60) Provisional application No. 61/103,825, filed on Oct. 8, 2008.

(30) Foreign Application Priority Data

Oct. 8, 2008 (EP) ..... 08017663
Feb. 18, 2009 (EP) ..... 09002271

(51) Int. Cl.
*G10L 19/08* (2013.01)
*G10L 19/008* (2013.01)

(Continued)

(52) U.S. Cl.
CPC ..... *G10L 19/008* (2013.01); *G10L 19/0017* (2013.01); *G10L 19/0212* (2013.01); *G10L 19/173* (2013.01); *G10L 19/18* (2013.01)

(58) Field of Classification Search
CPC ..... G10L 19/008
USPC ..... 704/500
See application file for complete search history.

(56) References Cited

U.S. PATENT DOCUMENTS 6,134,518 A 10/2000 Cohen et al.
6,963,842 B2 11/2005 Goodwin (Continued)

FOREIGN PATENT DOCUMENTS

CN 1234897 11/1999
CN 1495705 5/2004

(Continued)

OTHER PUBLICATIONS

Bessette, et al., "A Wideband Speech and Audio Codec at 16/24/32 kbits using Hybrid ACELP/TCX techniques", Speech Coding Proceedings, 1999 IEEE Workshop, 7-9.

(Continued)

*Primary Examiner* — Susan McFadden

(74) *Attorney, Agent, or Firm* — Michael A. Glenn; Perkins Coie LLP

(57) ABSTRACT

An audio encoder for encoding an audio signal has a first coding branch, the first coding branch comprising a first converter for converting a signal from a time domain into a frequency domain. Furthermore, the audio encoder has a second coding branch comprising a second time/frequency converter. Additionally, a signal analyzer for analyzing the audio signal is provided. The signal analyzer, on the hand, determines whether an audio portion is effective in the encoder output signal as a first encoded signal from the first encoding branch or as a second encoded signal from a second encoding branch. On the other hand, the signal analyzer determines a time/frequency resolution to be applied by the converters when generating the encoded signals. An output interface includes, in addition to the first encoded signal and the second encoded signal, a resolution information identifying the resolution used by the first time/frequency converter and used by the second time/frequency converter.

18 Claims, 28 Drawing Sheets

(51) Int. Cl.

| | |
|---|---|
| ***G10L 19/16*** | (2013.01) |
| ***G10L 19/18*** | (2013.01) |
| *G10L 19/00* | (2013.01) |
| *G10L 19/02* | (2013.01) |

(56) References Cited

U.S. PATENT DOCUMENTS

| | | | | |
|---|---|---|---|---|
| 7,043,423 | B2 | 5/2006 | Vinton et al. | |
| 7,876,966 | B2 | 1/2011 | Ojanpera | |
| 8,321,210 | B2 * | 11/2012 | Grill et al. | 704/205 |
| 8,447,620 | B2 * | 5/2013 | Neuendorf et al. | 704/500 |
| 8,744,863 | B2 * | 6/2014 | Neuendorf et al. | 704/501 |
| 8,804,970 | B2 * | 8/2014 | Grill et al. | 381/23 |
| 2002/0173969 | A1 | 11/2002 | Ojanpera | |
| 2003/0009325 | A1 | 1/2003 | Kirchherr et al. | |
| 2007/0112559 | A1 | 5/2007 | Schuijers et al. | |

FOREIGN PATENT DOCUMENTS

| | | |
|---|---|---|
| CN | 1625768 | 6/2005 |
| CN | 1839426 | 9/2006 |
| EP | 0932141 | 7/1999 |
| EP | 1 396 844 | 3/2004 |
| JP | 08263098 | 10/1996 |
| JP | 11175098 | 7/1999 |
| JP | 2007525707 | 9/2007 |
| JP | 2007538283 | 12/2007 |
| RU | 2214047 | 10/2003 |
| RU | 2005 135 650 | 3/2006 |
| WO | WO-98/02971 | 1/1998 |
| WO | WO-2005078706 | 8/2005 |
| WO | WO-2005114654 | 12/2005 |
| WO | WO-2007083934 | 7/2007 |
| WO | WO-2008022566 | 2/2008 |
| WO | WO-2008/071353 | 6/2008 |

OTHER PUBLICATIONS

Combescure, P et al., "A 16, 24, 32 kbits Wideband Speech Codec Based on a ECELP", 1999 Proceedings, IEEE Conference on Acoustic, Speech, and Signal Processing. vol. 1., May 1999, 5-8.

Ramprashad, Sean A. , The Multimode Transform Predictive Coding Paradigm, XP011079700; IEEE Transactions on Speech an Audio Processing, vol. 11, No. 2, Berkeley Heights, NJ, Mar. 2003, pp. 117-129.

Schnitzler, P et al., "Trends and Perspectives in Wideband Speech Coding", Signal Processing 80., 2000, 2267-2281.

Spanias, Andreas S. , "Speech Coding: A Tutorial Review", Proceedings of the IEEE vol. 82; Tempe, AZ, Oct. 10, 1994, pp. 1541-1582.

* cited by examiner (ENCODER)

(DECODER)

(ENCODER)

(ENCODER)

(DECODER)

(ENCODER)

- each block of the 1st domain audio signal is represented by either a 2nd domain, a 3rd domain or a 4th domain encoded signal, apart from a optional crossover region analysis-by-synthesis CELP $A_L(z)$: long term prediction
≙ pitch (fine) structure A(z): short term prediction
≙ format structure / spectral envelope (ENCODER SIDE)

(DECODER SIDE)

| window length | transform length | time resolution | frequency resolution |
|---|---|---|---|
| short | small | high | low |
| long | large | low | high |

FIGURE 13A

| window | #coeffs | looks like |
|---|---|---|
| LONG_WINDOW | 1024/960 | |
| SHORT_WINDOW | 128/120 | |
| LONG_START_WINDOW | 1024/960 | |
| LONG_STOP_WINDOW | 1024/960 | |
| STOP_START_WINDOW | 1024/960 | |
| START_WINDOW_LPD | 1024/960 | |
| STOP_WINDOW_1152 | 1152/1080 | |
| STOP_START_WINDOW_1152 | 1152/1080 | |

transform windows

FIGURE 13B
(AAC BRANCH AND TRANSITION)

| value | window_sequence | num_windows | looks like |
|---|---|---|---|
| 0 | ONLY_LONG_SEQUENCE = LONG_WINDOW | 1 | |
| 1 | LONG_START_SEQUENCE = LONG_START_WINDOW | 1 | |
| 2 | EIGHT_SHORT_SEQUENCE = 8 * SHORT_WINDOW | 8 | |
| 3 | LONG_STOP_SEQUENCE = LONG_STOP_WINDOW | 1 | |
| 1 | STOP_START_SEQUENCE = STOP_START_WINDOW | 1 | |
| 3 | LPD_START_SEQUENCE = START_WINDOW_LPD | 1 | |
| 3 | STOP_1152_SEQUENCE = STOP_WINDOW_1152 | 1 | |
| 1 | STOP_START_1152_SEQUENCE = STOP_START_WINDOW_1152 | 1 | |

window sequences

FIGURE 13C
(AAC BRANCH AND TRANSITION)

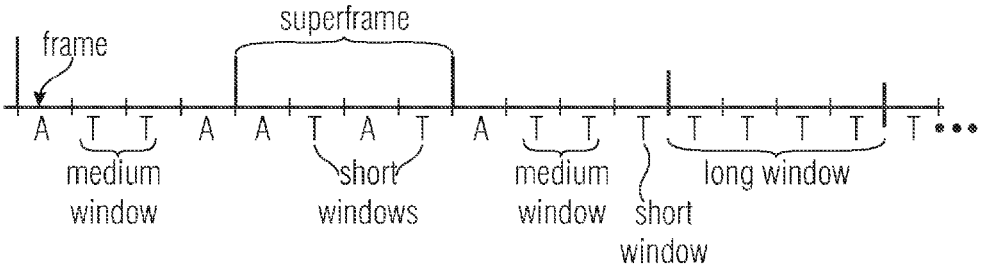
FIGURE 14E
| value of last_lpd_mode | value of mod[x] | number lg of spectral coefficients | ZL | L | M | R | ZR |
|---|---|---|---|---|---|---|---|
| 0 | 1 | 320 | 160 | 0 | 256 | 128 | 96 |
| 0 | 2 | 576 | 288 | 0 | 512 | 128 | 224 |
| 0 | 3 | 1152 | 512 | 128 | 1024 | 128 | 512 |
| 1..3 | 1 | 256 | 64 | 128 | 128 | 128 | 64 |
| 1..3 | 2 | 512 | 192 | 128 | 384 | 128 | 192 |
| 1..3 | 3 | 1024 | 448 | 128 | 896 | 128 | 448 |
FIGURE 14F
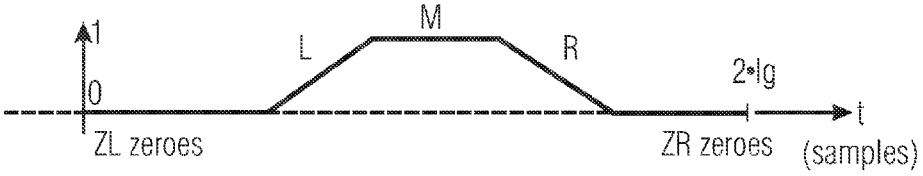
window definition of FIGURE 14F
FIGURE 14G

MULTI-RESOLUTION SWITCHED AUDIO ENCODING/DECODING SCHEME

CROSS-REFERENCE TO RELATED APPLICATIONS

This application is a continuation of copending U.S. application Ser. No. 13/081,223, filed Apr. 6, 2011, which is incorporated herein by reference in its entirety, which is a continuation of copending International Application No. PCT/EP2009/007205, filed Oct. 7, 2009, which is incorporated herein by reference in its entirety, and additionally claims priority from European Applications Nos. 09002271.6, filed Feb. 18, 2009, and EP 08017663.9, filed Oct. 8, 2008 and U.S. patent application Ser. No. 61/103,825, filed Oct. 8, 2008, which are all incorporated herein by reference in their entirety.

BACKGROUND OF THE INVENTION

The present invention is related to audio coding and, particularly, to low bit rate audio coding schemes.

In the art, frequency domain coding schemes such as MP3 or AAC are known. These frequency-domain encoders are based on a time-domain/frequency-domain conversion, a subsequent quantization stage, in which the quantization error is controlled using information from a perceptual module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform a Linear Predictive filtering of a time-domain signal. Such a LP filtering is derived from a Linear Prediction analysis of the input time-domain signal. The resulting LP filter coefficients are then quantized/coded and transmitted as side information. The process is known as Linear Prediction Coding (LPC). At the output of the filter, the prediction residual signal or prediction error signal which is also known as the excitation signal is encoded using the analysis-by-synthesis stages of the ACELP encoder or, alternatively, is encoded using a transform encoder, which uses a Fourier transform with an overlap. The decision between the ACELP coding and the Transform Coded eXcitation coding which is also called TCX coding is done using a closed loop or an open loop algorithm.

Frequency-domain audio coding schemes such as the High Efficiency AAC (HE-ACC) encoding scheme, which combines an AAC coding scheme and a spectral band replication (SBR) technique can also be combined with a joint stereo or a multi-channel coding tool which is known under the term "MPEG surround".

On the other hand, speech encoders such as the AMR-WB+ also have a high frequency extension stage and a stereo functionality.

Frequency-domain coding schemes are advantageous in that they show a high quality at low bitrates for music signals. Problematic, however, is the quality of speech signals at low bitrates.

Speech coding schemes show a high quality for speech signals even at low bitrates, but show a poor quality for other signals at low bitrates.

SUMMARY

According to an embodiment an audio encoder for encoding an audio signal may have a first coding branch for encoding an audio signal using a first coding algorithm to acquire a first encoded signal, the first coding branch having the first converter for converting an input signal into a spectral domain; a second coding branch for encoding an audio signal using a second coding algorithm to acquire a second encoded signal, wherein the first coding algorithm is different from the second coding algorithm, the second coding branch having a domain converter for converting an input signal from an input domain into an output domain, and a second converter for converting an input signal into a spectral domain; a switch for switching between the first coding branch and the second coding branch so that, for a portion of the audio input signal, either the first encoded signal or the second encoded signal is in an encoder output signal; a signal analyzer for analyzing the portion of the audio signal to determine, whether the portion of the audio signal is represented as the first encoded signal or the second encoded signal in the encoder output signal, wherein the signal analyzer is furthermore configured for variably determining a respective time/frequency resolution of the first converter and the second converter, when the first encoded signal or the second encoded signal representing the portion of the audio signal is generated; and an output interface for generating an encoder output signal having the first encoded signal and the second encoded signal and an information indicating the first encoded signal and the second encoded signal, and an information indicating the time/frequency resolution applied for encoding the first encoded signal and for encoding the second encoded signal.

According to another embodiment, a method of audio encoding an audio signal may have the steps of encoding, in a first coding branch, an audio signal using a first coding algorithm to acquire a first encoded signal, the first coding branch having the first converter for converting an input signal into a spectral domain; encoding, in a second coding branch, an audio signal using a second coding algorithm to acquire a second encoded signal, wherein the first coding algorithm is different from the second coding algorithm, the second coding branch having a domain converter for converting an input signal from an input domain into an output domain, and a second converter for converting an input signal into a spectral domain; switching between the first coding branch and the second coding branch so that, for a portion of the audio input signal, either the first encoded signal or the second encoded signal is in an encoder output signal; analyzing the portion of the audio signal to determine, whether the portion of the audio signal is represented as the first encoded signal or the second encoded signal in the encoder output signal, variably determining a respective time/frequency resolution of the first converter and the second converter, when the first encoded signal or the second encoded signal representing the portion of the audio signal is generated; and generating an encoder output signal having the first encoded signal and the second encoded signal and an information indicating the first encoded signal and the second encoded signal, and an information indicating the time/frequency resolution applied for encoding the first encoded signal and for encoding the second encoded signal.

According to another embodiment an audio decoder for decoding an encoded signal, the encoded signal having a first encoded signal, a second encoded signal, an indication indicating the first encoded signal and the second encoded signal, and a time/frequency resolution information to be used for decoding the first encoded signal and the second encoded audio signal, which may have a first decoding branch for decoding the first encoded signal using a first controllable frequency/time converter, the first controllable frequency/time converter being configured for being controlled using the time/frequency resolution information for the first encoded signal to acquire a first decoded signal; a second decoding branch for decoding the second encoded signal using a second controllable frequency/time converter, the second controllable frequency/time converter being configured for being controlled using the time/frequency resolution information for the second encoded signal; a controller for controlling the first frequency/time converter and the second frequency/time converter using the time/frequency resolution information; a domain converter for generating a synthesis signal using the second decoded signal; and a combiner for combining the first decoded signal and the synthesis signal to acquire a decoded audio signal.

According to another embodiment a method of audio decoding an encoded signal, the encoded signal having a first encoded signal, a second encoded signal, an indication indicating the first encoded signal and the second encoded signal, and a time/frequency resolution information to be used for decoding the first encoded signal and the second encoded audio signal, wherein the method may have the steps of decoding, by a first decoding branch, the first encoded signal using a first controllable frequency/time converter, the first controllable frequency/time converter being configured for being controlled using the time/frequency resolution information for the first encoded signal to acquire a first decoded signal; decoding, by a second decoding branch, the second encoded signal using a second controllable frequency/time converter, the second controllable frequency/time converter being configured for being controlled using the time/frequency resolution information for the second encoded signal; controlling the first frequency/time converter and the second frequency/time converter using the time/frequency resolution information; generating, by a domain converter, a synthesis signal using the second decoded signal; and combining the first decoded signal and the synthesis signal to acquire a decoded audio signal.

According to another embodiment, an encoded audio signal may have a first encoded signal; a second encoded signal, wherein a portion of an audio signal is either represented by the first encoded signal or the second encoded signal; an indication indicating the first encoded signal and the second encoded signal; an indication of a first time/frequency resolution information to be used for decoding the first encoded signal, and an indication of a second time/frequency resolution information to be used for decoding the second encoded signal.

Another embodiment may have a computer program for performing, when running on a processor, one of the above mentioned methods.

The present invention is based on the finding that a hybrid or dual-mode switched coding/encoding scheme is advantageous in that the best coding algorithm can be selected for a certain signal characteristic. Stated differently, the present invention does not look for a signal coding algorithm which is perfectly matched to all signal characteristics. Such scheme would be a compromise as can be seen from the huge differences between state of the art audio encoders on the one hand, and speech encoders on the other hand. Instead, the present invention combines different coding algorithms such as a speech coding algorithm on the one hand, and an audio coding algorithm on the other hand within a switched scheme so that, for each audio signal portion, the optimally matching coding algorithm is selected. Furthermore, it is also a feature of the present invention that both coding branches comprise a time/frequency converter, but in one coding branch, a further domain converter such an LPC processor is provided. This domain converter makes sure that the second coding branch is better suited for a certain signal characteristic than the first coding branch. However, it is also a feature of the present invention that the signal output by the domain processor is also transformed into a spectral representation.

Both converters, i.e., the first converter in the first coding branch and the second converter in the second coding branch are configured for applying a multi-resolution transform coding, where the resolution of the corresponding converter is set dependent on the audio signal, and particularly dependent on the audio signal actually coded in the corresponding coding branch so that a good compromise between quality on the one hand, and bitrate on the other hand, or in view of a certain fixed quality, the lowest bitrate, or in view of a fixed bitrate, the highest quality is obtained.

In accordance with the present invention, the time/frequency resolution of the two converters can advantageously be set independent from each other so that each time/frequency transformer can be optimally matched to the time/frequency resolution requirements of the corresponding signal. The bit efficiency, i.e., the relation between useful bits on the one hand, and side information bits on the other hand is higher for longer block sizes/window lengths. Therefore, it is advantageous that both converters are more biased to a longer window length, since, basically the same amount of side information refers to a longer time portion of the audio signal compared to applying shorter block sizes/window lengths/transform lengths. Advantageously, the time/frequency resolution in the encoding branches can also be influenced by other encoding/decoding tools located in these branches. Advantageously, the second coding branch comprising the domain converter such as an LPC processor comprises another hybrid scheme such as an ACELP branch on the one hand, and an TCX scheme on the other hand, where the second converter is included in the TCX scheme. Advantageously, the resolution of the time/frequency converter located in the TCX branch is also influenced by the encoding decision, so that a portion of the signal in the second encoding branch is processed in the TCX branch having the second converter or in the ACELP branch not having a time/frequency converter.

Basically, neither the domain converter nor the second coding branch, and particularly the first processing branch in the second encoding branch and the second processing branch in the second coding branch, have to be speech-related elements such as an LPC analyzer for the domain converter, a TCX encoder for the second processing branch and an ACELP encoder for the first processing branch. Other applications are also useful when other signal characteristics of an audio signal different from speech on the one hand, and music on the other hand are evaluated. Any domain converters and encoding branch implementations can be used and the best matching algorithm can be found by an analysis-by-synthesis scheme so that, on the encoder side, for each portion of the audio signal, all encoding alternatives are conducted and the best result is selected, where the best result can be found applying a target function to the encoding results. Then, side information identifying, to a decoder, the underlying encoding algorithm for a certain portion of the encoded audio signal is attached to the encoded audio signal by an encoder output interface so that the decoder does not have to care for any decisions on the encoder side or on any signal characteristics, but simply selects its coding branch depending on the transmitted side information. Furthermore, the decoder will not only select the correct decoding branch, but will also select, based on side information encoded in the encoded signal, which time/frequency resolution is to be applied in a corresponding first decoding branch and a corresponding second decoding branch.

Thus, the present invention provides an encoding/decoding scheme, which combines the advantages of all different coding algorithms and avoids the disadvantages of these coding algorithms which come up, when the signal portion would have to be encoded, by an algorithm that does not fit to a certain coding algorithm. Furthermore, the present invention avoids any disadvantages, which would come up, if the different time/frequency resolution requirements raised by different audio signal portions in different encoding branches had not been accounted for. Instead, due to the variable time/frequency resolution of time/frequency converters in both branches, any artifacts are at least reduced or even completely avoided, which would come up in the scenario where the same time/frequency resolution would be applied for both coding branches, or in which only a fixed time/frequency resolution would be possible for any coding branches.

The second switch again decides between two processing branches, but in a domain different from the "outer" first branch domain. Again one "inner" branch is mainly motivated by a source model or by SNR calculations, and the other "inner" branch can be motivated by a sink model and/or a psycho acoustic model, i.e. by masking or at least includes frequency/spectral domain coding aspects. Exemplarily, one "inner" branch has a frequency domain encoder/spectral converter and the other branch has an encoder coding on the other domain such as the LPC domain, wherein this encoder is for example an CELP or ACELP quantizer/scaler processing an input signal without a spectral conversion.

A further embodiment is an audio encoder comprising a first information sink oriented encoding branch such as a spectral domain encoding branch, a second information source or SNR oriented encoding branch such as an LPC-domain encoding branch, and a switch for switching between the first encoding branch and the second encoding branch, wherein the second encoding branch comprises a converter into a specific domain different from the time domain such as an LPC analysis stage generating an excitation signal, and wherein the second encoding branch furthermore comprises a specific domain such as LPC domain processing branch and a specific spectral domain such as LPC spectral domain processing branch, and an additional switch for switching between the specific domain coding branch and the specific spectral domain coding branch.

A further embodiment of the invention is an audio decoder comprising a first domain such as a spectral domain decoding branch, a second domain such as an LPC domain decoding branch for decoding a signal such as an excitation signal in the second domain, and a third domain such as an LPC-spectral decoder branch for decoding a signal such as an excitation signal in a third domain such as an LPC spectral domain, wherein the third domain is obtained by performing a frequency conversion from the second domain wherein a first switch for the second domain signal and the third domain signal is provided, and wherein a second switch for switching between the first domain decoder and the decoder for the second domain or the third domain is provided.

BRIEF DESCRIPTION OF THE DRAWINGS

Embodiments of the present invention are subsequently described with respect to the attached drawings, in which:

FIG. 13A illustrates the interrelation between resolution and window/transform lengths;

FIG. 13B illustrates an overview of a set of transform windows for the first coding branch and a transition from the first to the second coding branch;

FIG. 13C illustrates a plurality of different window sequences including window sequences for the first coding branch and sequences for a transition to the second branch;

FIG. 14E illustrates an exemplary sequence of ACELP frames and TCX frames within a super frame division;

FIG. 14F illustrates different transform lengths corresponding to different time/frequency resolutions for the second encoding branch; and FIG. 14G illustrates a construction of a window using the definitions of FIG. 14F.

DETAILED DESCRIPTION OF THE INVENTION

Figure 11A:
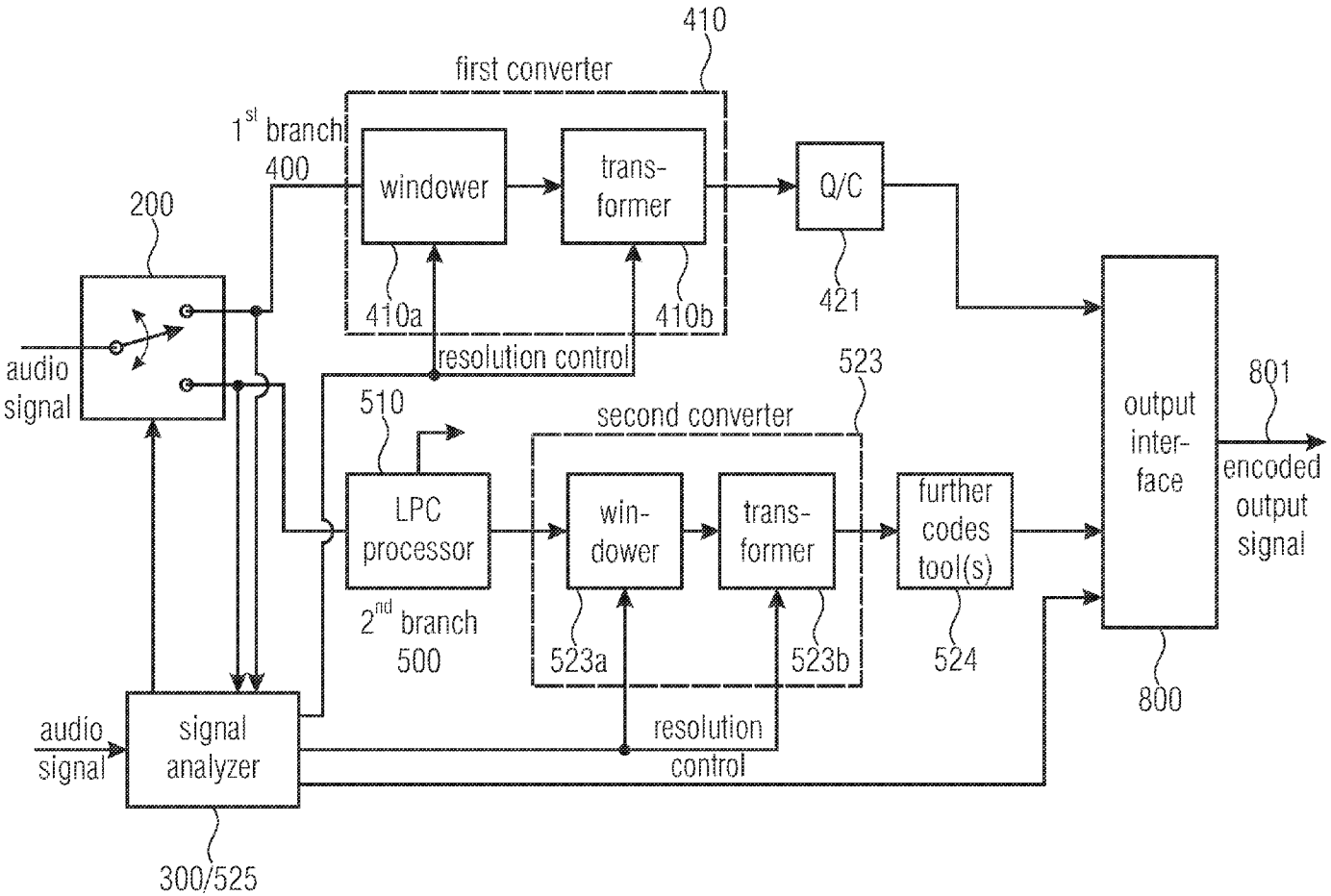
FIG. 11A illustrates a block diagram of an audio encoder in accordance with another aspect of the present invention.

FIG. 11A illustrates an embodiment of an audio encoder for encoding an audio signal. The encoder comprise a first coding branch 400 for encoding an audio signal using a first coding algorithm to obtain a first encoded signal.

The audio encoder furthermore comprises a second coding branch 500 for encoding an audio signal using a second coding algorithm to obtain a second encoded signal. The first coding algorithm is different from the second coding algorithm. Additionally, a first switch 200 for switching between the first coding branch and the second coding branch is provided so that, for a portion of the audio signal, either the first encoded signal or the second encoded signal is in an encoder output signal 801.

The audio encoder illustrated in FIG. 11A additionally comprises a signal analyzer 300/525, which is configured for analyzing a portion of the audio signal to determine, whether the portion of the audio signal is represented as the first encoded signal or the second encoded signal in the encoder output signal 801.

The signal analyzer 300/525 is furthermore configured for variably determining a respective time/frequency resolution of a first converter 410 in the first coding branch 400 or a second converter 523 in the second encoding branch 500. This time/frequency resolution is applied, when the first encoded signal or the second encoded signal representing the portion of the audio signal is generated.

The audio encoder additionally comprises an output interface 800 for generating the encoder output signal 801 comprising an encoded representation of the portion of the audio signal and an information indicating whether the representation of the audio signal is the first encoded signal or the second encoded signal, and indicating the time/frequency resolution used for decoding the first encoded signal and the second encoded signal.

The second encoding branch is different from the first encoding branch in that the second encoding branch additionally comprises a domain converter for converting the audio signal from the domain, in which the audio signal is processed in the first encoding branch into a different domain. Advantageously the domain converter is an LPC processor 510, but the domain converter can be implemented in any other way as long as the domain converter is different from the first converter 410 and the second converter 523.

The first converter 410 is a time/frequency converter advantageously comprising a windower 410*a* and a transformer 410*b*. The windower 410*a* applies an analysis window to the input audio signal, and the transformer 410*b* performs a conversion of the windowed signal into a spectral representation.

Analogously, the second converter 523 advantageously comprises a windower 523*a* and a subsequently connected transformer 523*b*. The windower 523*a* receives the signal output by the domain converter 510 and outputs the windowed representation thereof. The result of one analysis window applied by the windower 523*a* is input into the transformer 523*b* to form a spectral representation. The transformer can be an FFT or advantageously MDCT processor implementing a corresponding algorithm in software or hardware or in a mixed hardware/software implementation. Alternatively, the transformer can be a filterbank implementation such as a QMF filterbank which can be based on a real-valued or complex modulation of a prototype filter. For specific filterbank implementations, a window is applied. However, for other filterbank implementations, a windowing as needed for a transform algorithm based on a FFT of MDCT is not necessary. When a filterbank implementation is used, then the filterbank is a variable resolution filterbank and the resolution controls the frequency resolution of the filterbank, and additionally, the time resolution or only the frequency resolution and not the time resolution. When however, the converter is implemented as an FFT or MDCT or any other corresponding transformer, then the frequency resolution is connected to the time resolution in that an increase of the frequency resolution obtained by a larger block length in time automatically corresponds to a lower time resolution and vice versa.

Additionally, the first coding branch may comprise a quantizer/coder stage 421, and the second encoding branch may also comprise one or more further coding tools 524.

Importantly, the signal analyzer is configured for generating a resolution control signal for the first converter 510 and for the second converter 523. Thus, an independent resolution control in both coding branches is implemented in order to have a coding scheme which, on the one hand, provides a low bitrate, and on the other hand, provides a maximum quality in view of the low bitrate. In order to achieve the low bitrate goal, longer window lengths or longer transform lengths are advantageous, but in situations where these long lengths will result in an artifact due to the low time resolution, shorter window lengths and shorter transform lengths are applied, which results in a lower frequency resolution. Advantageously, the signal analyzer applies a statistical analysis or any other analysis which is suited to the corresponding algorithms in the encoding branches. In one implementation mode, in which the first coding branch is a frequency domain coding branch such as an AAC-based encoder, and in which the second coding branch comprises, as a domain converter, an LPC processor 510, the signal analyzer performs a speech/music discrimination so that the speech portion of the audio signal is fed into the second coding branch by correspondingly controlling the switch 200. A music portion of the audio signal is fed into the first coding branch 400 by correspondingly controlling the switch 200 as indicated by the switch control lines. Alternatively, as will be later discussed with respect to FIG. 1C or FIG. 4B, the switch can also be positioned before the output interface 800.

Furthermore, the signal analyzer can receive the audio signal input into the switch 200, or the audio signal output by the switch 200. Furthermore, the signal analyzer performs an analysis in order to not only feed the audio signal into the corresponding coding branch, but to also determine the appropriate time/frequency resolution of the respective converter in the corresponding coding branch, such as the first converter 410 and the second converter 523 as indicated by the resolution controlled lines connecting the signal analyzer and the converter.

Figure 11B:
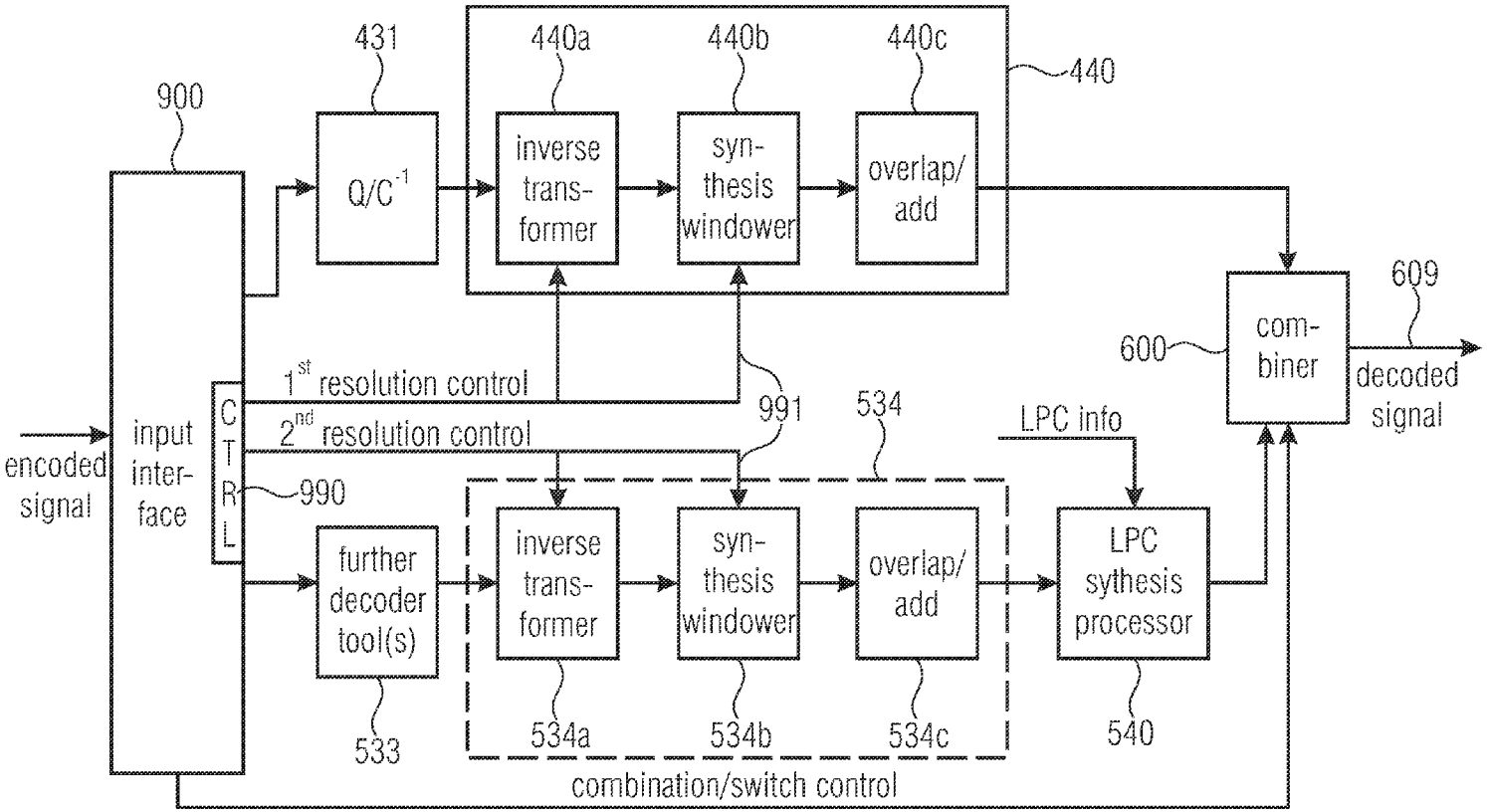
FIG. 11B illustrates a block diagram of another embodiment of an inventive audio decoder.

FIG. 11B comprises an embodiment of an audio decoder matching to the audio encoder in FIG. 11A.

The audio decoder in FIG. 11B is configured for decoding an encoded audio signal such as the encoder output signal 801 output by the output interface 800 in FIG. 11A. The encoded signal comprises a first encoded audio signal encoded in accordance with a first coding algorithm, a second encoded signal encoded in accordance with a second coding algorithm, the second coding algorithm being different from the first coding algorithm, and information, indicating whether the first coding algorithm or the second coding algorithm is used for decoding the first encoded signal and the second encoded signal, and a time/frequency resolution information for the first encoded audio signal and the second encoded audio signal.

The audio decoder comprises a first decoding branch 431, 440 for decoding the first encoded signal based on the first coding algorithm. Furthermore, the audio decoder comprises a second decoding branch for decoding the second encoded signal using the second coding algorithm.

The first decoding branch comprises a first controllable converter 440 for converting from a spectral domain into the time domain. The controllable converter is configured for being controlled using the time/frequency resolution information from the first encoded signal to obtain the first decoded signal.

The second decoding branch comprises a second controllable converter for converting from a spectral representation in a time representation, the second controllable converter 534 being configured for being controlled using the time/frequency resolution information 991 for the second encoded signal.

The decoder additionally comprises a controller 990 for controlling the first converter 540 and the second converter 534 in accordance with the time/frequency resolution information 991.

Furthermore, the decoder comprises a domain converter for generating a synthesis signal using the second decoded signal in order to cancel the domain conversion applied by the domain converter 510 in the encoder of FIG. 11A.

Advantageously, the domain converter 540 is an LPC synthesis processor, which is controlled using LPC filter information included in the encoded signal, where this LPC filter information has been generated by the LPC processor 510 in FIG. 11A and has been input into the encoder output signal as side information. The audio decoder finally comprises a combiner 600 for combining the first decoded signal output by the first domain converter 440 and the synthesis signal to obtain a decoded audio signal 609.

In the implementation, the first decoding branch additionally comprises a dequantizer/decoder stage 431 for reversing or at least for partly reversing the operations performed by the corresponding encoder stage 421. However, it is clear that quantization cannot be reversed, since this is a lossy operation. However, a dequantizer will reverse a certain non-uniformity in a quantization such as a logarithmic or companding quantization.

In the second decoding branch, the corresponding stage 533 is applied for undoing certain encoding operations applied by the stage 524. Advantageously, stage 524 comprises a uniform quantization. Therefore, the corresponding stage 533 will not have a specific dequantization stage for undoing a certain uniform quantization.

The first converter 440 as well as the second converter 534 may comprise a corresponding inverse transformer stage 440*a*, 534*a*, a synthesis window stage 440*b*, 534*b*, and the subsequently connected overlap/add stage 440*c*, 534*c*. The overlap/add stages are needed, when the converters, and more specifically, the transformer stages 440*a*, 534*a* apply aliasing introducing transforms such as a modified discrete cosine transform. Then, the overlap/add operation will perform a time domain aliasing cancellation (TDAC). When however, the transformers apply a non-aliasing introducing transform such as an inverse FFT, then an overlap/add stage 440*c* is not required. In such an implementation, a cross fading operation to avoid blocking artifacts may be applied.

Analogously, the combiner 600 may be a switched combiner or a cross fading combiner, or when aliasing is used for avoiding blocking artifacts, a transition windowing operation is implemented by the combiner similar to an overlap/add stage within a branch itself.

Figure 1A:
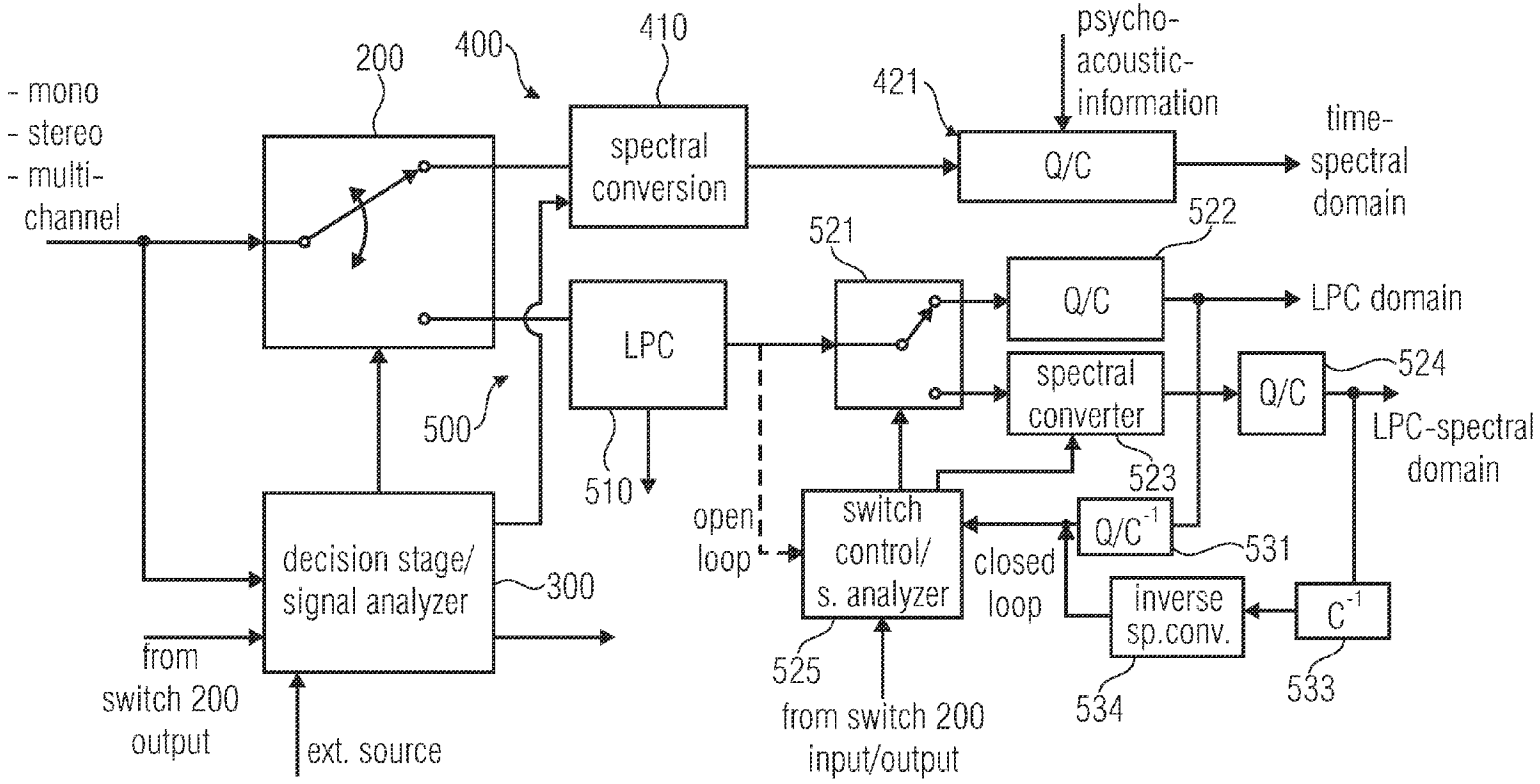
FIG. 1*a* is a block diagram of an encoding scheme in accordance with a first aspect of the present invention.

FIG. 1*a* illustrates an embodiment of the invention having two cascaded switches. A mono signal, a stereo signal or a multi-channel signal is input into the switch 200. The switch 200 is controlled by the decision stage 300. The decision stage receives, as an input, a signal input into block 200. Alternatively, the decision stage 300 may also receive a side information which is included in the mono signal, the stereo signal or the multi-channel signal or is at least associated to such a signal, where information is existing, which was, for example, generated, when originally producing the mono signal, the stereo signal or the multi-channel signal.

The decision stage 300 actuates the switch 200 in order to feed a signal either in the frequency encoding portion 400 illustrated at an upper branch of FIG. 1*a* or the LPC-domain encoding portion 500 illustrated at a lower branch in FIG. 1*a*. A key element of the frequency domain encoding branch is the spectral conversion block 410 which is operative to convert a common preprocessing stage output signal (as discussed later on) into a spectral domain. The spectral conversion block may include an MDCT algorithm, a QMF, an FFT algorithm, a Wavelet analysis or a filterbank such as a critically sampled filterbank having a certain number of filterbank channels, where the subband signals in this filterbank may be real valued signals or complex valued signals. The output of the spectral conversion block 410 is encoded using a spectral audio encoder 421, which may include processing blocks as known from the AAC coding scheme.

Generally, the processing in branch 400 is a processing in a perception based model or information sink model. Thus, this branch models the human auditory system receiving sound. Contrary thereto, the processing in branch 500 is to generate a signal in the excitation, residual or LPC domain. Generally, the processing in branch 500 is a processing in a speech model or an information generation model. For speech signals, this model is a model of the human speech/sound generation system generating sound. If, however, a sound from a different source requiring a different sound generation model is to be encoded, then the processing in branch 500 may be different.

In the lower encoding branch 500, a key element is an LPC device 510, which outputs an LPC information which is used for controlling the characteristics of an LPC filter. This LPC information is transmitted to a decoder. The LPC stage 510 output signal is an LPC-domain signal which consists of an excitation signal and/or a weighted signal.

Figure 7A:
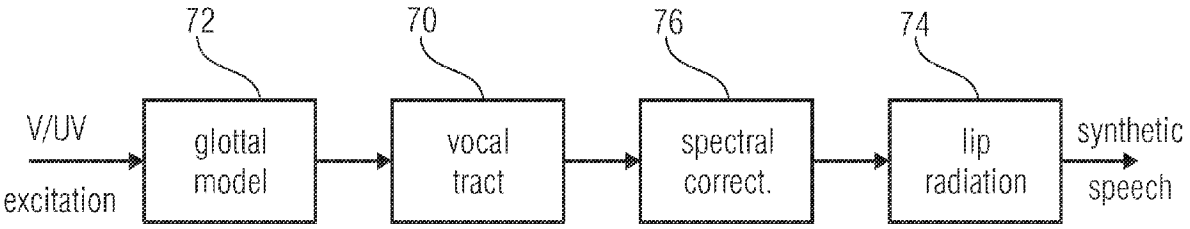
FIGS. 7*a* to 7*d* illustrate voiced/unvoiced excitation signals as an example for impulse-like signals.
Figure 7B:
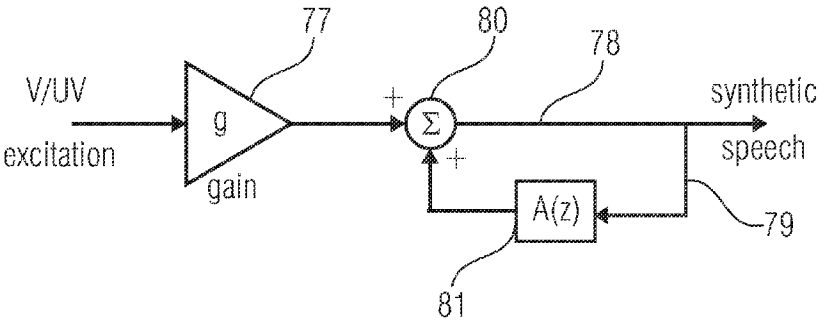
Figure 7C:
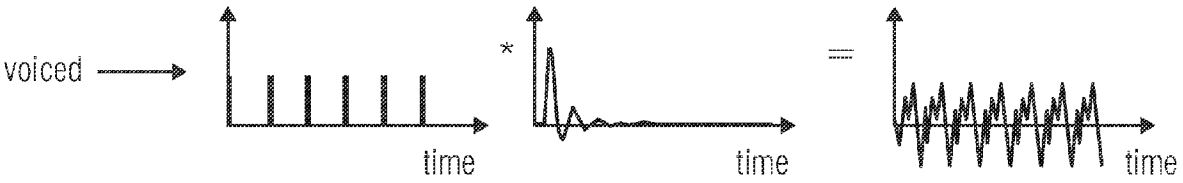
Figure 7D:
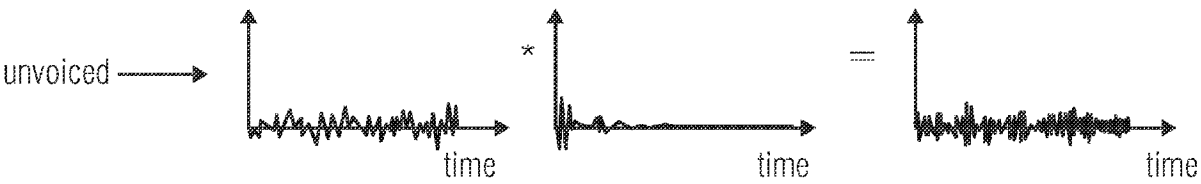
Figure 7E:
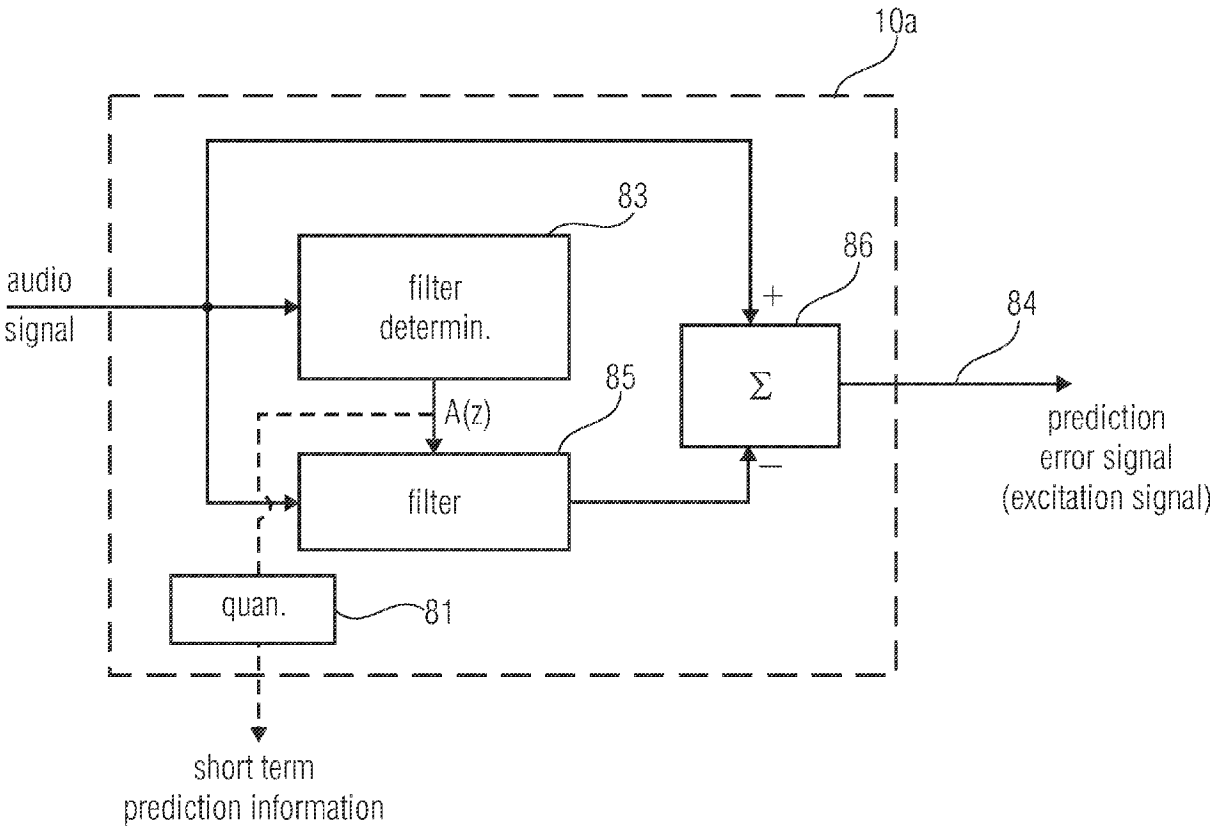
FIG. 7*e* illustrates an encoder-side LPC stage providing short-term prediction information and the prediction error (excitation) signal.
Figure 7F:
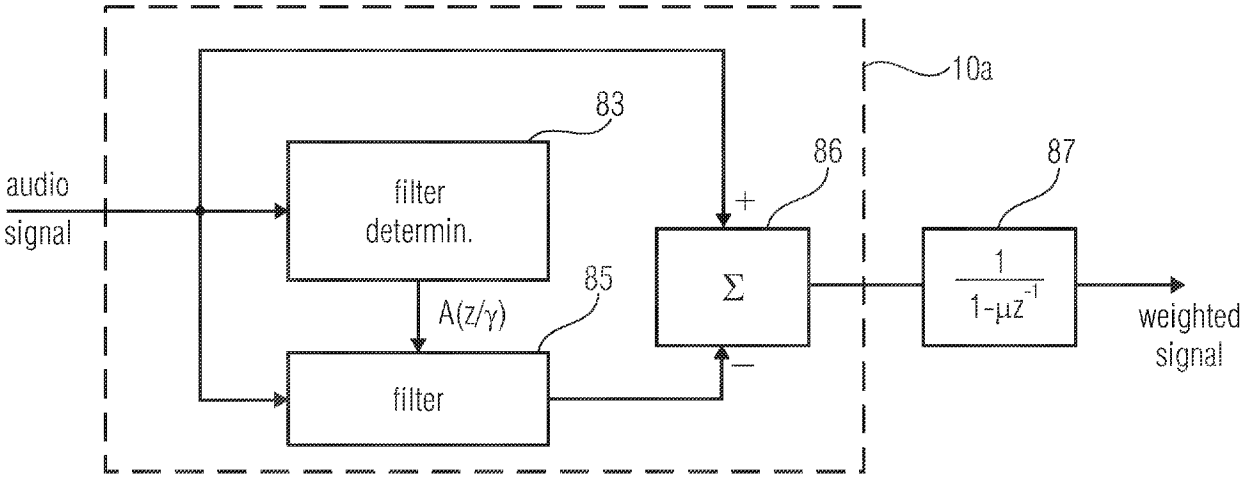
FIG. 7*f* illustrates a further embodiment of an LPC device for generating a weighted signal.

The LPC device generally outputs an LPC domain signal, which can be any signal in the LPC domain such as the excitation signal in FIG. 7*e* or a weighted signal in FIG. 7*f* or any other signal, which has been generated by applying LPC filter coefficients to an audio signal. Furthermore, an LPC device can also determine these coefficients and can also quantize/encode these coefficients.

The decision in the decision stage can be signal-adaptive so that the decision stage performs a music/speech discrimination and controls the switch 200 in such a way that music signals are input into the upper branch 400, and speech signals are input into the lower branch 500. In one embodiment, the decision stage is feeding its decision information into an output bit stream so that a decoder can use this decision information in order to perform the correct decoding operations.

Figure 1B:
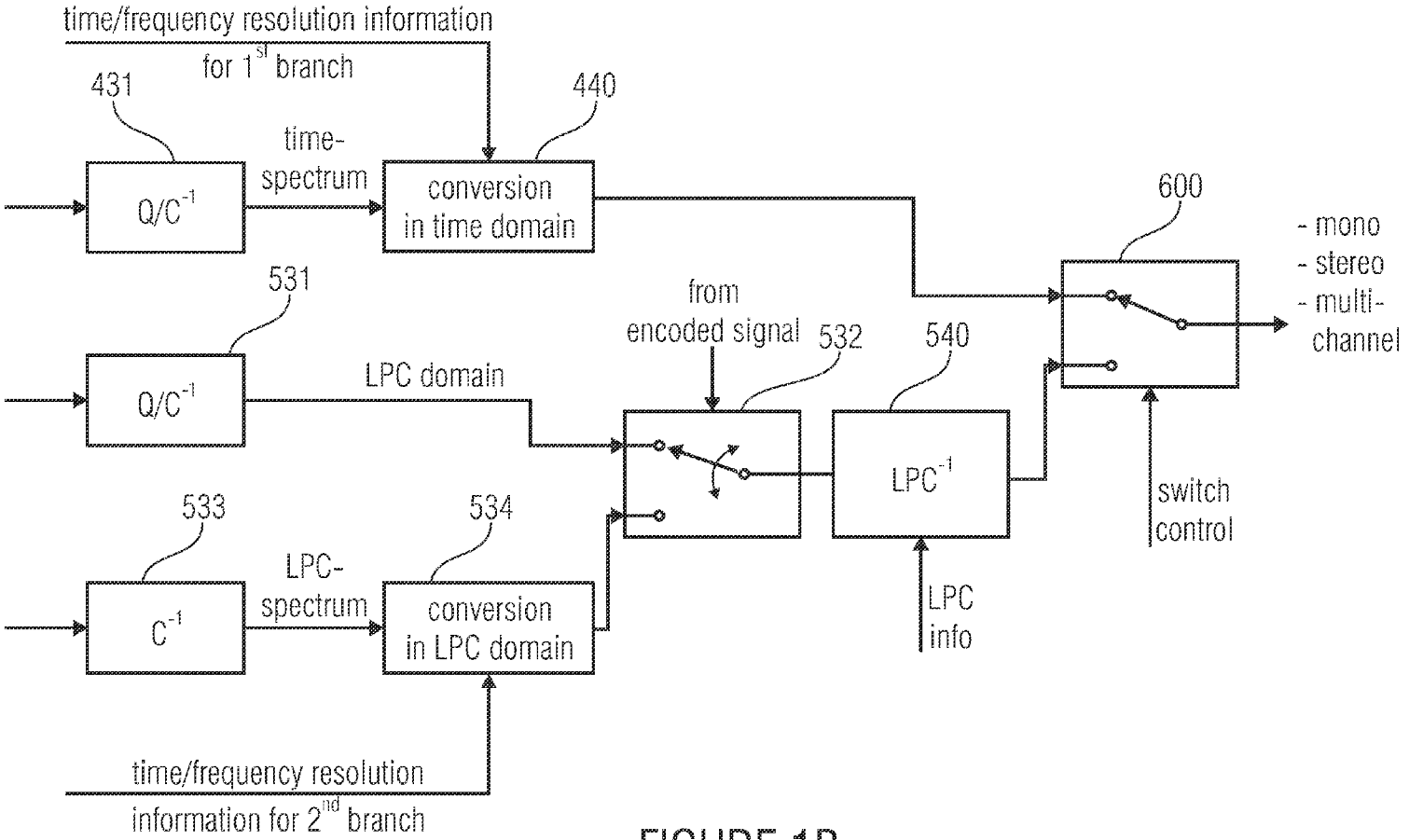
FIG. 1*b* is a block diagram of a decoding scheme in accordance with the first aspect of the present invention.

Such a decoder is illustrated in FIG. 1*b*. The signal output by the spectral audio encoder 421 is, after transmission, input into a spectral audio decoder 431. The output of the spectral audio decoder 431 is input into a time-domain converter 440. Analogously, the output of the LPC domain encoding branch 500 of FIG. 1*a* is received on the decoder side and processed by elements 531, 533, 534, and 532 for obtaining an LPC excitation signal. The LPC excitation signal is input into an LPC synthesis stage 540, which receives, as a further input, the LPC information generated by the corresponding LPC analysis stage 510. The output of the time-domain converter 440 and/or the output of the LPC synthesis stage 540 are input into a switch 600. The switch 600 is controlled via a switch control signal which was, for example, generated by the decision stage 300, or which was externally provided such as by a creator of the original mono signal, stereo signal or multichannel signal. The output of the switch 600 is a complete mono signal, stereo signal or multichannel signal.

The input signal into the switch 200 and the decision stage 300 can be a mono signal, a stereo signal, a multi-channel signal or generally an audio signal. Depending on the decision which can be derived from the switch 200 input signal or from any external source such as a producer of the original audio signal underlying the signal input into stage 200, the switch switches between the frequency encoding branch 400 and the LPC encoding branch 500. The frequency encoding branch 400 comprises a spectral conversion stage 410 and a subsequently connected quantizing/coding stage 421. The quantizing/coding stage can include any of the functionalities as known from modern frequency-domain encoders such as the AAC encoder. Furthermore, the quantization operation in the quantizing/coding stage 421 can be controlled via a psychoacoustic module which generates psychoacoustic information such as a psychoacoustic masking threshold over the frequency, where this information is input into the stage 421.

In the LPC encoding branch, the switch output signal is processed via an LPC analysis stage 510 generating LPC side info and an LPC-domain signal. The excitation encoder inventively comprises an additional switch for switching the further processing of the LPC-domain signal between a quantization/coding operation 522 in the LPC-domain or a quantization/coding stage 524, which is processing values in the LPC-spectral domain. To this end, a spectral converter 523 is provided at the input of the quantizing/coding stage 524. The switch 521 is controlled in an open loop fashion or a closed loop fashion depending on specific settings as, for example, described in the AMR-WB+ technical specification.

For the closed loop control mode, the encoder additionally includes an inverse quantizer/coder 531 for the LPC domain signal, an inverse quantizer/coder 533 for the LPC spectral domain signal and an inverse spectral converter 534 for the output of item 533. Both encoded and again decoded signals in the processing branches of the second encoding branch are input into the switch control device 525. In the switch control device 525, these two output signals are compared to each other and/or to a target function or a target function is calculated which may be based on a comparison of the distortion in both signals so that the signal having the lower distortion is used for deciding, which position the switch 521 should take. Alternatively, in case both branches provide non-constant bit rates, the branch providing the lower bit rate might be selected even when the signal to noise ratio of this branch is lower than the signal to noise ratio of the other branch. Alternatively, the target function could use, as an input, the signal to noise ratio of each signal and a bit rate of each signal and/or additional criteria in order to find the best decision for a specific goal. If, for example, the goal is such that the bit rate should be as low as possible, then the target function would heavily rely on the bit rate of the two signals output by the elements 531, 534. However, when the main goal is to have the best quality for a certain bit rate, then the switch control 525 might, for example, discard each signal which is above the allowed bit rate and when both signals are below the allowed bit rate, the switch control would select the signal having the better signal to noise ratio, i.e., having the smaller quantization/coding distortions.

The decoding scheme in accordance with the present invention is, as stated before, illustrated in FIG. 1*b*. For each of the three possible output signal kinds, a specific decoding/re-quantizing stage 431, 531 or 533 exists. While stage 431 outputs a time-spectrum which is converted into the time-domain using the frequency/time converter 440, stage 531 outputs an LPC-domain signal, and item 533 outputs an LPC-spectrum. In order to make sure that the input signals into switch 532 are both in the LPC-domain, the LPC-spectrum/LPC-converter 534 is provided. The output data of the switch 532 is transformed back into the time-domain using an LPC synthesis stage 540, which is controlled via encoder-side generated and transmitted LPC information. Then, subsequent to block 540, both branches have time-domain information which is switched in accordance with a switch control signal in order to finally obtain an audio signal such as a mono signal, a stereo signal or a multi-channel signal, which depends on the signal input into the encoding scheme of FIG. 1*a*.

Figure 1C:
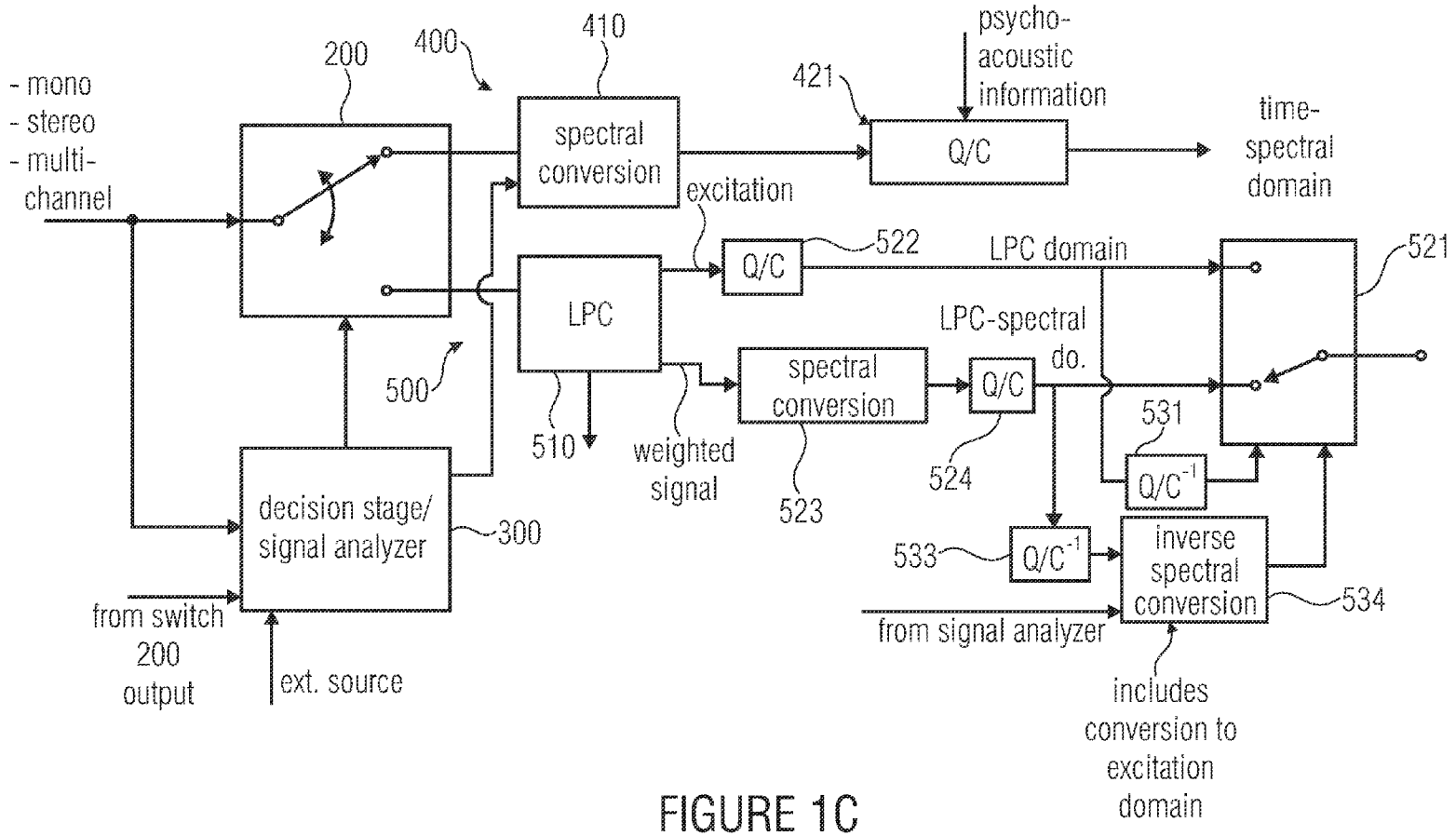
FIG. 1*c* is a block diagram of an encoding scheme in accordance with a further aspect of the present invention.
Figure 4A:
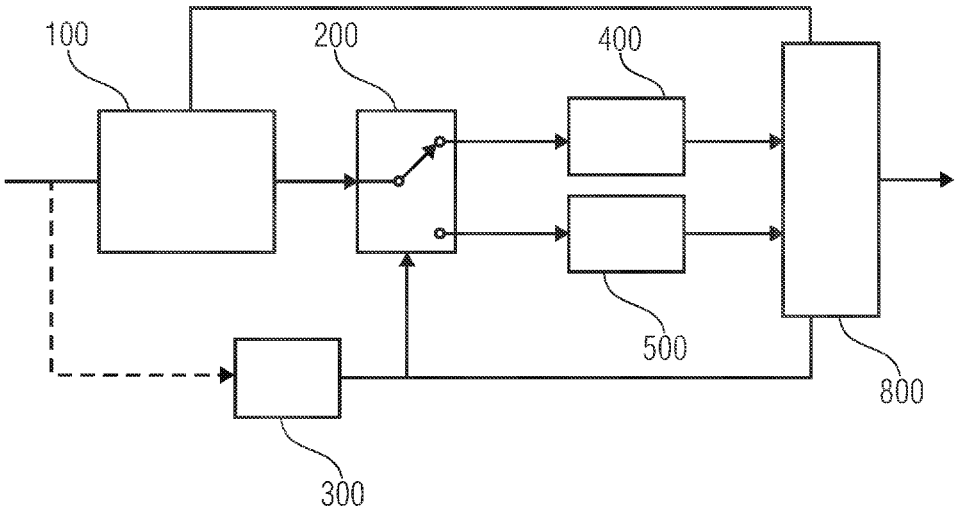
FIG. 4*a* illustrates a block diagram with a switch positioned before the encoding branches.
Figure 4B:
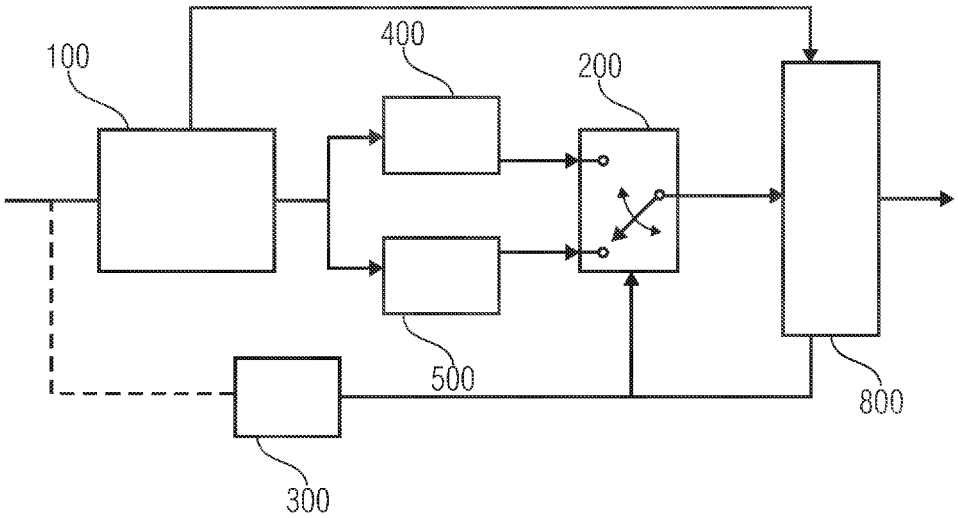
FIG. 4*b* illustrates a block diagram of an encoding scheme with the switch positioned subsequent to encoding the branches.

FIG. 1*c* illustrates a further embodiment with a different arrangement of the switch 521 similar to the principle of FIG. 4*b*.

Figure 2A:
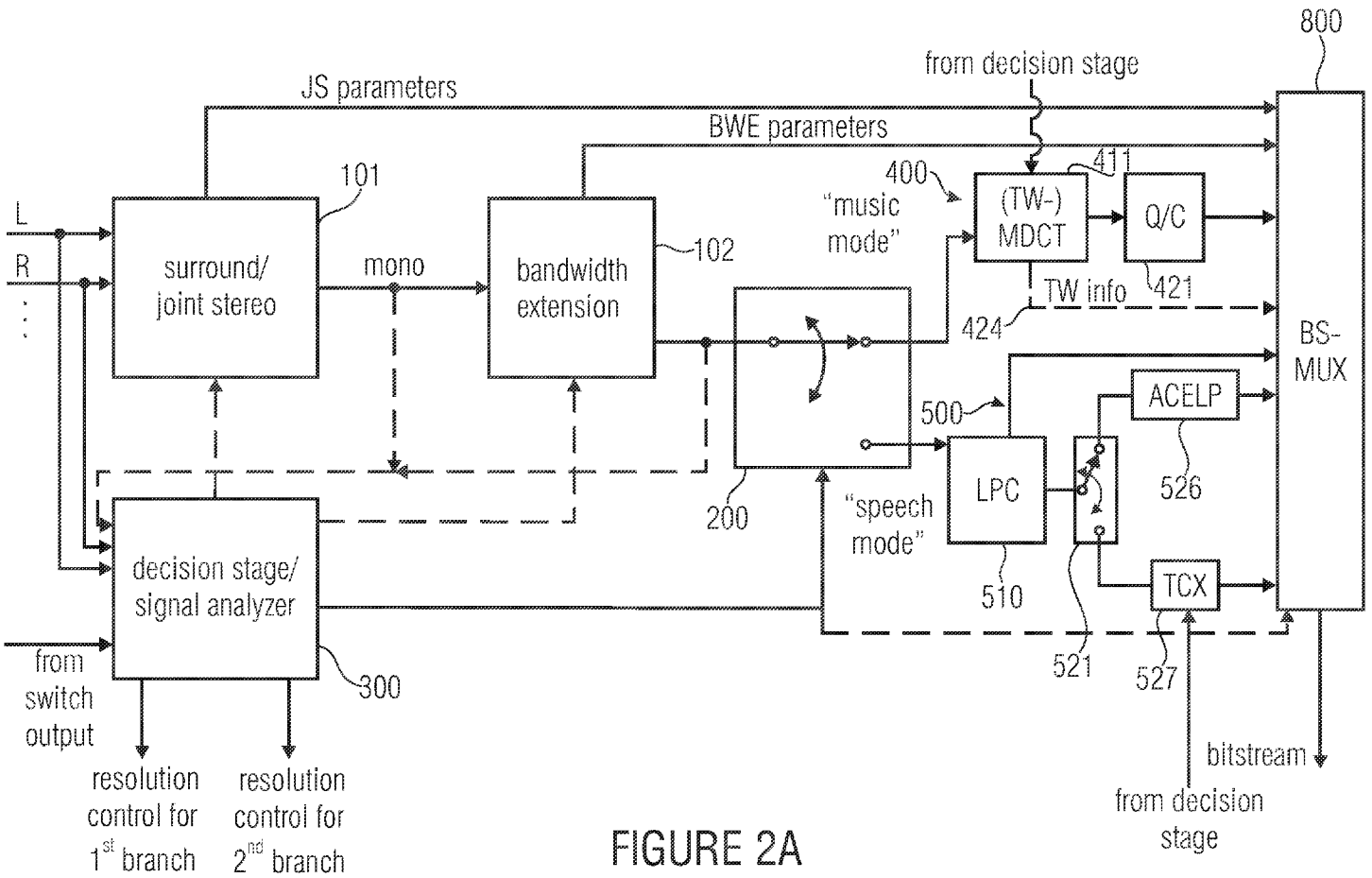
FIG. 2*a* is a block diagram of an encoding scheme in accordance with a second aspect of the present invention.

FIG. 2*a* illustrates an encoding scheme in accordance with a second aspect of the invention. A common preprocessing scheme connected to the switch 200 input may comprise a surround/joint stereo block 101 which generates, as an output, joint stereo parameters and a mono output signal, which is generated by downmixing the input signal which is a signal having two or more channels. Generally, the signal at the output of block 101 can also be a signal having more channels, but due to the downmixing functionality of block 101, the number of channels at the output of block 101 will be smaller than the number of channels input into block 101.

The common preprocessing scheme may comprise alternatively to the block 101 or in addition to the block 101 a bandwidth extension stage 102. In the FIG. 2*a* embodiment, the output of block 101 is input into the bandwidth extension block 102 which, in the encoder of FIG. 2*a*, outputs a band-limited signal such as the low band signal or the low pass signal at its output. Advantageously, this signal is down-sampled (e.g. by a factor of two) as well. Furthermore, for the high band of the signal input into block 102, bandwidth extension parameters such as spectral envelope parameters, inverse filtering parameters, noise floor parameters etc. as known from HE-AAC profile of MPEG-4 are generated and forwarded to a bitstream multiplexer 800.

Advantageously, the decision stage 300 receives the signal input into block 101 or input into block 102 in order to decide between, for example, a music mode or a speech mode. In the music mode, the upper encoding branch 400 is selected, while, in the speech mode, the lower encoding branch 500 is selected. Advantageously, the decision stage additionally controls the joint stereo block 101 and/or the bandwidth extension block 102 to adapt the functionality of these blocks to the specific signal. Thus, when the decision stage determines that a certain time portion of the input signal is of the first mode such as the music mode, then specific features of block 101 and/or block 102 can be controlled by the decision stage 300. Alternatively, when the decision stage 300 determines that the signal is in a speech mode or, generally, in a second LPC-domain mode, then specific features of blocks 101 and 102 can be controlled in accordance with the decision stage output.

Advantageously, the spectral conversion of the coding branch 400 is done using an MDCT operation which, even more advantageously, is the time-warped MDCT operation, where the strength or, generally, the warping strength can be controlled between zero and a high warping strength. In a zero warping strength, the MDCT operation in block 411 is a straight-forward MDCT operation known in the art. The time warping strength together with time warping side information can be transmitted/input into the bitstream multiplexer 800 as side information.

In the LPC encoding branch, the LPC-domain encoder may include an ACELP core 526 calculating a pitch gain, a pitch lag and/or codebook information such as a codebook index and gain. The TCX mode as known from 3GPP TS 26.290 incurs a processing of a perceptually weighted signal in the transform domain. A Fourier transformed weighted signal is quantized using a split multi-rate lattice quantization (algebraic VQ) with noise factor quantization. A transform is calculated in 1024, 512, or 256 sample windows. The excitation signal is recovered by inverse filtering the quantized weighted signal through an inverse weighting filter.

In the first coding branch 400, a spectral converter advantageously comprises a specifically adapted MDCT operation having certain window functions followed by a quantization/entropy encoding stage which may consist of a single vector quantization stage, but advantageously is a combined scalar quantizer/entropy coder similar to the quantizer/coder in the frequency domain coding branch, i.e., in item 421 of FIG. 2*a*.

In the second coding branch, there is the LPC block 510 followed by a switch 521, again followed by an ACELP block 526 or an TCX block 527. ACELP is described in 3GPP TS 26.190 and TCX is described in 3GPP TS 26.290. Generally, the ACELP block 526 receives an LPC excitation signal as calculated by a procedure as described in FIG. 7*e*. The TCX block 527 receives a weighted signal as generated by FIG. 7*f*.

In TCX, the transform is applied to the weighted signal computed by filtering the input signal through an LPC-based weighting filter. The weighting filter used embodiments of the invention is given by $(1-A(z/\gamma))/(1-\mu z^{-1})$. Thus, the weighted signal is an LPC domain signal and its transform is an LPC-spectral domain. The signal processed by ACELP block 526 is the excitation signal and is different from the signal processed by the block 527, but both signals are in the LPC domain.

Figure 2B:
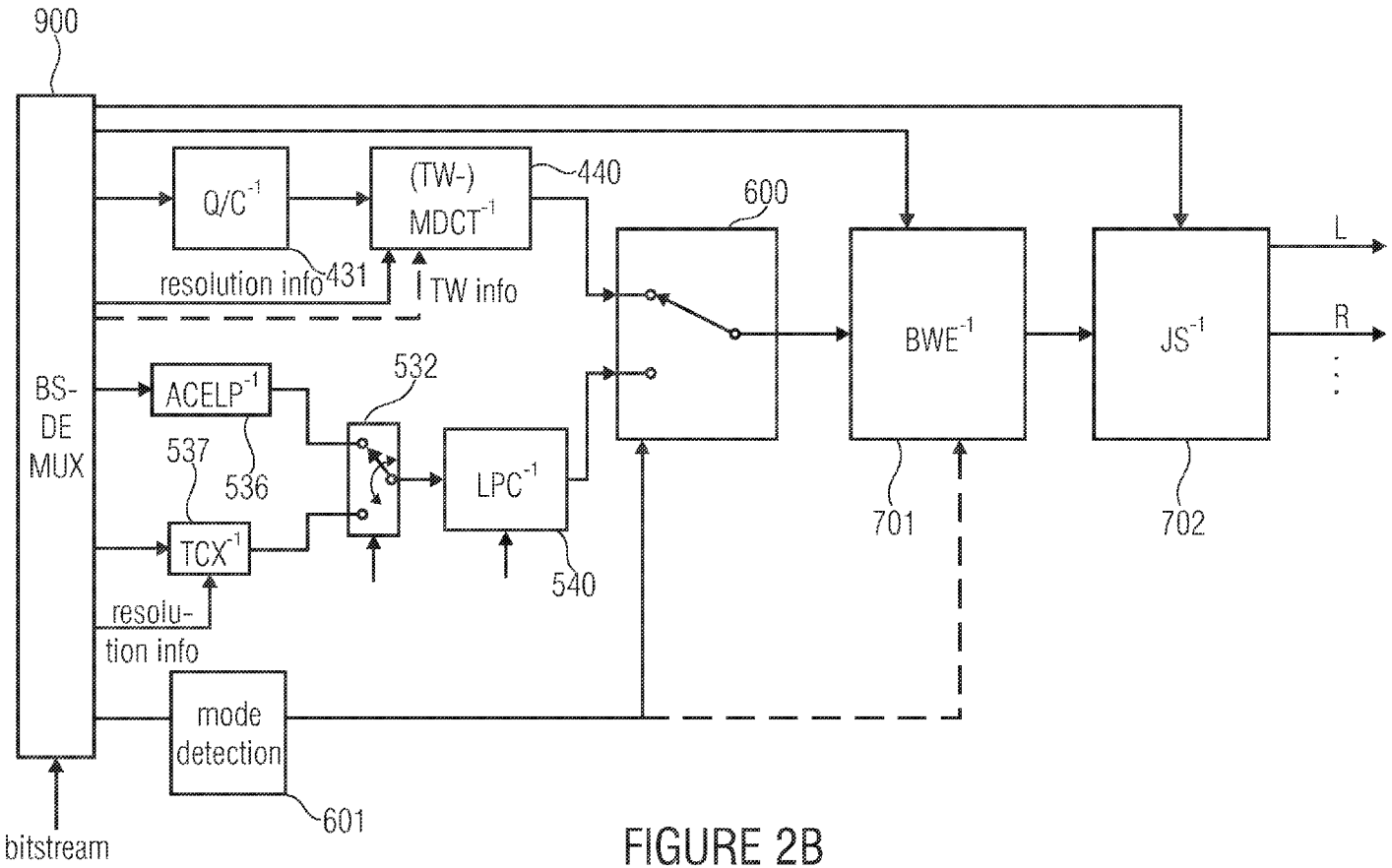
FIG. 2*b* is a schematic diagram of a decoding scheme in accordance with the second aspect of the present invention.

At the decoder side illustrated in FIG. 2*b*, after the inverse spectral transform in block 537, the inverse of the weighting filter is applied, that is $(1-\mu z^{-1})/(1-A(z/\gamma))$. Then, the signal is filtered through $(1-A(z))$ to go to the LPC excitation domain. Thus, the conversion to LPC domain block 534 and the TCX⁻block 537 include inverse transform and then filtering through $$\frac{(1-\mu z^{-1})}{(1-A(z/\gamma))}(1-A(z))$$

to convert from the weighted domain to the excitation domain.

Although item 510 in FIGS. 1*a*, 1*c*, 2*a*, 2*c* illustrates a single block, block 510 can output different signals as long as these signals are in the LPC domain. The actual mode of block 510 such as the excitation signal mode or the weighted signal mode can depend on the actual switch state. Alternatively, the block 510 can have two parallel processing devices, where one device is implemented similar to FIG. 7*e* and the other device is implemented as FIG. 7*f*. Hence, the LPC domain at the output of 510 can represent either the LPC excitation signal or the LPC weighted signal or any other LPC domain signal.

Figure 2C:
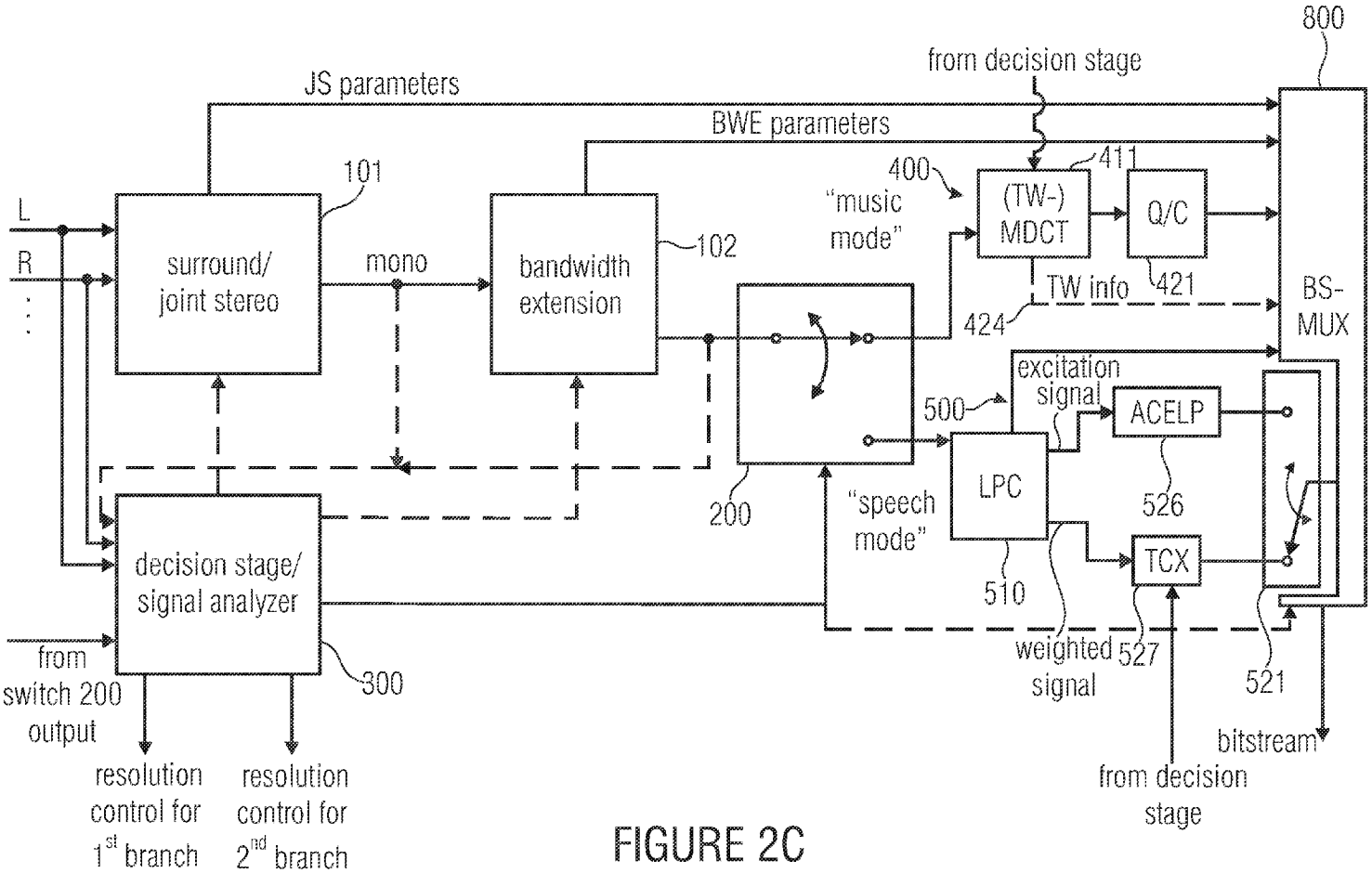
FIG. 2*c* is a block diagram of an encoding scheme in accordance with a further aspect of the present invention

In the second encoding branch (ACELP/TCX) of FIG. 2*a* or 2*c*, the signal is advantageously pre-emphasized through a filter $1-0.68z^{-1}$ before encoding. At the ACELP/TCX decoder in FIG. 2*b* the synthesized signal is deemphasized with the filter $1/(1-0.68z^{-1})$. The preemphasis can be part of the LPC block 510 where the signal is preemphasized before LPC analysis and quantization. Similarly, deemphasis can be part of the LPC synthesis block $LPC^{-1}$ 540.

FIG. 2*c* illustrates a further embodiment for the implementation of FIG. 2*a*, but with a different arrangement of the switch 521 similar to the principle of FIG. 4*b*.

In an embodiment, the first switch 200 (see FIG. 1*a* or 2*a*) is controlled through an open-loop decision (as in FIG. 4*a*) and the second switch is controlled through a closed-loop decision (as in FIG. 4*b*).

For example, FIG. 2*c*, has the second switch placed after the ACELP and TCX branches as in FIG. 4*b*. Then, in the first processing branch, the first LPC domain represents the LPC excitation, and in the second processing branch, the second LPC domain represents the LPC weighted signal. That is, the first LPC domain signal is obtained by filtering through $(1-A(z))$ to convert to the LPC residual domain, while the second LPC domain signal is obtained by filtering through the filter $(1-A(z/\gamma))/(1-\mu z^{-1})$ to convert to the LPC weighted domain.

FIG. 2*b* illustrates a decoding scheme corresponding to the encoding scheme of FIG. 2*a*. The bitstream generated by bitstream multiplexer 800 of FIG. 2*a* is input into a bitstream demultiplexer 900. Depending on an information derived for example from the bitstream via a mode detection block 601, a decoder-side switch 600 is controlled to either forward signals from the upper branch or signals from the lower branch to the bandwidth extension block 701. The bandwidth extension block 701 receives, from the bitstream demultiplexer 900, side information and, based on this side information and the output of the mode decision 601, reconstructs the high band based on the low band output by switch 600.

The full band signal generated by block 701 is input into the joint stereo/surround processing stage 702, which reconstructs two stereo channels or several multi-channels. Generally, block 702 will output more channels than were input into this block. Depending on the application, the input into block 702 may even include two channels such as in a stereo mode and may even include more channels as long as the output by this block has more channels than the input into this block.

The switch 200 has been shown to switch between both branches so that only one branch receives a signal to process and the other branch does not receive a signal to process. In an alternative embodiment, however, the switch may also be arranged subsequent to for example the audio encoder 421 and the excitation encoder 522, 523, 524, which means that both branches 400, 500 process the same signal in parallel. In order to not double the bitrate, however, only the signal output by one of those encoding branches 400 or 500 is selected to be written into the output bitstream. The decision stage will then operate so that the signal written into the bitstream minimizes a certain cost function, where the cost function can be the generated bitrate or the generated perceptual distortion or a combined rate/distortion cost function. Therefore, either in this mode or in the mode illustrated in the Figures, the decision stage can also operate in a closed loop mode in order to make sure that, finally, only the encoding branch output is written into the bitstream which has for a given perceptual distortion the lowest bitrate or, for a given bitrate, has the lowest perceptual distortion. In the closed loop mode, the feedback input may be derived from outputs of the three quantizer/scaler blocks 421, 522 and 424 in FIG. 1*a*.

In the implementation having two switches, i.e., the first switch 200 and the second switch 521, it is advantageous that the time resolution for the first switch is lower than the time resolution for the second switch. Stated differently, the blocks of the input signal into the first switch, which can be switched via a switch operation are larger than the blocks switched by the second switch operating in the LPC-domain. Exemplarily, the frequency domain/LPC-domain switch 200 may switch blocks of a length of 1024 samples, and the second switch 521 can switch blocks having 256 samples each.

Although some of the FIGS. 1*a* through 10*b* are illustrated as block diagrams of an apparatus, these figures simultaneously are an illustration of a method, where the block functionalities correspond to the method steps.

Figure 3A:
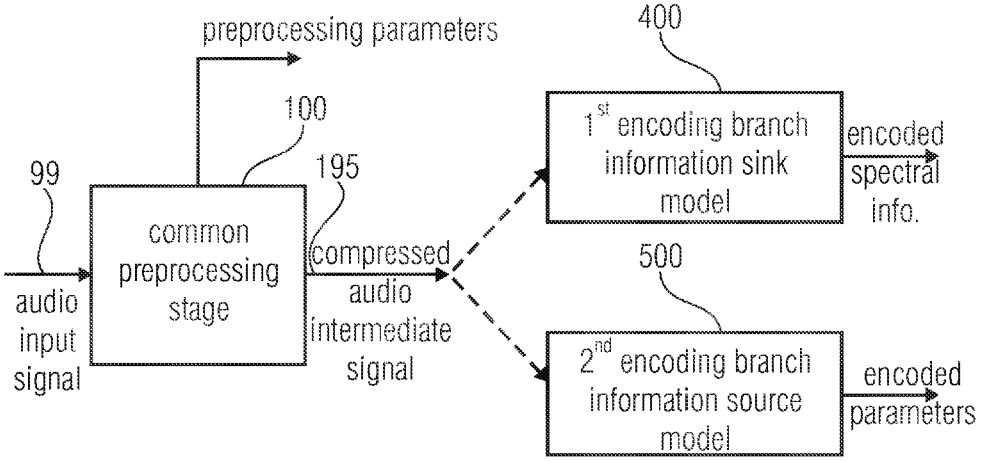
FIG. 3*a* illustrates a block diagram of an encoding scheme in accordance with a further aspect of the present invention.

FIG. 3*a* illustrates an audio encoder for generating an encoded audio signal as an output of the first encoding branch 400 and a second encoding branch 500. Furthermore, the encoded audio signal includes side information such as pre-processing parameters from the common pre-processing stage or, as discussed in connection with preceding Figs., switch control information.

Advantageously, the first encoding branch is operative in order to encode an audio intermediate signal 195 in accordance with a first coding algorithm, wherein the first coding algorithm has an information sink model. The first encoding branch 400 generates the first encoder output signal which is an encoded spectral information representation of the audio intermediate signal 195.

Furthermore, the second encoding branch 500 is adapted for encoding the audio intermediate signal 195 in accordance with a second encoding algorithm, the second coding algorithm having an information source model and generating, in a second encoder output signal, encoded parameters for the information source model representing the intermediate audio signal.

The audio encoder furthermore comprises the common pre-processing stage for pre-processing an audio input signal 99 to obtain the audio intermediate signal 195. Specifically, the common pre-processing stage is operative to process the audio input signal 99 so that the audio intermediate signal 195, i.e., the output of the common pre-processing algorithm is a compressed version of the audio input signal.

A method of audio encoding for generating an encoded audio signal, comprises a step of encoding 400 an audio intermediate signal 195 in accordance with a first coding algorithm, the first coding algorithm having an information sink model and generating, in a first output signal, encoded spectral information representing the audio signal; a step of encoding 500 an audio intermediate signal 195 in accordance with a second coding algorithm, the second coding algorithm having an information source model and generating, in a second output signal, encoded parameters for the information source model representing the intermediate signal 195, and a step of commonly pre-processing 100 an audio input signal 99 to obtain the audio intermediate signal 195, wherein, in the step of commonly pre-processing the audio input signal 99 is processed so that the audio intermediate signal 195 is a compressed version of the audio input signal 99, wherein the encoded audio signal includes, for a certain portion of the audio signal either the first output signal or the second output signal. The method includes the further step encoding a certain portion of the audio intermediate signal either using the first coding algorithm or using the second coding algorithm or encoding the signal using both algorithms and outputting in an encoded signal either the result of the first coding algorithm or the result of the second coding algorithm.

Generally, the audio encoding algorithm used in the first encoding branch 400 reflects and models the situation in an audio sink. The sink of an audio information is normally the human ear. The human ear can be modeled as a frequency analyzer. Therefore, the first encoding branch outputs encoded spectral information. Advantageously, the first encoding branch furthermore includes a psychoacoustic model for additionally applying a psychoacoustic masking threshold. This psychoacoustic masking threshold is used when quantizing audio spectral values where, advantageously, the quantization is performed such that a quantization noise is introduced by quantizing the spectral audio values, which are hidden below the psychoacoustic masking threshold.

The second encoding branch represents an information source model, which reflects the generation of audio sound. Therefore, information source models may include a speech model which is reflected by an LPC analysis stage, i.e., by transforming a time domain signal into an LPC domain and by subsequently processing the LPC residual signal, i.e., the excitation signal. Alternative sound source models, however, are sound source models for representing a certain instrument or any other sound generators such as a specific sound source existing in real world. A selection between different sound source models can be performed when several sound source models are available, for example based on an SNR calculation, i.e., based on a calculation, which of the source models is the best one suitable for encoding a certain time portion and/or frequency portion of an audio signal. Advantageously, however, the switch between encoding branches is performed in the time domain, i.e., that a certain time portion is encoded using one model and a certain different time portion of the intermediate signal is encoded using the other encoding branch.

Information source models are represented by certain parameters. Regarding the speech model, the parameters are LPC parameters and coded excitation parameters, when a modern speech coder such as AMR-WB+ is considered. The AMR-WB+ comprises an ACELP encoder and a TCX encoder. In this case, the coded excitation parameters can be global gain, noise floor, and variable length codes.

Figure 3B:
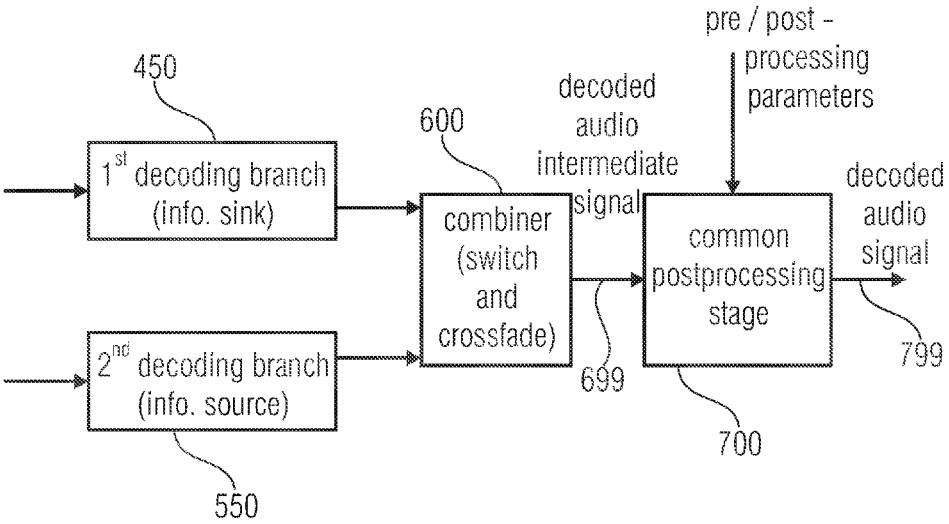
FIG. 3*b* illustrates a block diagram of a decoding scheme in accordance with the further aspect of the present invention.

FIG. 3*b* illustrates a decoder corresponding to the encoder illustrated in FIG. 3*a*. Generally, FIG. 3*b* illustrates an audio decoder for decoding an encoded audio signal to obtain a decoded audio signal 799. The decoder includes the first decoding branch 450 for decoding an encoded signal encoded in accordance with a first coding algorithm having an information sink model. The audio decoder furthermore includes a second decoding branch 550 for decoding an encoded information signal encoded in accordance with a second coding algorithm having an information source model. The audio decoder furthermore includes a combiner for combining output signals from the first decoding branch 450 and the second decoding branch 550 to obtain a combined signal. The combined signal which is illustrated in FIG. 3*b* as the decoded audio intermediate signal 699 is input into a common post processing stage for post processing the decoded audio intermediate signal 699, which is the combined signal output by the combiner 600 so that an output signal of the common pre-processing stage is an expanded version of the combined signal. Thus, the decoded audio signal 799 has an enhanced information content compared to the decoded audio intermediate signal 699. This information expansion is provided by the common post processing stage with the help of pre/post processing parameters which can be transmitted from an encoder to a decoder, or which can be derived from the decoded audio intermediate signal itself. Advantageously, however, pre/post processing parameters are transmitted from an encoder to a decoder, since this procedure allows an improved quality of the decoded audio signal.

Figure 3C:
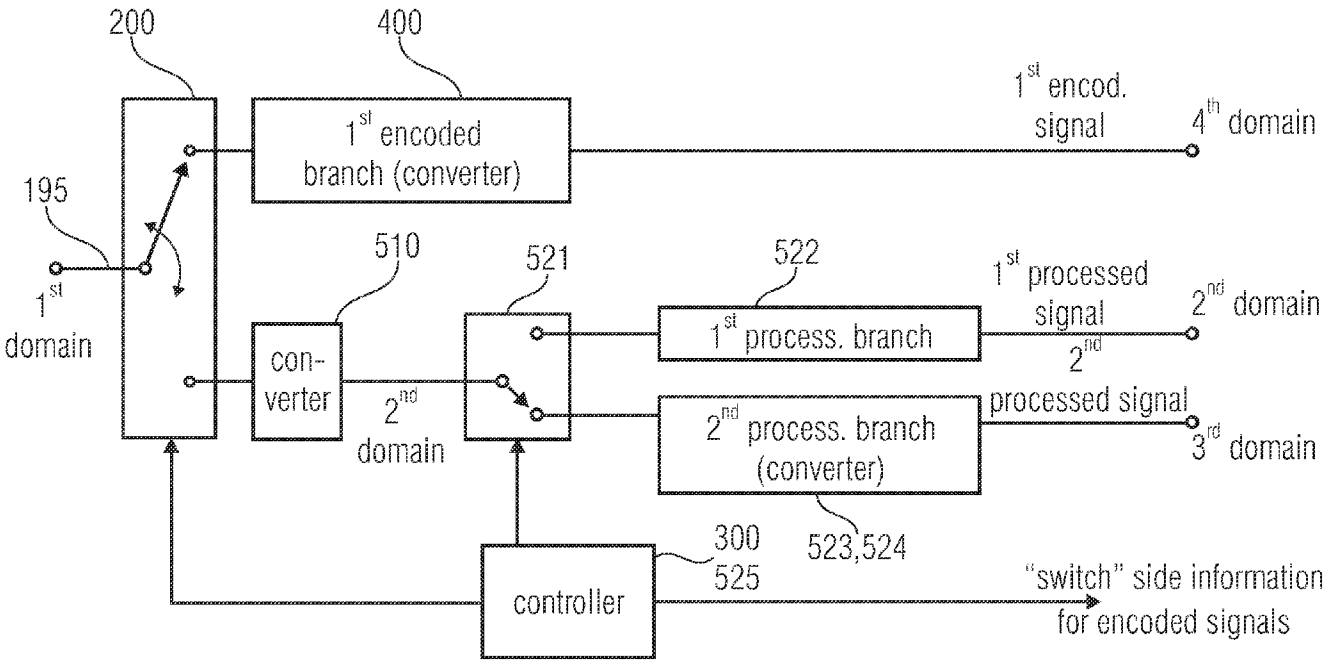
FIG. 3*c* illustrates a schematic representation of the encoding apparatus/method with cascaded switches.

FIG. 3*c* illustrates an audio encoder for encoding an audio input signal 195, which may be equal to the intermediate audio signal 195 of FIG. 3*a* in accordance with the embodiment of the present invention. The audio input signal 195 is present in a first domain which can, for example, be the time domain but which can also be any other domain such as a frequency domain, an LPC domain, an LPC spectral domain or any other domain. Generally, the conversion from one domain to the other domain is performed by a conversion algorithm such as any of the well-known time/frequency conversion algorithms or frequency/time conversion algorithms.

An alternative transform from the time domain, for example in the LPC domain is the result of LPC filtering a time domain signal which results in an LPC residual signal or excitation signal. Any other filtering operations producing a filtered signal which has an impact on a substantial number of signal samples before the transform can be used as a transform algorithm as the case may be. Therefore, weighting an audio signal using an LPC based weighting filter is a further transform, which generates a signal in the LPC domain. In a time/frequency transform, the modification of a single spectral value will have an impact on all time domain values before the transform. Analogously, a modification of any time domain sample will have an impact on each frequency domain sample. Similarly, a modification of a sample of the excitation signal in an LPC domain situation will have, due to the length of the LPC filter, an impact on a substantial number of samples before the LPC filtering. Similarly, a modification of a sample before an LPC transformation will have an impact on many samples obtained by this LPC transformation due to the inherent memory effect of the LPC filter.

The audio encoder of FIG. 3*c* includes a first coding branch 400 which generates a first encoded signal. This first encoded signal may be in a fourth domain which is, in the embodiment, the time-spectral domain, i.e., the domain which is obtained when a time domain signal is processed via a time/frequency conversion.

Therefore, the first coding branch 400 for encoding an audio signal uses a first coding algorithm to obtain a first encoded signal, where this first coding algorithm may or may not include a time/frequency conversion algorithm.

The audio encoder furthermore includes a second coding branch 500 for encoding an audio signal. The second coding branch 500 uses a second coding algorithm to obtain a second encoded signal, which is different from the first coding algorithm.

The audio encoder furthermore includes a first switch 200 for switching between the first coding branch 400 and the second coding branch 500 so that for a portion of the audio input signal, either the first encoded signal at the output of block 400 or the second encoded signal at the output of the second encoding branch is included in an encoder output signal. Thus, when for a certain portion of the audio input signal 195, the first encoded signal in the fourth domain is included in the encoder output signal, the second encoded signal which is either the first processed signal in the second domain or the second processed signal in the third domain is not included in the encoder output signal. This makes sure that this encoder is bit rate efficient. In embodiments, any time portions of the audio signal which are included in two different encoded signals are small compared to a frame length of a frame as will be discussed in connection with FIG. 3*e*. These small portions are useful for a cross fade from one encoded signal to the other encoded signal in the case of a switch event in order to reduce artifacts that might occur without any cross fade. Therefore, apart from the cross-fade region, each time domain block is represented by an encoded signal of only a single domain.

As illustrated in FIG. 3*c*, the second coding branch 500 comprises a converter 510 for converting the audio signal in the first domain, i.e., signal 195 into a second domain.

Furthermore, the second coding branch 500 comprises a first processing branch 522 for processing an audio signal in the second domain to obtain a first processed signal which is, advantageously, also in the second domain so that the first processing branch 522 does not perform a domain change.

The second encoding branch 500 furthermore comprises a second processing branch 523, 524 which converts the audio signal in the second domain into a third domain, which is different from the first domain and which is also different from the second domain and which processes the audio signal in the third domain to obtain a second processed signal at the output of the second processing branch 523, 524.

Furthermore, the second coding branch comprises a second switch 521 for switching between the first processing branch 522 and the second processing branch 523, 524 so that, for a portion of the audio signal input into the second coding branch, either the first processed signal in the second domain or the second processed signal in the third domain is in the second encoded signal.

Figure 3D:
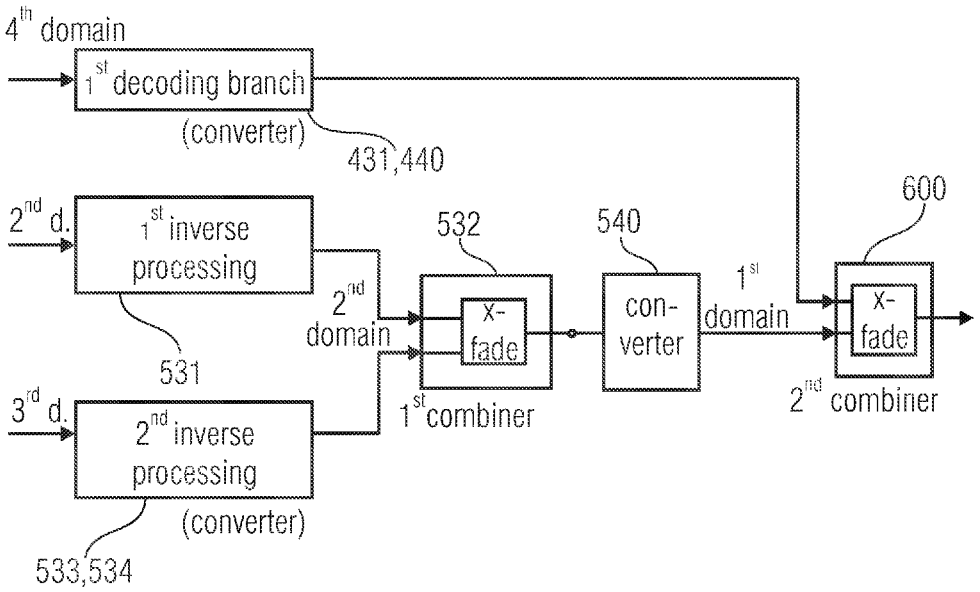
FIG. 3*d* illustrates a schematic diagram of an apparatus or method for decoding, in which cascaded combiners are used.

FIG. 3*d* illustrates a corresponding decoder for decoding an encoded audio signal generated by the encoder of FIG. 3*c*. Generally, each block of the first domain audio signal is represented by either a second domain signal, a third domain signal or a fourth domain encoded signal apart from an optional cross fade region which is, advantageously, short compared to the length of one frame in order to obtain a system which is as much as possible at the critical sampling limit. The encoded audio signal includes the first coded signal, a second coded signal in a second domain and a third coded signal in a third domain, wherein the first coded signal, the second coded signal and the third coded signal all relate to different time portions of the decoded audio signal and wherein the second domain, the third domain and the first domain for a decoded audio signal are different from each other.

The decoder comprises a first decoding branch for decoding based on the first coding algorithm. The first decoding branch is illustrated at 431, 440 in FIG. 3*d* and advantageously comprises a frequency/time converter. The first coded signal is advantageously in a fourth domain and is converted into the first domain which is the domain for the decoded output signal.

The decoder of FIG. 3*d* furthermore comprises a second decoding branch which comprises several elements. These elements are a first inverse processing branch 531 for inverse processing the second coded signal to obtain a first inverse processed signal in the second domain at the output of block 531. The second decoding branch furthermore comprises a second inverse processing branch 533, 534 for inverse processing a third coded signal to obtain a second inverse processed signal in the second domain, where the second inverse processing branch comprises a converter for converting from the third domain into the second domain.

The second decoding branch furthermore comprises a first combiner 532 for combining the first inverse processed signal and the second inverse processed signal to obtain a signal in the second domain, where this combined signal is, at the first time instant, only influenced by the first inverse processed signal and is, at a later time instant, only influenced by the second inverse processed signal.

The second decoding branch furthermore comprises a converter 540 for converting the combined signal to the first domain.

Finally, the decoder illustrated in FIG. 3*d* comprises a second combiner 600 for combining the decoded first signal from block 431, 440 and the converter 540 output signal to obtain a decoded output signal in the first domain. Again, the decoded output signal in the first domain is, at the first time instant, only influenced by the signal output by the converter 540 and is, at a later time instant, only influenced by the first decoded signal output by block 431, 440.

Figure 3E:
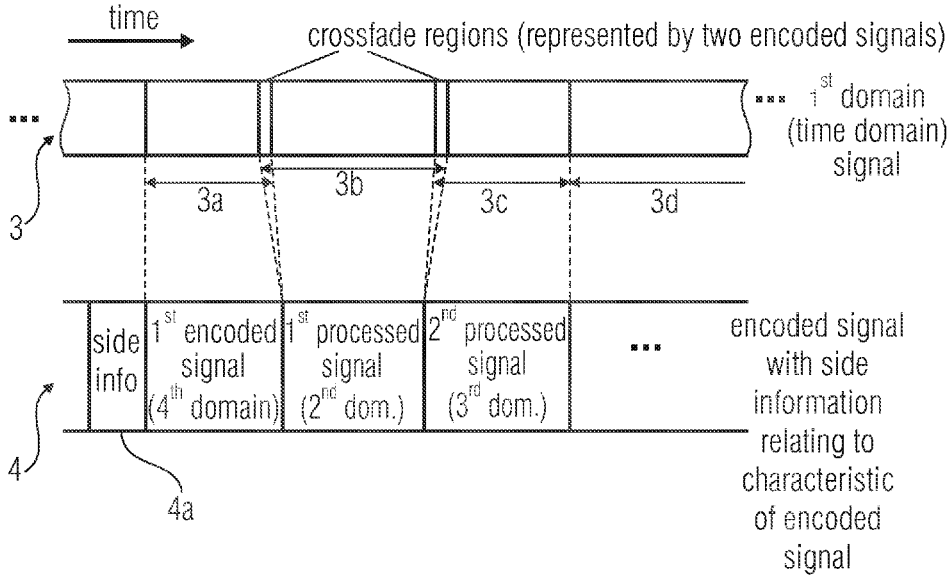
FIG. 3*e* illustrates an illustration of a time domain signal and a corresponding representation of the encoded signal illustrating short cross fade regions which are included in both encoded signals.

This situation is illustrated, from an encoder perspective, in FIG. 3*e*. The upper portion in FIG. 3*e* illustrates in the schematic representation, a first domain audio signal such as a time domain audio signal, where the time index increases from left to right and item 3 might be considered as a stream of audio samples representing the signal 195 in FIG. 3*c*. FIG. 3*e* illustrates frames 3*a*, 3*b*, 3*c*, 3*d* which may be generated by switching between the first encoded signal and the first processed signal and the second processed signal as illustrated at item 4 in FIG. 3*e*. The first encoded signal, the first processed signal and the second processed signals are all in different domains and in order to make sure that the switch between the different domains does not result in an artifact on the decoder-side, frames 3*a*, 3*b* of the time domain signal have an overlapping range which is indicated as a cross fade region, and such a cross fade region is there at frame 3*b* and 3*c*. However, no such cross fade region is existing between frame 3*d*, 3*c* which means that frame 3*d* is also represented by a second processed signal, i.e., a signal in the third domain, and there is no domain change between frame 3*c* and 3*d*. Therefore, generally, it is advantageous not to provide a cross fade region where there is no domain change and to provide a cross fade region, i.e., a portion of the audio signal which is encoded by two subsequent coded/processed signals when there is a domain change, i.e., a switching action of either of the two switches. Advantageously, crossfades are performed for other domain changes.

In the embodiment, in which the first encoded signal or the second processed signal has been generated by an MDCT processing having e.g. 50 percents overlap, each time domain sample is included in two subsequent frames. Due to the characteristics of the MDCT, however, this does not result in an overhead, since the MDCT is a critically sampled system. In this context, critically sampled means that the number of spectral values is the same as the number of time domain values. The MDCT is advantageous in that the crossover effect is provided without a specific crossover region so that a crossover from an MDCT block to the next MDCT block is provided without any overhead which would violate the critical sampling requirement.

Advantageously, the first coding algorithm in the first coding branch is based on an information sink model, and the second coding algorithm in the second coding branch is based on an information source or an SNR model. An SNR model is a model which is not specifically related to a specific sound generation mechanism but which is one coding mode which can be selected among a plurality of coding modes based e.g. on a closed loop decision. Thus, an SNR model is any available coding model but which does not necessarily have to be related to the physical constitution of the sound generator but which is any parameterized coding model different from the information sink model, which can be selected by a closed loop decision and, specifically, by comparing different SNR results from different models.

As illustrated in FIG. 3*c*, a controller 300, 525 is provided. This controller may include the functionalities of the decision stage 300 of FIG. 1*a* and, additionally, may include the functionality of the switch control device 525 in FIG. 1*a*. Generally, the controller is for controlling the first switch and the second switch in a signal adaptive way. The controller is operative to analyze a signal input into the first switch or output by the first or the second coding branch or signals obtained by encoding and decoding from the first and the second encoding branch with respect to a target function. Alternatively, or additionally, the controller is operative to analyze the signal input into the second switch or output by the first processing branch or the second processing branch or obtained by processing and inverse processing from the first processing branch and the second processing branch, again with respect to a target function.

In one embodiment, the first coding branch or the second coding branch comprises an aliasing introducing time/frequency conversion algorithm such as an MDCT or an MDST algorithm, which is different from a straightforward FFT transform, which does not introduce an aliasing effect. Furthermore, one or both branches comprise a quantizer/entropy coder block. Specifically, only the second processing branch of the second coding branch includes the time/frequency converter introducing an aliasing operation and the first processing branch of the second coding branch comprises a quantizer and/or entropy coder and does not introduce any aliasing effects. The aliasing introducing time/frequency converter advantageously comprises a windower for applying an analysis window and an MDCT transform algorithm. Specifically, the windower is operative to apply the window function to subsequent frames in an overlapping way so that a sample of a windowed signal occurs in at least two subsequent windowed frames.

In one embodiment, the first processing branch comprises an ACELP coder and a second processing branch comprises an MDCT spectral converter and the quantizer for quantizing spectral components to obtain quantized spectral components, where each quantized spectral component is zero or is defined by one quantizer index of the plurality of different possible quantizer indices.

Furthermore, it is advantageous that the first switch 200 operates in an open loop manner and the second switch operates in a closed loop manner.

As stated before, both coding branches are operative to encode the audio signal in a block wise manner, in which the first switch or the second switch switches in a block-wise manner so that a switching action takes place, at the minimum, after a block of a predefined number of samples of a signal, the predefined number forming a frame length for the corresponding switch. Thus, the granule for switching by the first switch may be, for example, a block of 2048 or 1028 samples, and the frame length, based on which the first switch 200 is switching may be variable but is, advantageously, fixed to such a quite long period.

Contrary thereto, the block length for the second switch 521, i.e., when the second switch 521 switches from one mode to the other, is substantially smaller than the block length for the first switch. Advantageously, both block lengths for the switches are selected such that the longer block length is an integer multiple of the shorter block length. In the embodiment, the block length of the first switch is 2048 or 1024 and the block length of the second switch is 1024 or more advantageously, 512 and even more advantageously, 256 and even more advantageously 128 samples so that, at the maximum, the second switch can switch 16 times when the first switch switches only a single time. A maximum block length ratio, however, is 4:1.

In a further embodiment, the controller 300, 525 is operative to perform a speech music discrimination for the first switch in such a way that a decision to speech is favored with respect to a decision to music. In this embodiment, a decision to speech is taken even when a portion less than 50% of a frame for the first switch is speech and the portion of more than 50% of the frame is music.

Furthermore, the controller is operative to already switch to the speech mode, when a quite small portion of the first frame is speech and, specifically, when a portion of the first frame is speech, which is 50% of the length of the smaller second frame. Thus, a speech/favouring switching decision already switches over to speech even when, for example, only 6% or 12% of a block corresponding to the frame length of the first switch is speech.

This procedure is advantageously in order to fully exploit the bit rate saving capability of the first processing branch, which has a voiced speech core in one embodiment and to not loose any quality even for the rest of the large first frame, which is non-speech due to the fact that the second processing branch includes a converter and, therefore, is useful for audio signals which have non-speech signals as well. Advantageously, this second processing branch includes an overlapping MDCT, which is critically sampled, and which even at small window sizes provides a highly efficient and aliasing free operation due to the time domain aliasing cancellation processing such as overlap and add on the decoder-side. Furthermore, a large block length for the first encoding branch which is advantageously an AAC-like MDCT encoding branch is useful, since non-speech signals are normally quite stationary and a long transform window provides a high frequency resolution and, therefore, high quality and, additionally, provides a bit rate efficiency due to a psycho acoustically controlled quantization module, which can also be applied to the transform based coding mode in the second processing branch of the second coding branch.

Regarding the FIG. 3*d* decoder illustration, it is advantageous that the transmitted signal includes an explicit indicator as side information 4*a* as illustrated in FIG. 3*e*. This side information 4*a* is extracted by a bit stream parser not illustrated in FIG. 3*d* in order to forward the corresponding first encoded signal, first processed signal or second processed signal to the correct processor such as the first decoding branch, the first inverse processing branch or the second inverse processing branch in FIG. 3*d*. Therefore, an encoded signal not only has the encoded/processed signals but also includes side information relating to these signals. In other embodiments, however, there can be an implicit signaling which allows a decoder-side bit stream parser to distinguish between the certain signals. Regarding FIG. 3*e*, it is outlined that the first processed signal or the second processed signal is the output of the second coding branch and, therefore, the second coded signal.

Advantageously, the first decoding branch and/or the second inverse processing branch includes an MDCT transform for converting from the spectral domain to the time domain. To this end, an overlap-adder is provided to perform a time domain aliasing cancellation functionality which, at the same time, provides a cross fade effect in order to avoid blocking artifacts. Generally, the first decoding branch converts a signal encoded in the fourth domain into the first domain, while the second inverse processing branch performs a conversion from the third domain to the second domain and the converter subsequently connected to the first combiner provides a conversion from the second domain to the first domain so that, at the input of the combiner 600, only first domain signals are there, which represent, in the FIG. 3*d* embodiment, the decoded output signal.

FIGS. 4*a* and 4*b* illustrate two different embodiments, which differ in the positioning of the switch 200. In FIG. 4*a*, the switch 200 is positioned between an output of the common pre-processing stage 100 and input of the two encoded branches 400, 500. The FIG. 4*a* embodiment makes sure that the audio signal is input into a single encoding branch only, and the other encoding branch, which is not connected to the output of the common pre-processing stage does not operate and, therefore, is switched off or is in a sleep mode. This embodiment is advantageous in that the non-active encoding branch does not consume power and computational resources which is useful for mobile applications in particular, which are battery-powered and, therefore, have the general limitation of power consumption.

On the other hand, however, the FIG. 4*b* embodiment may be advantageous when power consumption is not an issue. In this embodiment, both encoding branches 400, 500 are active all the time, and only the output of the selected encoding branch for a certain time portion and/or a certain frequency portion is forwarded to the bit stream formatter which may be implemented as a bit stream multiplexer 800. Therefore, in the FIG. 4*b* embodiment, both encoding branches are active all the time, and the output of an encoding branch which is selected by the decision stage 300 is entered into the output bit stream, while the output of the other non-selected encoding branch 400 is discarded, i.e., not entered into the output bit stream, i.e., the encoded audio signal.

Advantageously, the second encoding rule/decoding rule is an LPC-based coding algorithm. In LPC-based speech coding, a differentiation between quasi-periodic impulse-like excitation signal segments or signal portions, and noise-like excitation signal segments or signal portions, is made. This is performed for very low bit rate LPC vocoders (2.4 kbps) as in FIG. 7*b*. However, in medium rate CELP coders, the excitation is obtained for the addition of scaled vectors from an adaptive codebook and a fixed codebook.

Quasi-periodic impulse-like excitation signal segments, i.e., signal segments having a specific pitch are coded with different mechanisms than noise-like excitation signals. While quasi-periodic impulse-like excitation signals are connected to voiced speech, noise-like signals are related to unvoiced speech.

Figures 5A, 5B:
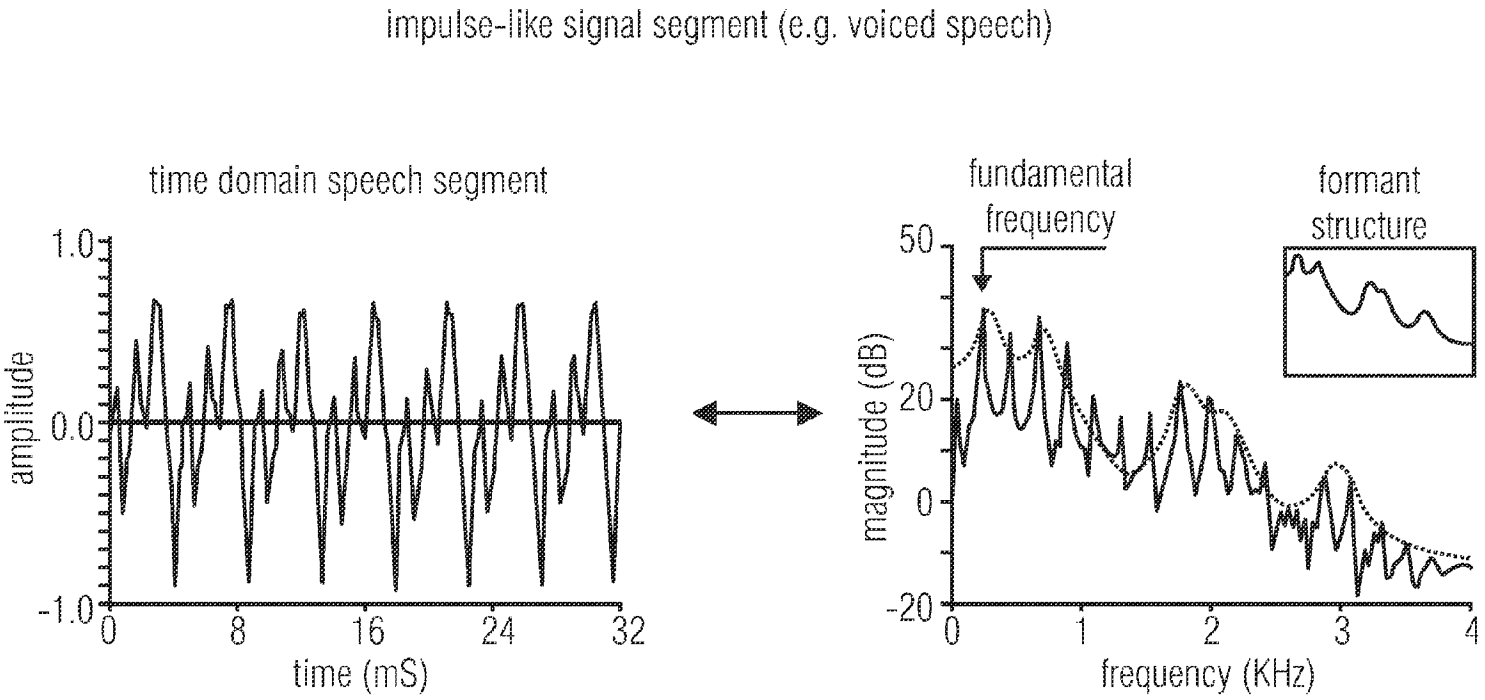
FIG. 5*a* illustrates a wave form of a time domain speech segment as a quasi-periodic or impulse-like signal segment.
FIG. 5*b* illustrates a spectrum of the segment of FIG. 5*a;*

Exemplarily, reference is made to FIGS. 5*a* to 5*d*. Here, quasi-periodic impulse-like signal segments or signal portions and noise-like signal segments or signal portions are exemplarily discussed. Specifically, a voiced speech as illustrated in FIG. 5*a* in the time domain and in FIG. 5*b* in the frequency domain is discussed as an example for a quasi-periodic impulse-like signal portion, and an unvoiced speech segment as an example for a noise-like signal portion is discussed in connection with FIGS. 5*c* and 5*d*. Speech can generally be classified as voiced, unvoiced, or mixed. Time-and-frequency domain plots for sampled voiced and unvoiced segments are shown in FIGS. 5*a* to 5*d*. Voiced speech is quasi periodic in the time domain and harmonically structured in the frequency domain, while unvoiced speed is random-like and broadband. The short-time spectrum of voiced speech is characterized by its fine harmonic formant structure. The fine harmonic structure is a consequence of the quasi-periodicity of speech and may be attributed to the vibrating vocal chords. The formant structure (spectral envelope) is due to the interaction of the source and the vocal tracts. The vocal tracts consist of the pharynx and the mouth cavity. The shape of the spectral envelope that "fits" the short time spectrum of voiced speech is associated with the transfer characteristics of the vocal tract and the spectral tilt (6 dB/Octave) due to the glottal pulse. The spectral envelope is characterized by a set of peaks which are called formants. The formants are the resonant modes of the vocal tract. For the average vocal tract there are three to five formants below 5 kHz. The amplitudes and locations of the first three formants, usually occurring below 3 kHz are quite important both, in speech synthesis and perception. Higher formants are also important for wide band and unvoiced speech representations. The properties of speech are related to the physical speech production system as follows. Voiced speech is produced by exciting the vocal tract with quasi-periodic glottal air pulses generated by the vibrating vocal chords. The frequency of the periodic pulses is referred to as the fundamental frequency or pitch.

Unvoiced speech is produced by forcing air through a constriction in the vocal tract. Nasal sounds are due to the acoustic coupling of the nasal tract to the vocal tract, and plosive sounds are produced by abruptly releasing the air pressure which was built up behind the closure in the tract.

Figures 5C, 5D:
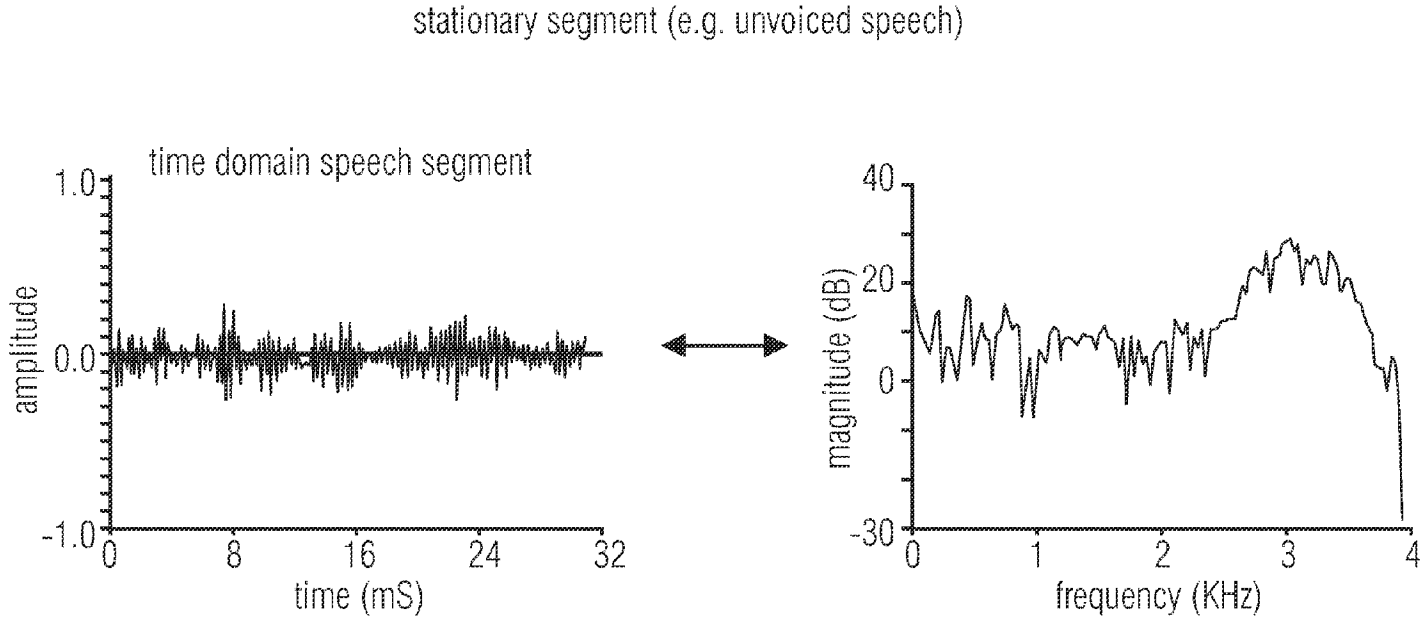
FIG. 5*c* illustrates a time domain speech segment of unvoiced speech as an example for a noise-like segment.
FIG. 5*d* illustrates a spectrum of the time domain wave form of FIG. 5*c;*

Thus, a noise-like portion of the audio signal shows neither any impulse-like time-domain structure nor harmonic frequency-domain structure as illustrated in FIG. 5*c* and in FIG. 5*d*, which is different from the quasi-periodic impulse-like portion as illustrated for example in FIG. 5*a* and in FIG. 5*b*. As will be outlined later on, however, the differentiation between noise-like portions and quasi-periodic impulse-like portions can also be observed after a LPC for the excitation signal. The LPC is a method which models the vocal tract and extracts from the signal the excitation of the vocal tracts.

Furthermore, quasi-periodic impulse-like portions and noise-like portions can occur in a timely manner, i.e., which means that a portion of the audio signal in time is noisy and another portion of the audio signal in time is quasi-periodic, i.e. tonal. Alternatively, or additionally, the characteristic of a signal can be different in different frequency bands. Thus, the determination, whether the audio signal is noisy or tonal, can also be performed frequency-selective so that a certain frequency band or several certain frequency bands are considered to be noisy and other frequency bands are considered to be tonal. In this case, a certain time portion of the audio signal might include tonal components and noisy components.

FIG. 7*a* illustrates a linear model of a speech production system. This system assumes a two-stage excitation, i.e., an impulse-train for voiced speech as indicated in FIG. 7*c*, and a random-noise for unvoiced speech as indicated in FIG. 7*d*. The vocal tract is modelled as an all-pole filter 70 which processes pulses of FIG. 7*c* or FIG. 7*d*, generated by the glottal model 72. Hence, the system of FIG. 7*a* can be reduced to an all pole-filter model of FIG. 7*b* having a gain stage 77, a forward path 78, a feedback path 79, and an adding stage 80. In the feedback path 79, there is a prediction filter 81, and the whole source-model synthesis system illustrated in FIG. 7*b* can be represented using z-domain functions as follows:

$$S(z)=g/(1-A(z))\cdot X(z),$$

where g represents the gain, A(z) is the prediction filter as determined by an LP analysis, X(z) is the excitation signal, and S(z) is the synthesis speech output.

FIGS. 7*c* and 7*d* give a graphical time domain description of voiced and unvoiced speech synthesis using the linear source system model. This system and the excitation parameters in the above equation are unknown and have to be determined from a finite set of speech samples. The coefficients of A(z) are obtained using a linear prediction of the input signal and a quantization of the filter coefficients. In a p-th order forward linear predictor, the present sample of the speech sequence is predicted from a linear combination of p passed samples. The predictor coefficients can be determined by well-known algorithms such as the Levinson-Durbin algorithm, or generally an autocorrelation method or a reflection method.

FIG. 7*e* illustrates a more detailed implementation of the LPC analysis block 510. The audio signal is input into a filter determination block which determines the filter information A(z). This information is output as the short-term prediction information needed for a decoder. The short-term prediction information is needed by the actual prediction filter 85. In a subtracter 86, a current sample of the audio signal is input and a predicted value for the current sample is subtracted so that for this sample, the prediction error signal is generated at line 84. A sequence of such prediction error signal samples is very schematically illustrated in FIG. 7*c* or 7*d*. Therefore, FIG. 7*a*, 7*b* can be considered as a kind of a rectified impulse-like signal.

While FIG. 7*e* illustrates a way to calculate the excitation signal, FIG. 7*f* illustrates a way to calculate the weighted signal. In contrast to FIG. 7*e*, the filter 85 is different, when $\gamma$ is different from 1. A value smaller than 1 is advantageous for $\gamma$. Furthermore, the block 87 is present, and $\mu$ is advantageously a number smaller than 1. Generally, the elements in FIGS. 7*e* and 7*f* can be implemented as in 3GPP TS 26.190 or 3GPP TS 26.290.

Figure 7G:
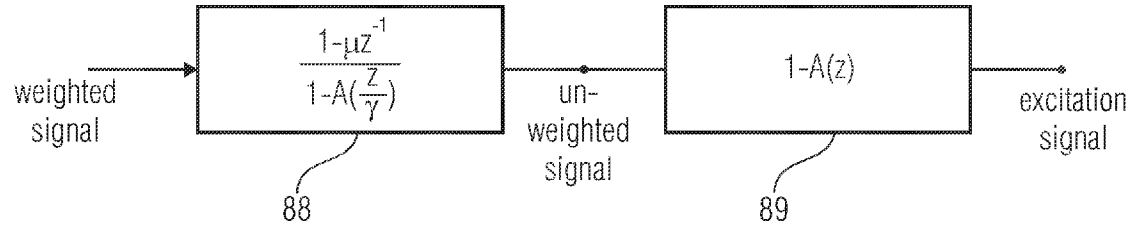
FIG. 7*g* illustrates an implementation for transforming a weighted signal into an excitation signal by applying an inverse weighting operation and a subsequent excitation analysis as needed in the converter 537 of FIG. 2*b;*

FIG. 7*g* illustrates an inverse processing, which can be applied on the decoder side such as in element 537 of FIG. 2*b*. Particularly, block 88 generates an unweighted signal from the weighted signal and block 89 calculates an excitation from the unweighted signal. Generally, all signals but the unweighted signal in FIG. 7*g* are in the LPC domain, but the excitation signal and the weighted signal are different signals in the same domain. Block 89 outputs an excitation signal which can then be used together with the output of block 536. Then, the common inverse LPC transform can be performed in block 540 of FIG. 2*b*.

Figure 6:
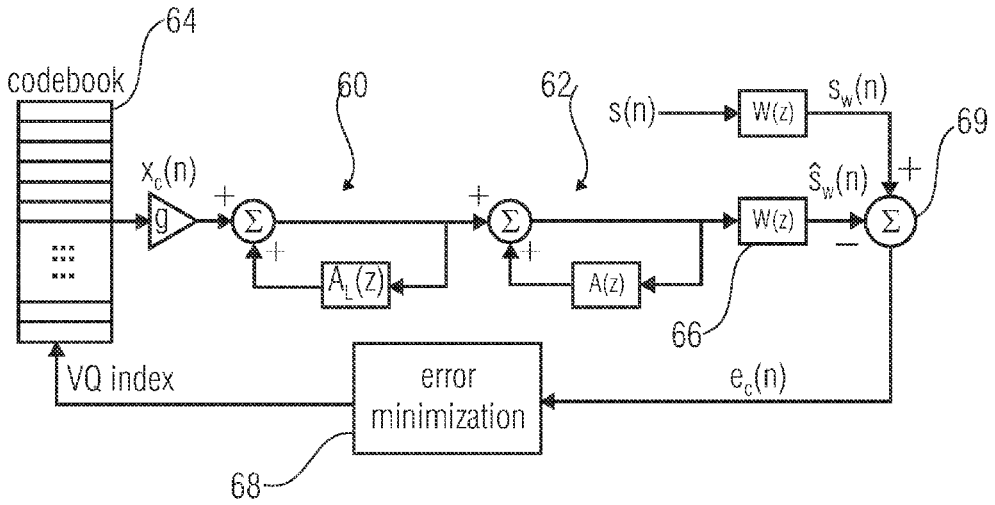
FIG. 6 illustrates a block diagram of an analysis by synthesis CELP encoder.

Subsequently, an analysis-by-synthesis CELP encoder will be discussed in connection with FIG. 6 in order to illustrate the modifications applied to this algorithm. This CELP encoder is discussed in detail in "Speech Coding: A Tutorial Review", Andreas Spanias, Proceedings of the IEEE, Vol. 82, No. 10, October 1994, pages 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the time-domain input signal. After having been perceptually weighted, the weighted signal is input into a subtracter 69, which calculates the error between the weighted synthesis signal at the output of block 66 and the original weighted signal $s_w(n)$. Generally, the short-term prediction filter coefficients A(z) are calculated by an LP analysis stage and its coefficients are quantized in $\hat{A}(z)$ as indicated in FIG. 7*e*. The long-term prediction information $A_L(z)$ including the long-term prediction gain g and the vector quantization index, i.e., codebook references are calculated on the prediction error signal at the output of the LPC analysis stage referred as 10*a* in FIG. 7*e*. The LTP parameters are the pitch delay and gain. In CELP this is usually implemented as an adaptive codebook containing the past excitation signal (not the residual). The adaptive CB delay and gain are found by minimizing the mean-squared weighted error (closed-loop pitch search).

The CELP algorithm encodes then the residual signal obtained after the short-term and long-term predictions using a codebook of for example Gaussian sequences. The ACELP algorithm, where the "A" stands for "Algebraic" has a specific algebraically designed codebook.

A codebook may contain more or less vectors where each vector is some samples long. A gain factor g scales the code vector and the gained code is filtered by the long-term prediction synthesis filter and the short-term prediction synthesis filter. The "optimum" code vector is selected such that the perceptually weighted mean square error at the output of the subtracter 69 is minimized. The search process in CELP is done by an analysis-by-synthesis optimization as illustrated in FIG. 6.

For specific cases, when a frame is a mixture of unvoiced and voiced speech or when speech over music occurs, a TCX coding can be more appropriate to code the excitation in the LPC domain. The TCX coding processes the weighted signal in the frequency domain without doing any assumption of excitation production. The TCX is then more generic than CELP coding and is not restricted to a voiced or a non-voiced source model of the excitation. TCX is still a source-oriented model coding using a linear predictive filter for modelling the formants of the speech-like signals.

In the AMR-WB+-like coding, a selection between different TCX modes and ACELP takes place as known from the AMR-WB+ description. The TCX modes are different in that the length of the block-wise Discrete Fourier Transform is different for different modes and the best mode can be selected by an analysis by synthesis approach or by a direct "feedforward" mode.

As discussed in connection with FIGS. 2*a* and 2*b*, the common pre-processing stage 100 advantageously includes a joint multi-channel (surround/joint stereo device) 101 and, additionally, a band width extension stage 102. Correspondingly, the decoder includes a band width extension stage 701 and a subsequently connected joint multichannel stage 702. Advantageously, the joint multichannel stage 101 is, with respect to the encoder, connected before the band width extension stage 102, and, on the decoder side, the band width extension stage 701 is connected before the joint multichannel stage 702 with respect to the signal processing direction. Alternatively, however, the common pre-processing stage can include a joint multichannel stage without the subsequently connected bandwidth extension stage or a bandwidth extension stage without a connected joint multichannel stage.

Figure 8:
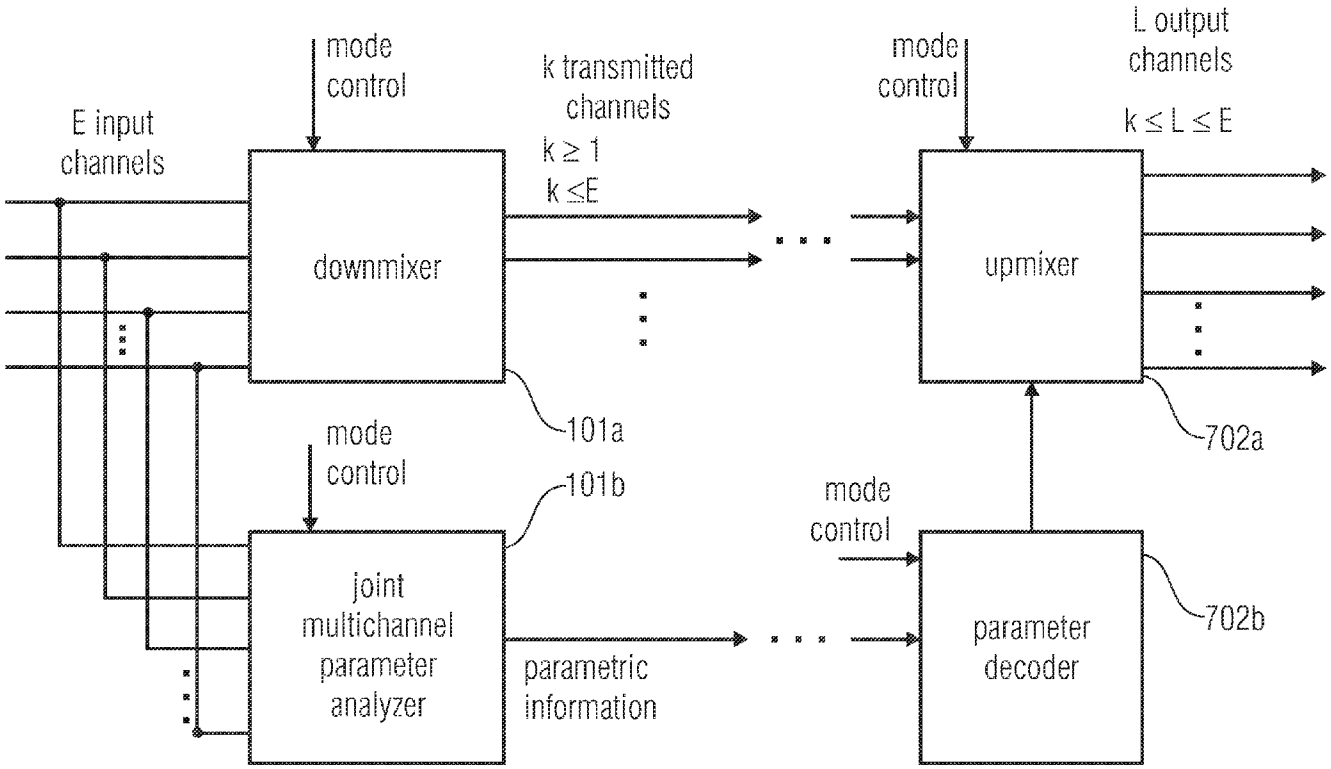
FIG. 8 illustrates a block diagram of a joint multi-channel algorithm in accordance with an embodiment of the present invention.

An example for a joint multichannel stage on the encoder side 101*a*, 101*b* and on the decoder side 702*a* and 702*b* is illustrated in the context of FIG. 8. A number of E original input channels is input into the downmixer 101*a* so that the downmixer generates a number of K transmitted channels, where the number K is greater than or equal to one and is smaller than or equal E.

Advantageously, the E input channels are input into a joint multichannel parameter analyzer 101*b* which generates parametric information. This parametric information is advantageously entropy-encoded such as by a difference encoding and subsequent Huffman encoding or, alternatively, subsequent arithmetic encoding. The encoded parametric information output by block 101*b* is transmitted to a parameter decoder 702*b* which may be part of item 702 in FIG. 2*b*. The parameter decoder 702*b* decodes the transmitted parametric information and forwards the decoded parametric information into the upmixer 702*a*. The upmixer 702*a* receives the K transmitted channels and generates a number of L output channels, where the number of L is greater than or equal K and lower than or equal to E.

Parametric information may include inter channel level differences, inter channel time differences, inter channel phase differences and/or inter channel coherence measures as is known from the BCC technique or as is known and is described in detail in the MPEG surround standard. The number of transmitted channels may be a single mono channel for ultra-low bit rate applications or may include a compatible stereo application or may include a compatible stereo signal, i.e., two channels. Typically, the number of E input channels may be five or maybe even higher. Alternatively, the number of E input channels may also be E audio objects as it is known in the context of spatial audio object coding (SAOC).

In one implementation, the downmixer performs a weighted or unweighted addition of the original E input channels or an addition of the E input audio objects. In case of audio objects as input channels, the joint multichannel parameter analyzer 101*b* will calculate audio object parameters such as a correlation matrix between the audio objects advantageously for each time portion and even more advantageously for each frequency band. To this end, the whole frequency range may be divided in at least 10 and advantageously 32 or 64 frequency bands.

Figure 9:
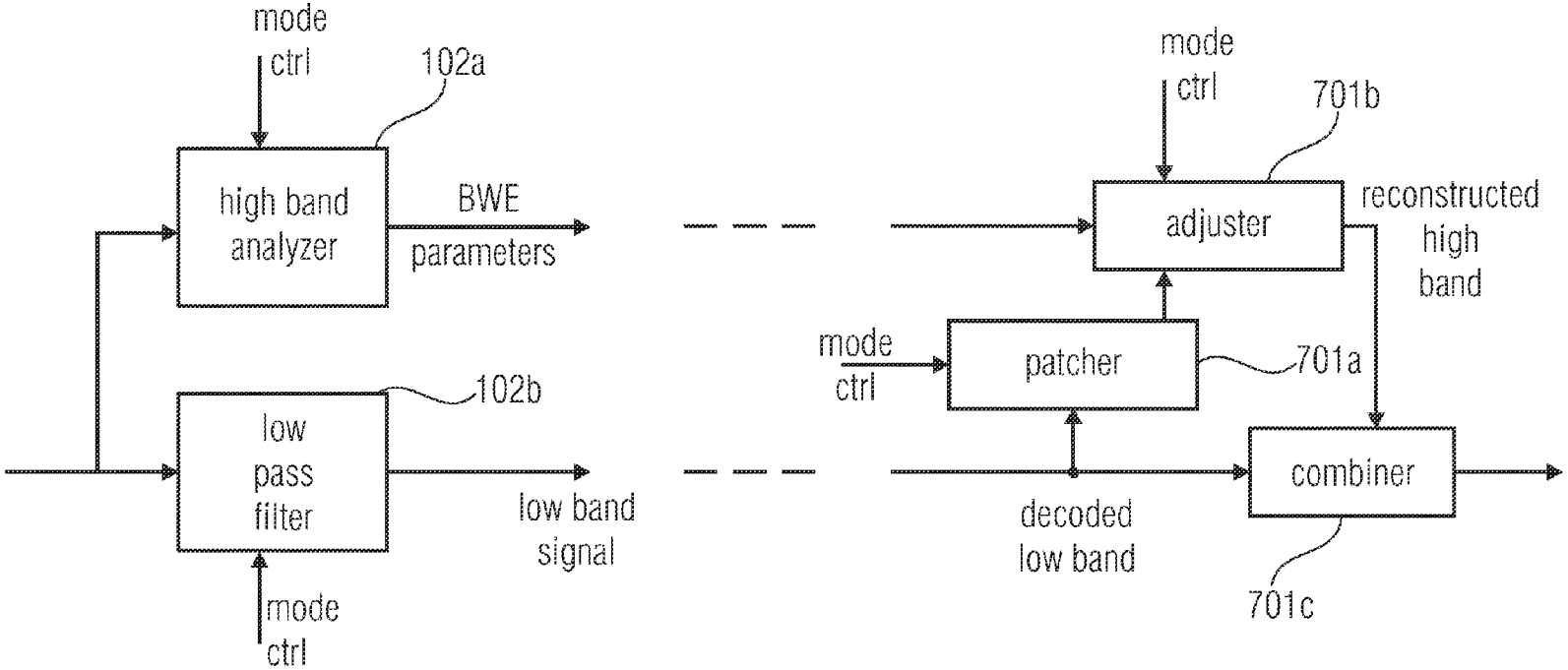
FIG. 9 illustrates an embodiment of a bandwidth extension algorithm.

FIG. 9 illustrates an embodiment for the implementation of the bandwidth extension stage 102 in FIG. 2*a* and the corresponding band width extension stage 701 in FIG. 2*b*. On the encoder-side, the bandwidth extension block 102 advantageously includes a low pass filtering block 102*b*, a downsampler block, which follows the lowpass, or which is part of the inverse QMF, which acts on only half of the QMF bands, and a high band analyzer 102*a*. The original audio signal input into the bandwidth extension block 102 is low-pass filtered to generate the low band signal which is then input into the encoding branches and/or the switch. The low pass filter has a cut off frequency which can be in a range of 3 kHz to 10 kHz. Furthermore, the bandwidth extension block 102 furthermore includes a high band analyzer for calculating the bandwidth extension parameters such as a spectral envelope parameter information, a noise floor parameter information, an inverse filtering parameter information, further parametric information relating to certain harmonic lines in the high band and additional parameters as discussed in detail in the MPEG-4 standard in the chapter related to spectral band replication.

On the decoder-side, the bandwidth extension block 701 includes a patcher 701*a*, an adjuster 701*b* and a combiner 701*c*. The combiner 701*c* combines the decoded low band signal and the reconstructed and adjusted high band signal output by the adjuster 701*b*. The input into the adjuster 701*b* is provided by a patcher which is operated to derive the high band signal from the low band signal such as by spectral band replication or, generally, by bandwidth extension. The patching performed by the patcher 701*a* may be a patching performed in a harmonic way or in a non-harmonic way. The signal generated by the patcher 701*a* is, subsequently, adjusted by the adjuster 701*b* using the transmitted parametric bandwidth extension information.

As indicated in FIG. 8 and FIG. 9, the described blocks may have a mode control input in an embodiment. This mode control input is derived from the decision stage 300 output signal. In such an embodiment, a characteristic of a corresponding block may be adapted to the decision stage output, i.e., whether, in an embodiment, a decision to speech or a decision to music is made for a certain time portion of the audio signal. Advantageously, the mode control only relates to one or more of the functionalities of these blocks but not to all of the functionalities of blocks. For example, the decision may influence only the patcher 701*a* but may not influence the other blocks in FIG. 9, or may, for example, influence only the joint multichannel parameter analyzer 101*b* in FIG. 8 but not the other blocks in FIG. 8. This implementation is advantageously such that a higher flexibility and higher quality and lower bit rate output signal is obtained by providing flexibility in the common pre-processing stage. On the other hand, however, the usage of algorithms in the common pre-processing stage for both kinds of signals allows to implement an efficient encoding/decoding scheme.

Figure 10A:
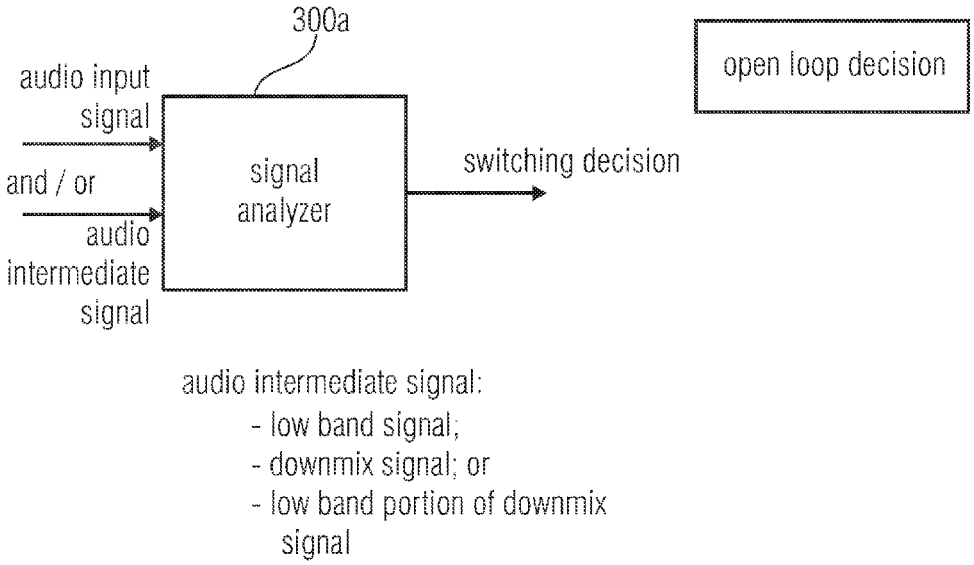
FIG. 10*a* illustrates a detailed description of the switch when performing an open loop decision.
Figure 10B:
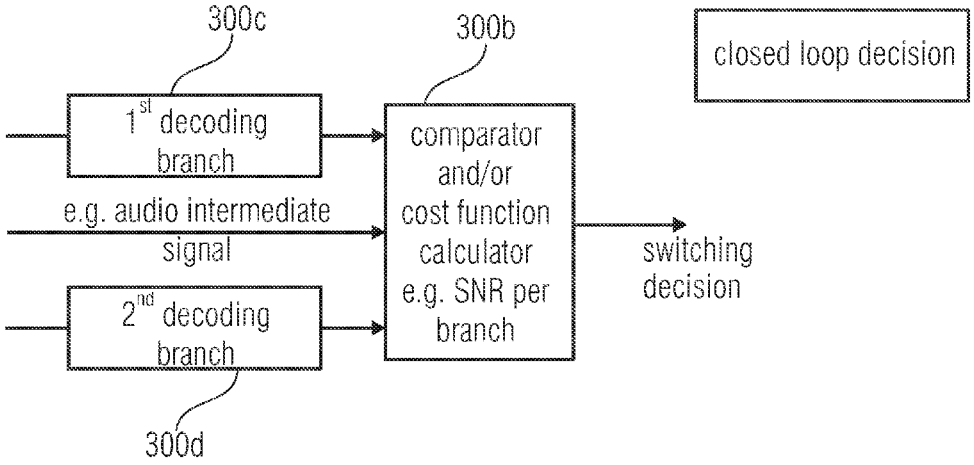
FIG. 10*b* illustrates an illustration of the switch when operating in a closed loop decision mode.

FIG. 10*a* and FIG. 10*b* illustrates two different implementations of the decision stage 300. In FIG. 10*a*, an open loop decision is indicated. Here, the signal analyzer 300*a* in the decision stage has certain rules in order to decide whether the certain time portion or a certain frequency portion of the input signal has a characteristic which requests that this signal portion is encoded by the first encoding branch 400 or by the second encoding branch 500. To this end, the signal analyzer 300*a* may analyze the audio input signal into the common pre-processing stage or may analyze the audio signal output by the common pre-processing stage, i.e., the audio intermediate signal or may analyze an intermediate signal within the common pre-processing stage such as the output of the downmix signal which may be a mono signal or which may be a signal having k channels indicated in FIG. 8. On the output-side, the signal analyzer 300*a* generates the switching decision for controlling the switch 200 on the encoder-side and the corresponding switch 600 or the combiner 600 on the decoder-side.

Although not discussed in detail for the second switch 521, it is to be emphasized that the second switch 521 can be positioned in a similar way as the first switch 200 as discussed in connection with FIG. 4*a* and FIG. 4*b*. Thus, an alternative position of switch 521 in FIG. 3*c* is at the output of both processing branches 522, 523, 524 so that, both processing branches operate in parallel and only the output of one processing branch is written into a bit stream via a bit stream former which is not illustrated in FIG. 3*c*.

Furthermore, the second combiner 600 may have a specific cross fading functionality as discussed in FIG. 4*c*. Alternatively or additionally, the first combiner 532 might have the same cross fading functionality. Furthermore, both combiners may have the same cross fading functionality or may have different cross fading functionalities or may have no cross fading functionalities at all so that both combiners are switches without any additional cross fading functionality.

As discussed before, both switches can be controlled via an open loop decision or a closed loop decision as discussed in connection with FIG. 10*a* and FIG. 10*b*, where the controller 300, 525 of FIG. 3*c* can have different or the same functionalities for both switches.

Furthermore, a time warping functionality which is signal-adaptive can exist not only in the first encoding branch or first decoding branch but can also exist in the second processing branch of the second coding branch on the encoder side as well as on the decoder side. Depending on a processed signal, both time warping functionalities can have the same time warping information so that the same time warp is applied to the signals in the first domain and in the second domain. This saves processing load and might be useful in some instances, in cases where subsequent blocks have a similar time warping time characteristic. In alternative embodiments, however, it is advantageous to have independent time warp estimators for the first coding branch and the second processing branch in the second coding branch.

The inventive encoded audio signal can be stored on a digital storage medium or can be transmitted on a transmission medium such as a wireless transmission medium or a wired transmission medium such as the Internet.

In a different embodiment, the switch 200 of FIG. 1*a* or 2*a* switches between the two coding branches 400, 500. In a further embodiment, there can be additional encoding branches such as a third encoding branch or even a fourth encoding branch or even more encoding branches. On the decoder side, the switch 600 of FIG. 1*b* or 2*b* switches between the two decoding branches 431, 440 and 531, 532, 533, 534, 540. In a further embodiment, there can be additional decoding branches such as a third decoding branch or even a fourth decoding branch or even more decoding branches. Similarly, the other switches 521 or 532 may switch between more than two different coding algorithms, when such additional coding/decoding branches are provided.

Figure 12A:
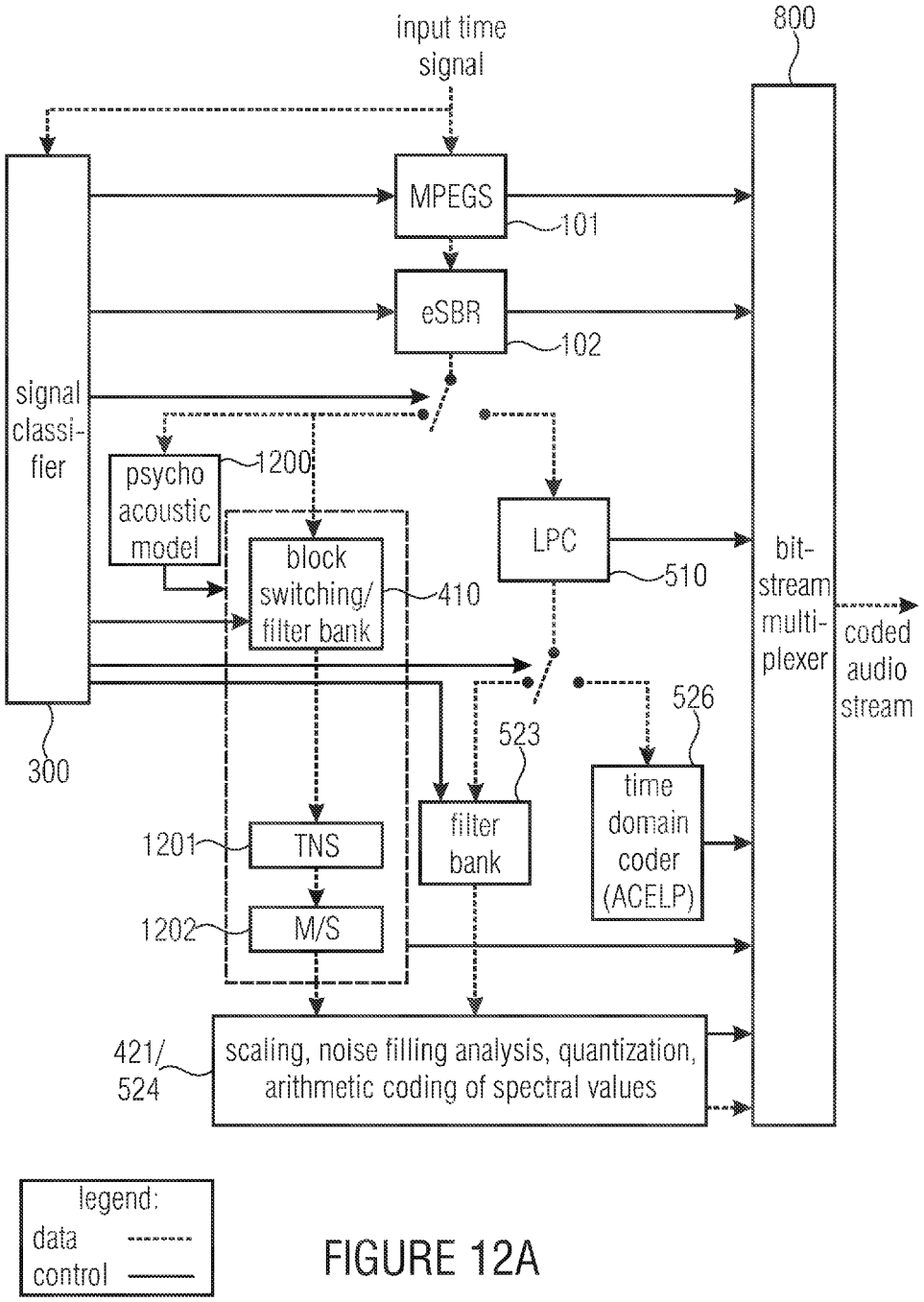
FIG. 12A illustrates another embodiment of an inventive encoder.
Figure 12B:
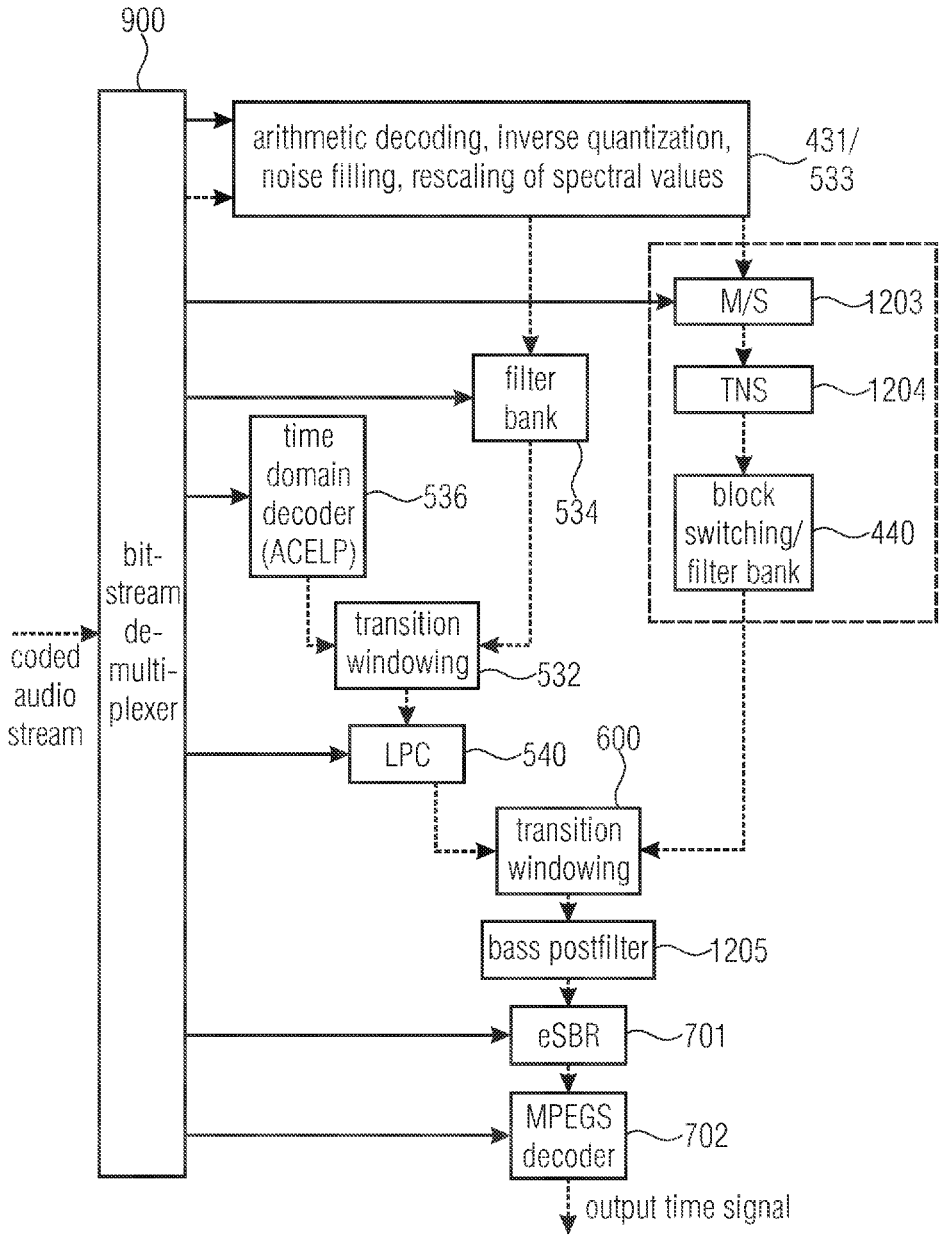
FIG. 12B illustrates another embodiment of an inventive decoder.

FIG. 12A illustrates an embodiment of an encoder implementation, and FIG. 12B illustrates an embodiment of the corresponding decoder implementation. In addition to the elements discussed before with respect to corresponding reference numbers, the embodiment of FIG. 12A illustrates a separate psychoacoustic module 1200, and additionally, illustrates an implementation of the further encoder tools illustrated at block 421 in FIG. 11A. These additional tools are a temporal noise shaping (TNS) tool 1201 and a mid/side coding tool (M/S) 1202. Furthermore, additional functionalities of the elements 421 and 524 are illustrated in block 421/542 as a combined implementation of scaling, noise filling analysis, quantization, arithmetic coding of spectral values.

In the corresponding decoder implementation FIG. 12B, additional elements are illustrated, which are an M/S decoding tool 1203 and a TNS-decoder tool 1204. Furthermore, a bass postfilter not illustrated in the preceding figures is indicated at 1205. The transition windowing block 532 corresponds to the element 532 in FIG. 2B, which is illustrated as a switch, but which performs a kind of a cross fading which can either be an over sampled cross fading or a critically sampled cross fading. The latter one is implemented as an MDCT operation, where two time aliased portions are overlapped and added. This critically sampled transition processing is advantageously used where appropriate, since the overall bitrate can be reduced without any loss in quality. The additional transition windowing block 600 corresponds to the combiner 600 in FIG. 2B, which is again illustrated as a switch, but it is clear that this element performs a kind of cross fading either critically sampled or non-critically sampled in order to avoid blocking artifacts, and specifically switching artifacts, when one block has been processed in the first branch and the other block has been processed in the second branch. When however, the processing in both branches is perfectly matched to its other, then the cross fading operation can "degrade" to a hard switch, while a cross fading operation is understood to be a "soft" switching between both branches.

The concept in FIGS. 12A and 12B permits coding of signals having an arbitrary mix of speech and audio content, and this concept performs comparable to or better than the best coding technology that might be tailored specifically to coding of either speech or general audio content. The general structure of the encoder and decoder can be described in that there is a common pre-post processing consisting of an MPEG surround (MPEGS) functional unit to handle stereo or multi-channel processing and an enhanced SBR (eSBR) unit, which handles the parametric representation of the higher audio frequencies in the input signal. Then, there are two branches, one consisting of a modified advanced audio coding (AAC) tool path and the other consisting of a linear prediction coding (LP or LPC domain) based path, which in turn features either a frequency domain representation or a time domain representation of the LPC residual. All transmitted spectra for both, AAC and LPC, are represented in MDCT domain following quantization and arithmetic coding. The time domain representation uses an ACELP excitation coding scheme. The basic structure is shown in FIG. 12A for the encoder and FIG. 12B for the decoder. The data flow in this diagram is from left to right, top to bottom. The functions of the decoder are to find the description of the quantized audio spectral or time domain representation in the bitstream payload and decode the quantized values and other reconstruction information.

In case of transmitted spectral information the decoder shall reconstruct the quantized spectra, process the reconstructed spectra through whatever tools are active in the bitstream payload in order to arrive at the actual signal spectra as described by the input bitstream payload, and finally convert the frequency domain spectra to the time domain. Following the initial reconstruction and scaling of the spectrum reconstruction, there are optional tools that modify one or more of the spectra in order to provide more efficient coding.

In case of a transmitted time domain signal representation, the decoder shall reconstruct the quantized time signal, process the reconstructed time signal through whatever tools are active in the bitstream payload in order to arrive at the actual time domain signal as described by the input bitstream payload.

For each of the optional tools that operate on the signal data, the option to "pass through" is retained, and in all cases where the processing is omitted, the spectra or time samples at its input are passed directly through the tool without modification.

In places where the bitstream changes its signal representation from time domain to frequency domain representation or from LP domain to non-LP domain or vice versa, the decoder shall facilitate the transition from one domain to the other by means of an appropriate transition overlap-add windowing.

eSBR and MPEGS processing is applied in the same manner to both coding paths after transition handling.

The input to the bitstream payload demultiplexer tool is a bitstream payload. The demultiplexer separates the bitstream payload into the parts for each tool, and provides each of the tools with the bitstream payload information related to that tool.

The outputs from the bitstream payload demultiplexer tool are:

Depending on the core coding type in the current frame either:

the quantized and noiselessly coded spectra represented by scalefactor information arithmetically coded spectral lines or: linear prediction (LP) parameters together with an excitation signal represented by either:

quantized and arithmetically coded spectral lines (transform coded excitation, TCX) or ACELP coded time domain excitation The spectral noise filling information (optional)

The M/S decision information (optional)

The temporal noise shaping (TNS) information (optional)

The filterbank control information

The time unwarping (TW) control information (optional)

The enhanced spectral bandwidth replication (eSBR) control information

The MPEG Surround (MPEGS) control information

The scalefactor noiseless decoding tool takes information from the bitstream payload demultiplexer, parses that information, and decodes the Huffman and DPCM coded scalefactors.

The input to the scalefactor noiseless decoding tool is:

The scalefactor information for the noiselessly coded spectra

The output of the scalefactor noiseless decoding tool is:

The decoded integer representation of the scalefactors:

The spectral noiseless decoding tool takes information from the bitstream payload demultiplexer, parses that information, decodes the arithmetically coded data, and reconstructs the quantized spectra. The input to this noiseless decoding tool is:

The noiselessly coded spectra

The output of this noiseless decoding tool is:

The quantized values of the spectra

The inverse quantizer tool takes the quantized values for the spectra, and converts the integer values to the non-scaled, reconstructed spectra. This quantizer is a companding quantizer, whose companding factor depends on the chosen core coding mode.

The input to the Inverse Quantizer tool is:

The quantized values for the spectra

The output of the inverse quantizer tool is:

The un-scaled, inversely quantized spectra

The noise filling tool is used to fill spectral gaps in the decoded spectra, which occur when spectral value are quantized to zero e.g. due to a strong restriction on bit demand in the encoder. The use of the noise filling tool is optional.

The inputs to the noise filling tool are:

The un-scaled, inversely quantized spectra

Noise filling parameters

The decoded integer representation of the scalefactors

The outputs to the noise filling tool are:

The un-scaled, inversely quantized spectral values for spectral lines which were previously quantized to zero.

Modified integer representation of the scalefactors

The rescaling tool converts the integer representation of the scalefactors to the actual values, and multiplies the un-scaled inversely quantized spectra by the relevant scalefactors.

The inputs to the scalefactors tool are:

The decoded integer representation of the scalefactors

The un-scaled, inversely quantized spectra

The output from the scalefactors tool is:

The scaled, inversely quantized spectra

For an overview over the M/S tool, please refer to ISO/IEC 14496-3, subpart 4.1.1.2.

For an overview over the temporal noise shaping (TNS) tool, please refer to ISO/IEC 14496-3, subpart 4.1.1.2.

The filterbank/block switching tool applies the inverse of the frequency mapping that was carried out in the encoder. An inverse modified discrete cosine transform (IMDCT) is used for the filterbank tool. The IMDCT can be configured to support 120, 128, 240, 256, 320, 480, 512, 576, 960, 1024 or 1152 spectral coefficients.

The inputs to the filterbank tool are:

The (inversely quantized) spectra

The filterbank control information

The output(s) from the filterbank tool is (are):

The time domain reconstructed audio signal(s).

The time-warped filterbank/block switching tool replaces the normal filterbank/block switching tool when the time warping mode is enabled. The filterbank is the same (IMDCT) as for the normal filterbank, additionally the windowed time domain samples are mapped from the warped time domain to the linear time domain by time-varying resampling.

The inputs to the time-warped filterbank tools are:

The inversely quantized spectra

The filterbank control information

The time-warping control information

The output(s) from the filterbank tool is (are):

The linear time domain reconstructed audio signal(s).

The enhanced SBR (eSBR) tool regenerates the highband of the audio signal. It is based on replication of the sequences of harmonics, truncated during encoding. It adjusts the spectral envelope of the generated high-band and applies inverse filtering, and adds noise and sinusoidal components in order to recreate the spectral characteristics of the original signal.

The input to the eSBR tool is:

The quantized envelope data

Misc. control data a time domain signal from the AAC core decoder

The output of the eSBR tool is either:

a time domain signal or a QMF-domain representation of a signal, e.g. in case the MPEG Surround tool is used.

The MPEG Surround (MPEGS) tool produces multiple signals from one or more input signals by applying a sophisticated upmix procedure to the input signal(s) controlled by appropriate spatial parameters. In the USAC context MPEGS is used for coding a multichannel signal, by transmitting parametric side information alongside a transmitted downmixed signal.

The input to the MPEGS tool is:

a downmixed time domain signal or a QMF-domain representation of a downmixed signal from the eSBR tool The output of the MPEGS tool is:

a multi-channel time domain signal

The Signal Classifier tool analyses the original input signal and generates from it control information which triggers the selection of the different coding modes. The analysis of the input signal is implementation dependent and will try to choose the optimal core coding mode for a given input signal frame. The output of the signal classifier can (optionally) also be used to influence the behaviour of other tools, for example MPEG Surround, enhanced SBR, time-warped filterbank and others.

The input to the Signal Classifier tool is:

the original unmodified input signal additional implementation dependent parameters The output of the Signal Classifier tool is:

a control signal to control the selection of the core codec (non-LP filtered frequency domain coding, LP filtered frequency domain or LP filtered time domain coding)

In accordance with the present invention, the time/frequency resolution in block 410 in FIG. 12A and in the converter 523 in FIG. 12A is controlled dependent on the audio signal.

The interrelation between window length, transform length, time resolution and frequency resolution is illustrated in FIG. 13A, where it becomes clear that, for a long window length, the time resolution gets low, but the frequency resolution gets high, and for a short window length, the time resolution is high, but the frequency resolution is low.

In the first encoding branch, which is advantageously the AAC encoding branch indicated by elements 410, 1201, 1202, 4021 of FIG. 12A, different windows can be used, where the window shape is determined by a signal analyzer which is advantageously encoded in the signal classifier block 300, but which can also be a separate module. The encoder selects one of the windows illustrated in FIG. 13B, which have different time/frequency resolutions. The time/frequency resolution of the first long window, the second window, the fourth window, the fifth window and the sixth window are equal to 2,048 sampling values to a transform length of 1,024. The short window illustrated in the third line in FIG. 13B has a time resolution of 256 sampling values corresponding to the window size. This corresponds to a transform length of 128.

Analogously, the last two windows have a window length equal to 2,304, which is a better frequency resolution than the window in the first line but a lower time resolution. The transform length of the windows in the last two lines is equal to 1,152.

In the first encoding branch, different window sequences which are built from the transform windows in the FIG. 13B can be constructed. Although in FIG. 13C only a short sequence is illustrated, while the other "sequences" consist of a single window only, larger sequences consisting of more windows can also be constructed. It is noted that according to FIG. 13B, for the smaller number of coefficients, i.e., 960 instead of 1,024, the time resolution is also lower than for the corresponding higher number of coefficients such as 1024.

Figure 14A:
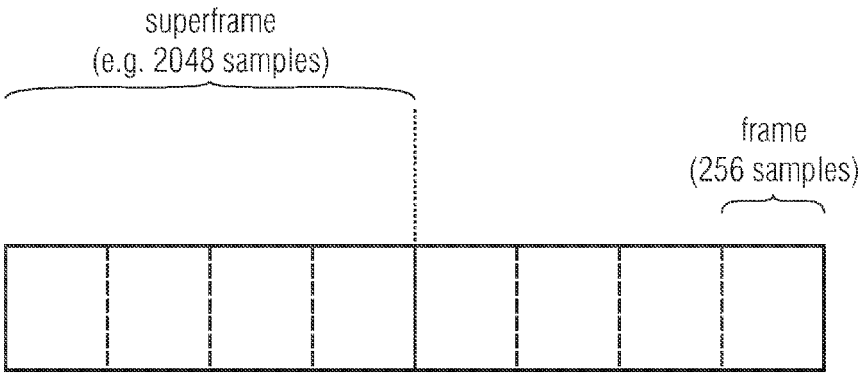
FIG. 14A illustrates the framing of an embodiment of the second coding branch.
Figure 14B:
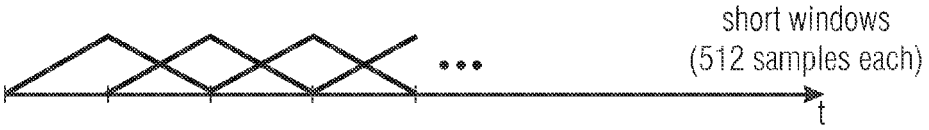
FIG. 14B illustrates short windows as applied in the second coding branch.
Figure 14C:
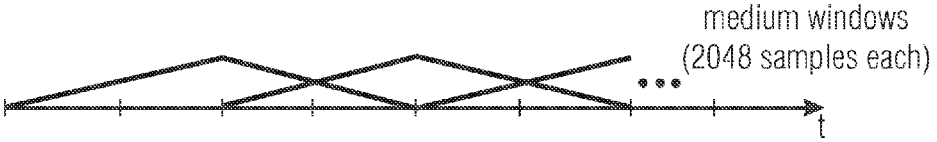
FIG. 14C illustrates medium sized windows applied in the second coding branch.
Figure 14D:
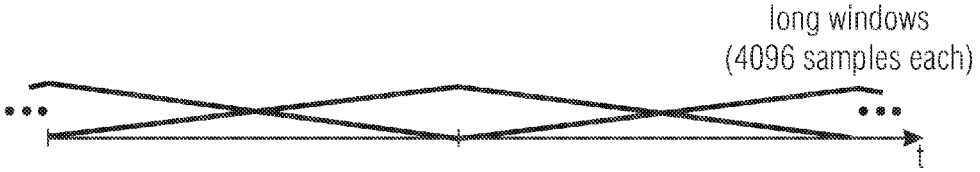
FIG. 14D illustrates long windows applied by the second coding branch.

FIG. 14A-14G illustrates different resolutions/window sizes in the second encoding branch. In an embodiment of the present invention, the second encoding branch has a first processing branch which is an ACELP time domain coder 526, and the second processing branch comprises the filterbank 523. In this branch, a super frame of, for example 2048 samples, is sub-divided into frames of 256 samples. Individual frames of 256 samples can be separately used so that a sequence of four windows, each window covering two frames, can be applied when an MDCT with 50 percents overlap is applied. Then, a high time resolution is used as illustrated in FIG. 14D. Alternatively, when the signal allows longer windows, the sequence as in FIG. 14C can be applied, where a double window size having 1,024 samples for each window (medium windows) is applied, so that one window covers four frames and there is an overlap of 50 percent.

Finally, when the signal is such that a long window can be used, this long window extends over 4,096 samples again with a 50 percent overlap.

In the embodiment, in which there are two branches, where one branch has an ACELP encoder, the position of the ACELP frame indicated by "A" in the super frame also may determine the window size applied for two adjacent TCX frames indicated by "T" in FIG. 14E. Basically, one is interested in using long windows whenever possible. Nevertheless, short windows have to be applied when a single T frame is between two A frames. Medium windows can be applied when there are two adjacent T frames. However, when there are three adjacent T frames, a corresponding larger window might not be efficient due to the additional complexity. Therefore, the third T frame, although not preceded by an A frame can be processed by a short window. When the whole super frame only has T frames then a long window can be applied.

FIG. 14F illustrates several alternatives for windows, where the window size is 2× the number lg of spectral coefficients due to 50 percent overlap. However, other overlap percentages for all encoding branches can be applied so that the relation between window size and transform length can also be different from two and even approach one, when no time domain aliasing is applied.

FIG. 14G illustrates rules for constructing a window based on rules given in FIG. 14F. The value ZL illustrates zeroes at the beginning of the window. The value L illustrates a number of window coefficients in an aliasing zone. The values in portion M are "1" values not introducing any aliasing due to an overlap with an adjacent window which has zero values in the portion corresponding to M. The portion M is followed by a right overlap zone R, which is followed by a ZR zone of zeros, which would correspond to a portion M of a subsequent window.

Reference is made to the subsequently attached annex, which describes an advantageous and detailed implementation of an inventive audio encoding/decoding scheme, particularly with respect to the decoder-side.

Annex

1. Windows and Window Sequences

Quantization and coding is done in the frequency domain. For this purpose, the time signal is mapped into the frequency domain in the encoder. The decoder performs the inverse mapping as described in subclause 2. Depending on the signal, the coder may change the time/frequency resolution by using three different windows size: 2304, 2048 and 256. To switch between windows, the transition windows LONG_START_WINDOW, LONG_STOP_WINDOW, START_WINDOW_LPD, STOP_WINDOW__1152, STOP_ START_WINDOW and STOP_START_WINDOW__1152 are used. Table 5.11 lists the windows, specifies the corresponding transform length and shows the shape of the windows schematically. Three transform lengths are used: 1152, 1024 (or 960) (referred to as long transform) and 128 (or 120) coefficients (referred to as short transform).

Window sequences are composed of windows in a way that a raw_data_block contains data representing 1024 (or 960) output samples. The data element window sequence indicates the window sequence that is actually used. FIG. 13C lists how the window sequences are composed of individual windows. Refer to subclause 2 for more detailed information about the transform and the windows.

1.2 Scalefactor Bands and Grouping

See ISO/IEC 14496-3, subpart 4, subclause 4.5.2.3.4

As explain in ISO/IEC 14496-3, subpart 4, subclause 4.5.2.3.4, the width of the scalefactor bands is built in imitation of the critical bands of the human auditory system. For that reason the number of scalefactor bands in a spectrum and their width depend on the transform length and the sampling frequency. Table 4.110 to Table 4.128, in ISO/IEC 14496-3, subpart 4, section 4.5.4, list the offset to the beginning of each scalefactor band on the transform lengths 1024 (960) and 128 (120) and on the sampling frequencies. The tables originally designed for LONG_WINDOW, LONG_START_WINDOW and LONG_STOP_WINDOW are used also for START_WINDOW_LPD and STOP_START_WINDOW. The offset tables for STOP_WINDOW__1152 and STOP_START_WINDOW__1152 are Table 4 to Table 10.

1.3 Decoding of lpd_Channel_Stream( )

The lpd_channel_stream( ) bitstream element contains all needed information to decode one frame of "linear prediction domain" coded signal. It contains the payload for one frame of encoded signal which was coded in the LPC-domain, i.e. including an LPC filtering step. The residual of this filter (so-called "excitation") is then represented either with the help of an ACELP module or in the MDCT transform domain ("transform coded excitation", TCX). To allow close adaptation to the signal characteristics, one frame is broken down in to four smaller units of equal size, each of which is coded either with ACELP or TCX coding scheme.

This process is similar to the coding scheme described in 3GPP TS 26.290. Inherited from this document is a slightly different terminology, where one "superframe" signifies a signal segment of 1024 samples, whereas a "frame" is exactly one fourth of that, i.e. 256 samples. Each one of these frames is further subdivided into four "subframes" of equal length. Please note that this subchapter adopts this terminology 1.4 Definitions, Data Elements acelp_core_mode This bitfield indicates the exact bit allocation scheme in case ACELP is used as a lpd coding mode.

lpd_mode The bit-field mode defines the coding modes for each of the four frames within one superframe of the lpd_channel_stream( ) (corresponds to one AAC frame). The coding modes are stored in the array mod[ ] and can take values from 0 to 3. The mapping from lpd_mode to mod[ ] can be determined from Table 1 below.

TABLE 1

Mapping of coding modes for lpd_channel_stream( )

| | meaning of bits in bit-field mode | | | | | remaining |
|---|---|---|---|---|---|---|
| lpd_mode | bit 4 | bit 3 | bit 2 | bit 1 | bit 0 | mod[ ] entries |
| 0 . . . 15 | 0 | mod[3] | mod[2] | mod[1] | mod[0] | |
| 16 . . . 19 | 1 | 0 | 0 | mod[3] | mod[2] | mod[1] = 2<br>mod[0] = 2 |
| 20 . . . 23 | 1 | 0 | 1 | mod[1] | mod[0] | mod[3] = 2<br>mod[2] = 2 |
| 24 | 1 | 1 | 0 | 0 | 0 | mod[3] = 2<br>mod[2] = 2<br>mod[1] = 2<br>mod[0] = 2 |
| 25 | 1 | 1 | 0 | 0 | 1 | mod[3] = 3<br>mod[2] = 3<br>mod[1] = 3<br>mod[0] = 3 |
| 26 . . . 31 | | | | | | reserved |

mod[0 . . . 3] The values in the array mod[ ] indicate the respective coding modes in each frame:

TABLE 2

Coding modes indicated by mod[ ]

| value of mod[x] | coding mode in frame | bitstream element |
|---|---|---|
| 0 | ACELP | acelp_coding( ) |
| 1 | one frame of TCX | tcx_coding( ) |
| 2 | TCX covering half a superframe | tcx_coding( ) |
| 3 | TCX covering entire superframe | tcx_coding( ) |
| acelp_coding( ) | Syntax element which contains all data to decode one frame of ACELP excitation. | |

TABLE 2-continued

| Coding modes indicated by mod[ ] | | |
|---|---|---|
| value of mod[x] | coding mode in frame | bitstream element |
| tcx_coding( ) | Syntax element which contains all data to decode one frame of MDCT based transform coded excitation (TCX). | |
| first_tcx_flag | Flag which indicates if the current processed TCX frame is the first in the superframe. | |
| lpc_data( ) | Syntax element which contains all data to decode all LPC filter parameter sets needed to decode the current superframe. | |
| first_lpd_flag | Flag which indicates whether the current superframe is the first of a sequence of superframes which are coded in LPC domain. This flag can also be determined from the history of the bitstream element core_mode (core_mode( ) and core_mode1 in case of a channel_pair_element) according to Table 3. | |

TABLE 3

| Definition of first_lpd_flag | | |
|---|---|---|
| core_mode of previous frame (superframe) | core_mode of current frame (superframe) | first_lpd_flag |
| 0 | 1 | 1 |
| 1 | 1 | 0 |
| last_lpd_mode | Indicates the lpd_mode of the previously decoded frame. | |

1.5 Decoding Process

In the lpd_channel_stream the order of decoding is

Get acelp_core_mode

Get lpd_mode and determine from it the content of the helper variable mod[ ]

Get acelp_coding or tcx_coding data depending on the content of the helper variable mod [ ]

Get lpc_data 1.6 ACELP/TCX Coding Mode Combinations

In analogy to [8], section 5.2.2, there are 26 allowed combinations of ACELP or TCX within one superframe of an lpd_channel_stream payload. One of these 26 mode combinations is signaled in the bitstream element lpd_mode. The mapping of lpd_mode to actual coding modes of each frame in a subframe is shown in Table 1 and Table 2.

TABLE 4

| scalefactor bands for a window length of 2304 for STOP_START_1152_WINDOW and STOP_1152_WINDOW at 44.1 and 48 kHz | |
|---|---|
| fs [kHz] | 44.1, 48 |
| num_swb_long_window | 49 |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 48 |
| 12 | 56 |

TABLE 4-continued

| scalefactor bands for a window length of 2304 for STOP_START_1152_WINDOW and STOP_1152_WINDOW at 44.1 and 48 kHz | |
|---|---|
| fs [kHz] | 44.1, 48 |
| num_swb_long_window | 49 |
| swb | swb_offset_long_window |
| 13 | 64 |
| 14 | 72 |
| 15 | 80 |
| 16 | 88 |
| 17 | 96 |
| 18 | 108 |
| 19 | 120 |
| 20 | 132 |
| 21 | 144 |
| 22 | 160 |
| 23 | 176 |
| 24 | 196 |
| 25 | 216 |
| 26 | 240 |
| 27 | 264 |
| 28 | 292 |
| 29 | 320 |
| 30 | 352 |
| 31 | 384 |
| 32 | 416 |
| 33 | 448 |
| 34 | 480 |
| 35 | 512 |
| 36 | 544 |
| 37 | 576 |
| 38 | 608 |
| 39 | 640 |
| 40 | 672 |
| 41 | 704 |
| 42 | 736 |
| 43 | 768 |
| 44 | 800 |
| 45 | 832 |
| 46 | 864 |
| 47 | 896 |
| 48 | 928 |
| | 1152 |

TABLE 5

| scalefactor bands for a window length of 2304 for STOP_START_1152_WINDOW and STOP_1152_WINDOW at 32 kHz | |
|---|---|
| fs [kHz] | 32 |
| num_swb_long_window | 51 |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 48 |
| 12 | 56 |
| 13 | 64 |
| 14 | 72 |
| 15 | 80 |
| 16 | 88 |

TABLE 5-continued

| scalefactor bands for a window length of 2304 for STOP_START_1152_WINDOW and STOP_1152_WINDOW at 32 kHz | |
|---|---|
| fs [kHz] | 32 |
| num_swb_long_window | 51 |
| swb | swb_offset_long_window |
| 17 | 96 |
| 18 | 108 |
| 19 | 120 |
| 20 | 132 |
| 21 | 144 |
| 22 | 160 |
| 23 | 176 |
| 24 | 196 |
| 25 | 216 |
| 26 | 240 |
| 27 | 264 |
| 28 | 292 |
| 29 | 320 |
| 30 | 352 |
| 31 | 384 |
| 32 | 416 |
| 33 | 448 |
| 34 | 480 |
| 35 | 512 |
| 36 | 544 |
| 37 | 576 |
| 38 | 608 |
| 39 | 640 |
| 40 | 672 |
| 41 | 704 |
| 42 | 736 |
| 43 | 768 |
| 44 | 800 |
| 45 | 832 |
| 46 | 864 |
| 47 | 896 |
| 48 | 928 |
| 49 | 960 |
| 50 | 992 |
| | 1152 |

TABLE 6

| scalefactor bands for window length of of 2304 for STOP_START_1152_WINDOW and STOP_1152_WINDOW at 8 kHz | |
|---|---|
| fs [kHz] | 8 |
| num_swb_long_window | 40 |
| swb | swb_offset_long_window |
| 0 | 0 |
| 1 | 12 |
| 2 | 24 |
| 3 | 36 |
| 4 | 48 |
| 5 | 60 |
| 6 | 72 |
| 7 | 84 |
| 8 | 96 |
| 9 | 108 |
| 10 | 120 |
| 11 | 132 |
| 12 | 144 |
| 13 | 156 |
| 14 | 172 |
| 15 | 188 |
| 16 | 204 |
| 17 | 220 |
| 18 | 236 |

TABLE 6-continued

| scalefactor bands for window length of of 2304 for STOP_START_1152_WINDOW and STOP_1152_WINDOW at 8 kHz | |
|---|---|
| fs [kHz] | 8 |
| num_swb_long_window | 40 |
| swb | swb_offset_long_window |
| 19 | 252 |
| 20 | 268 |
| 21 | 288 |
| 22 | 308 |
| 23 | 328 |
| 24 | 348 |
| 25 | 372 |
| 26 | 396 |
| 27 | 420 |
| 28 | 448 |
| 29 | 476 |
| 30 | 508 |
| 31 | 544 |
| 32 | 580 |
| 33 | 620 |
| 34 | 664 |
| 35 | 712 |
| 36 | 764 |
| 37 | 820 |
| 38 | 880 |
| 39 | 944 |
| | 1152 |

TABLE 7

| scalefactor bands for a window length of 2304 for STOP_START_1152_WINDOW and STOP_1152_WINDOW at 11.025, 12 and 16 kHz | |
|---|---|
| fs [kHz] | 11.025, 12, 16 |
| num_swb_long_window | 43 |
| swb | swb_offset_long_window |
| 0 | 0 |
| 1 | 8 |
| 2 | 16 |
| 3 | 24 |
| 4 | 32 |
| 5 | 40 |
| 6 | 48 |
| 7 | 56 |
| 8 | 64 |
| 9 | 72 |
| 10 | 80 |
| 11 | 88 |
| 12 | 100 |
| 13 | 112 |
| 14 | 124 |
| 15 | 136 |
| 16 | 148 |
| 17 | 160 |
| 18 | 172 |
| 19 | 184 |
| 20 | 196 |
| 21 | 212 |
| 22 | 228 |
| 23 | 244 |
| 24 | 260 |
| 25 | 280 |
| 26 | 300 |
| 27 | 320 |
| 28 | 344 |
| 29 | 368 |

TABLE 7-continued

| scalefactor bands for a window length of 2304 for STOP_START_1152_WINDOW and STOP_1152_WINDOW at 11.025, 12 and 16 kHz | |
|---|---|
| fs [kHz] | 11.025, 12, 16 |
| num_swb_long_window | 43 |
| swb | swb_offset_long_window |
| 30 | 396 |
| 31 | 424 |
| 32 | 456 |
| 33 | 492 |
| 34 | 532 |
| 35 | 572 |
| 36 | 616 |
| 37 | 664 |
| 38 | 716 |
| 39 | 772 |
| 40 | 832 |
| 41 | 896 |
| 42 | 960 |
| | 1152 |

TABLE 8

| scalefactor bands for a window length of 2304 for STOP_START_1152_WINDOW and STOP_1152_WINDOW at 22.05 and 24 kHz | |
|---|---|
| fs [kHz] | 22.05 and 24 |
| num_swb_long_window | 47 |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 44 |
| 12 | 52 |
| 13 | 60 |
| 14 | 68 |
| 15 | 76 |
| 16 | 84 |
| 17 | 92 |
| 18 | 100 |
| 19 | 108 |
| 20 | 116 |
| 21 | 124 |
| 22 | 136 |
| 23 | 148 |
| 24 | 160 |
| 25 | 172 |
| 26 | 188 |
| 27 | 204 |
| 28 | 220 |
| 29 | 240 |
| 30 | 260 |
| 31 | 284 |
| 32 | 308 |
| 33 | 336 |
| 34 | 364 |
| 35 | 396 |
| 36 | 432 |

TABLE 8-continued

| scalefactor bands for a window length of 2304 for STOP_START_1152_WINDOW and STOP_1152_WINDOW at 22.05 and 24 kHz | |
|---|---|
| fs [kHz] | 22.05 and 24 |
| num_swb_long_window | 47 |
| swb | swb_offset_long_window |
| 37 | 468 |
| 38 | 508 |
| 39 | 552 |
| 40 | 600 |
| 41 | 652 |
| 42 | 704 |
| 43 | 768 |
| 44 | 832 |
| 45 | 896 |
| 46 | 960 |
| | 1152 |

TABLE 9

| scalefactor bands for a window length of 2304 for STOP_START_1152_WINDOW and STOP_1152_WINDOW at 64 kHz | |
|---|---|
| fs [kHz] | 64 |
| num_swb_long_window | 47 (46) |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 44 |
| 12 | 48 |
| 13 | 52 |
| 14 | 56 |
| 15 | 64 |
| 16 | 72 |
| 17 | 80 |
| 18 | 88 |
| 19 | 100 |
| 20 | 112 |
| 21 | 124 |
| 22 | 140 |
| 23 | 156 |
| 24 | 172 |
| 25 | 192 |
| 26 | 216 |
| 27 | 240 |
| 28 | 268 |
| 29 | 304 |
| 30 | 344 |
| 31 | 384 |
| 32 | 424 |
| 33 | 464 |
| 34 | 504 |
| 35 | 544 |
| 36 | 584 |
| 37 | 624 |
| 38 | 664 |
| 39 | 704 |
| 40 | 744 |
| 41 | 784 |

TABLE 9-continued

| scalefactor bands for a window length of 2304 for STOP_START_1152_WINDOW and STOP_1152_WINDOW at 64 kHz | |
|---|---|
| fs [kHz] | 64 |
| num_swb_long_window | 47 (46) |
| swb | swb_offset_long_window |
| 42 | 824 |
| 43 | 864 |
| 44 | 904 |
| 45 | 944 |
| 46 | 984 |
| | 1152 |

TABLE 10

| scalefactor bands for a window length of 2304 for STOP_START_1152_WINDOW and STOP_1152_WINDOW at 88.2 and 96 kHz | |
|---|---|
| fs [kHz] | 88.2 and 96 |
| num_swb_long_window | 41 |
| swb | swb_offset_long_window |
| 0 | 0 |
| 1 | 4 |
| 2 | 8 |
| 3 | 12 |
| 4 | 16 |
| 5 | 20 |
| 6 | 24 |
| 7 | 28 |
| 8 | 32 |
| 9 | 36 |
| 10 | 40 |
| 11 | 44 |
| 12 | 48 |
| 13 | 52 |
| 14 | 56 |
| 15 | 64 |
| 16 | 72 |
| 17 | 80 |
| 18 | 88 |
| 19 | 96 |
| 20 | 108 |
| 21 | 120 |
| 22 | 132 |
| 23 | 144 |
| 24 | 156 |
| 25 | 172 |
| 26 | 188 |
| 27 | 212 |
| 28 | 240 |
| 29 | 276 |
| 30 | 320 |
| 31 | 384 |
| 32 | 448 |
| 33 | 512 |
| 34 | 576 |
| 35 | 640 |
| 36 | 704 |
| 37 | 768 |
| 38 | 832 |
| 39 | 896 |
| 40 | 960 |
| | 1152 |

1.7 Scale Factor Band Tables References

For all other scalefactor band tables please refer to ISO/IEC 14496-3, subpart 4, section 4.5.4 Table 4.129 to Table 4.147.

1.8 Quantization

For quantization of the AAC spectral coefficients in the encoder a non uniform quantizer is used. Therefore the decoder has to perform the inverse non uniform quantization after the Huffman decoding of the scalefactors (see subclause 6.3) and the noiseless decoding of the spectral data (see subclause 6.1).

For the quantization of the TCX spectral coefficients, a uniform quantizer is used. No inverse quantization is needed at the decoder after the noiseless decoding of the spectral data.

2. Filterbank and Block Switching 2.1 Tool Description

The time/frequency representation of the signal is mapped onto the time domain by feeding it into the filterbank module. This module consists of an inverse modified discrete cosine transform (IMDCT), and a window and an overlap-add function. In order to adapt the time/frequency resolution of the filterbank to the characteristics of the input signal, a block switching tool is also adopted. N represents the window length, where N is a function of the window_sequence (see subclause 1.1). For each channel, the N/2 time-frequency values $X_{i,k}$ are transformed into the N time domain values $x_{i,n}$ via the IMDCT. After applying the window function, for each channel, the first half of the $z_{i,n}$ sequence is added to the second half of the previous block windowed sequence to reconstruct the output samples for each channel $out_{i,n}$.

2.2 Definitions window_sequence 2 bit indicating which window sequence (i.e. block size) is used.

window_shape 1 bit indicating which window function is selected.

FIG. 13C shows the eight window_sequences (ONLY_LONG_SEQUENCE, LONG_START_SEQUENCE, EIGHT_SHORT_SEQUENCE, LONG_STOP_SEQUENCE, STOP_START_SEQUENCE, STOP__1152_SEQUENCE, LPD_START_SEQUENCE, STOP_START__1152_SEQUENCE).

In the following LPD_SEQUENCE refers to all allowed window/coding mode combinations inside the so called linear prediction domain codec (see section 1.3). In the context of decoding a frequency domain coded frame it is important to know only if a following frame is encoded with the LP domain coding modes, which is represented by an LPD_SEQUENCE. However, the exact structure within the LPD_SEQUENCE is taken care of when decoding the LP domain coded frame.

2.3 Decoding Process 2.3.1 IMDCT

The analytical expression of the IMDCT is:

$$x_{i,n} = \frac{2}{N}\sum_{k=0}^{\frac{N}{2}-1} spec[i][k]\cos\left(\frac{2\pi}{N}(n+n_0)\left(k+\frac{1}{2}\right)\right) \quad \text{for } 0 \le n < N$$

where:

n=sample index i=window index k=spectral coefficient index

N=window length based on the window_sequence value $n_0=(N/2+1)/2$

The synthesis window length N for the inverse transform is a function of the syntax element window sequence and the algorithmic context. It is defined as follows:

Window length 2304:

$$N = \begin{cases} 2304, & \text{if STOP_1152_SEQUENCE} \\ 2304, & \text{if STOP_START_1152_SEQUENCE} \end{cases}$$

Window length 2048:

$$N = \begin{cases} 2048, & \text{if ONLY_LONG_SEQUENCE} \\ 2048, & \text{if LONG_START_SEQUENCE} \\ 256, & \text{if EIGHT_SHORT_SEQUENCE} \\ 2048, & \text{if LONG_STOP_SEQUENCE} \\ 2048, & \text{if STOP_START_SEQUENCE} \\ 2048, & \text{if LPD_START_SEQUENCE} \end{cases}$$

The meaningful block transitions are as follows:

$$\text{From ONLY_LONG_SEQUENCE to} \begin{cases} \text{ONLY_LONG_SEQUENCE} \\ \text{LONG_START_SEQUENCE} \\ \text{LPD_START_SEQUENCE} \end{cases}$$

$$\text{from LONG_START_SEQUENCE to} \begin{cases} \text{EIGHT_SHORT_SEQUENCE} \\ \text{LONG_STOP_SEQUENCE} \end{cases}$$

$$\text{from LONG_STOP_SEQUENCE to} \begin{cases} \text{ONLY_LONG_SEQUENCE} \\ \text{LONG_START_SEQUENCE} \\ \text{LPD_START_SEQUENCE} \end{cases}$$

$$\text{from EIGHT_SHORT_SEQUENCE to} \begin{cases} \text{EIGHT_SHORT_SEQUENCE} \\ \text{LONG_STOP_SEQUENCE} \\ \text{STOP_START_SEQUENCE} \end{cases}$$

$$\text{from LPD_SEQUENCE to} \begin{cases} \text{LPD_SEQUENCE} \\ \text{STOP_1152_SEQUENCE} \\ \text{STOP_START_1152_SEQUENCE} \end{cases}$$

$$\text{from STOP_START_SEQUENCE to} \begin{cases} \text{EIGHT_SHORT_SEQUENCE} \\ \text{LONG_STOP_SEQUENCE} \end{cases}$$

$$\text{from LPD_START_SEQUENCE to} \begin{cases} \text{LPD_SEQUENCE} \end{cases}$$

$$\text{from STOP_1152_SEQUENCE to} \begin{cases} \text{ONLY_LONG_SEQUENCE} \\ \text{LONG_START_SEQUENCE} \end{cases}$$

$$\text{from STOP_START_1152_SEQUENCE to} \begin{cases} \text{EIGHT_SHORT_SEQUENCE} \\ \text{LONG_STOP_SEQUENCE} \end{cases}$$

2.3.2 Windowing and Block Switching

Depending on the window_sequence and window_shape element different transform windows are used. A combination of the window halves described as follows offers all possible window_sequences.

For window_shape=1, the window coefficients are given by the Kaiser-Bessel derived (KBD) window as follows:

$$W_{KBD_LEFT,N}(n) = \sqrt{\frac{\sum_{p=0}^{n} [W'(p, \alpha)]}{\sum_{p=0}^{N/2} [W'(p, \alpha)]}} \quad \text{for } 0 \le n < \frac{N}{2}$$

$$W_{KBD_RIGHT,N}(n) = \sqrt{\frac{\sum_{p=0}^{N-n-1} [W'(p, \alpha)]}{\sum_{p=0}^{N/2} [W'(p, \alpha)]}} \quad \text{for } \frac{N}{2} \le n < N$$

where:

W', Kaiser-Bessel kernel window function, see also [5], is defined as follows:

$$W'(n, \alpha) = \frac{I_0\left[\pi\alpha\left(\sqrt{1.0 - \left(\frac{n - N/4}{N/4}\right)}\right)^2\right]}{I_0[\pi\alpha]} \quad \text{for } 0 \le n \le \frac{N}{2}$$

$$I_0[x] = \sum_{k=0}^{\infty} \left[\frac{\left(\frac{x}{2}\right)^k}{k!}\right]^2$$

$$\alpha = \text{kernel window alpha factor, } \alpha = \begin{cases} 4 \text{ for } N = 2048\,(1920) \\ 6 \text{ for } N = 256\,(240) \end{cases}$$

Otherwise, for window_shape=0, a sine window is employed as follows:

$$W_{SIN_LEFT,N}(n) = \sin\left(\frac{\pi}{N}\left(n + \frac{1}{2}\right)\right) \quad \text{for } 0 \le n < \frac{N}{2}$$

$$W_{SIN_RIGHT,N}(n) = \sin\left(\frac{\pi}{N}\left(n + \frac{1}{2}\right)\right) \quad \text{for } \frac{N}{2} \le n < N$$

The window length N can be 2048 (1920) or 256 (240) for the KBD and the sine window. In case of STOP_1152_SEQUENCE and STOP_START_1152_SEQUENCE, N can still be 2048 or 256, the window slopes are similar but the flat top regions are longer.

Only in the case of LPD_START_SEQUENCE the right part of the window is a sine window of 64 samples.

How to obtain the possible window sequences is explained in the parts a)-h) of this subclause.

For all kinds of window_sequences the window_shape of the left half of the first transform window is determined by the window shape of the previous block. The following formula expresses this fact:

$$W_{LEFT,N}(n) = \begin{cases} W_{KBD_LEFT,N}(n), & \text{if window_shape_previous_block == 1} \\ W_{SIN_LEFT,N}(n), & \text{if window_shape_previous_block == 0} \end{cases}$$

where:

window_shape_previous_block: window_shape of the previous block (i−1).

For the first raw_data_block( )to be decoded the window_shape of the left and right half of the window are identical.

a) ONLY_LONG_SEQUENCE:

The window sequence=ONLY_LONG_SEQUENCE is equal to one LONG_WINDOW with a total window length N_l of 2048 (1920).

For window_shape=1 the window for ONLY_LONG_SEQUENCE is given as follows:

$$W(n)=\begin{cases} W_{LEFT,N_l}(n), & \text{for } 0 \le n < N_l/2 \\ W_{SIN_RIGHT,N_l}(n), & \text{for } N_l/2 \le n < N_l \end{cases}$$

If window_shape=0 the window for ONLY_LONG_SEQUENCE can be described as follows:

$$W(n)=\begin{cases} W_{LEFT,N_l}(n), & \text{for } 0 \le n < N_l/2 \\ W_{KBD_RIGHT,N_l}(n), & \text{for } N_l/2 \le n < N_l \end{cases}$$

After windowing, the time domain values ($z_{i,n}$) can be expressed as:

$$z_{i,n}=w(n)\cdot x_{i,n};$$

b) LONG_START_SEQUENCE:

The LONG_START_SEQUENCE is needed to obtain a correct overlap and add for a block transition from a ONLY_LONG_SEQUENCE to a EIGHT_SHORT_SEQUENCE.

Window length N_l and N_s is set to 2048 (1920) and 256 (240) respectively.

If window_shape=1 the window for LONG_START_SEQUENCE is given as follows:

$$W(n)=\begin{cases} W_{LEFT,N_l}(n), & \text{for } 0 \le n < N_l/2 \\ 1.0, & \text{for } N_l/2 \le n < \frac{3N_l-N_s}{4} \\ W_{KBD_RIGHT,N_s}\left(n+\frac{N_s}{2}-\frac{3N_l-N_s}{4}\right), & \text{for } \frac{3N_l-N_s}{4} \le n < \frac{3N_l+N_s}{4} \\ 0.0, & \text{for } \frac{3N_l+N_s}{4} \le n < N_l \end{cases}$$

If window _shape=0 the window for LONG_START_SEQUENCE looks like:

$$W(n)=\begin{cases} W_{LEFT,N_l}(n), & \text{for } 0 \le n < N_l/2 \\ 1.0, & \text{for } N_l/2 \le n < \frac{3N_l-N_s}{4} \\ W_{SIN_RIGHT,N_s}\left(n+\frac{N_s}{2}-\frac{3N_l-N_s}{4}\right), & \text{for } \frac{3N_l-N_s}{4} \le n < \frac{3N_l+N_s}{4} \\ 0.0, & \text{for } \frac{3N_l+N_s}{4} \le n < N_l \end{cases}$$

The windowed time-domain values can be calculated with the formula explained in a).

c) EIGHT_SHORT

The window_sequence=EIGHT_SHORT comprises eight overlapped and added SHORT_WINDOWs with a length N_s of 256 (240) each. The total length of the window_sequence together with leading and following zeros is 2048 (1920). Each of the eight short blocks are windowed separately first. The short block number is indexed with the variable j=0, . . . , M−1 (M=N_l/N_s).

The window_shape of the previous block influences the first of the eight short blocks ($W_0(n)$) only. If window_shape=1 the window functions can be given as follows:

$$W_0(n)=\begin{cases} W_{LEFT,N_s}(n), & \text{for } 0 \le n < N_s/2 \\ W_{KBD_RIGHT,N_s}(n), & \text{for } N_s/2 \le n < N_s \end{cases}$$

$$W_{1-(M-1)}(n)=\begin{cases} W_{KBD_LEFT,N_s}(n) & \text{for } 0 \le n < N_s/2 \\ W_{KBD_RIGHT,N_s}(n), & \text{for } N_s/2 \le n < N_s \end{cases}$$

Otherwise, if window_shape=0, the window functions can be described as:

$$W_0(n) = \begin{cases} W_{LEFT,N_s}(n), & \text{for } 0 \le n < \text{N_s}/2 \\ W_{SIN_RIGHT,N_s}(n), & \text{for } \text{N_s}/2 \le n < \text{N_s} \end{cases}$$

$$W_{1-(M-1)}(n) = \begin{cases} W_{\text{SIN_LEFT},N_s}(n), & \text{for } 0 \le n < \text{N_s}/2 \\ W_{SIN_RIGHT,N_s}(n), & \text{for } \text{N_s}/2 \le n < \text{N_s} \end{cases}$$

The overlap and add between the EIGHT_SHORT window_sequence resulting in the windowed time domain values is described as follows:

$$z_{i,n} = \begin{cases} 0, & \text{for } 0 \le n < \frac{\text{N_l} - \text{N_s}}{4} \\ x_{0,n-\frac{N_l-N_s}{4}} \cdot W_0\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ x_{j-1,n-\frac{N_l+(2j-3)-N_s}{4}} \cdot W_{j-1}\left(n - \frac{\text{N_l} + (2j-3)N_s}{4}\right) + & \text{for } 1 \le j < M, \\ \quad x_{j,n-\frac{N_l+(2j-1)N_s}{4}} \cdot W_j\left(n - \frac{\text{N_l} + (2j-1)\text{N_s}}{4}\right), & \frac{\text{N_l} + (2j-1)\text{N_s}}{4} \le n < \frac{\text{N_l} + (2j+1)\text{N_s}}{4} \\ x_{M-1,n-\frac{N_l+(2M-3)N_s}{4}} \cdot W_{M-1}\left(n - \frac{\text{N_l} + (2M-3)\text{N_s}}{4}\right), & \text{for } \frac{\text{N_l} + (2M-1)\text{N_s}}{4} \le n < \frac{\text{N_l} + (2M+1)\text{N_s}}{4} \\ 0, & \text{for } \frac{\text{N_l} + (2M+1)\text{N_s}}{4} \le n < \text{N_l} \end{cases}$$

d) LONG_STOP_SEQUENCE

This window_sequence is needed to switch from a EIGHT_ SHORT_SEQUENCE back to a ONLY_LONG_ SEQUENCE.

If window_shape=1 the window for LONG_STOP_SEQUENCE is given as follows:

$$W(n) = \begin{cases} 0.1, & \text{for } 0 \le n < \frac{\text{N_l} - \text{N_s}}{4} \\ W_{LEFT,N_s}\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ 1.0, & \text{for } \frac{\text{N_l} + \text{N_s}}{4} \le n < \text{N_l}/2 \\ W_{KBD_RIGHT,N_l}(n), & \text{for } \text{N_l}/2 \le n < \text{N_l} \end{cases}$$

If window shape=0 the window for LONG_START_SEQUENCE is determined by:

$$W(n) = \begin{cases} 0.0, & \text{for } 0 \le n < \frac{\text{N_l} - \text{N_s}}{4} \\ W_{LEFT,N_s}\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ 1.0, & \text{for } \frac{\text{N_l} + \text{N_s}}{4} \le n < \text{N_l}/2 \\ W_{SIN_RIGHT,N_l}(n), & \text{for } \text{N_l}/2 \le n < \text{N_l} \end{cases}$$

The windowed time domain values can be calculated with the formula explained in a).

e) STOP_START_SEQUENCE:

The STOP_START_SEQUENCE is needed to obtain a correct overlap and add for a block transition from a EIGHT_ SHORT_SEQUENCE to a EIGHT_SHORT_SEQUENCE when just a ONLY_LONG_SEQUENCE is needed.

Window length N_l and N_s is set to 2048 (1920) and 256 (240) respectively.

If window_shape=1 the window for STOP_START_SEQUENCE is given as follows:

$$W(n) = \begin{cases} 0.0, & \text{for } 0 \le n < \frac{\text{N_l} - \text{N_s}}{4} \\ W_{LEFT,N_s}\left(n - \frac{\text{N_l} - \text{N_s}}{4}\right), & \text{for } \frac{\text{N_l} - \text{N_s}}{4} \le n < \frac{\text{N_l} + \text{N_s}}{4} \\ 1.0, & \text{for } \frac{\text{N_l} + \text{N_s}}{4} \le n < \frac{3\text{N_l} - \text{N_s}}{4} \\ W_{KBD_RIGHT,N_s}\left(n + \frac{\text{N_s}}{2} - \frac{3\text{N_l} - \text{N_3}}{4}\right), & \text{for } \frac{3\text{N_l} - \text{N_s}}{4} \le n < \frac{3\text{N_l} + \text{N_s}}{4} \\ 0.0, & \text{for } \frac{3\text{N_l} + \text{N_s}}{4} \le n < \text{N_l} \end{cases}$$

If window_shape=0 the window for STOP_START_SEQUENCE looks like:

$$W(n)=\begin{cases}0.0, & \text{for } 0\le n<\frac{N_l-N_s}{4}\\ W_{LEFT,N_s}\left(n-\frac{N_l-N_s}{4}\right), & \text{for } \frac{N_l-N_s}{4}\le n<\frac{N_l+N_s}{4}\\ 1.0, & \text{for } \frac{N_l+N_s}{4}\le n<\frac{3N_l-N_s}{4}\\ W_{SIN_RIGHT,N_s}\left(n+\frac{N_s}{2}-\frac{3N_l-N_3}{4}\right), & \text{for } \frac{3N_l-N_s}{4}\le n<\frac{3N_l+N_s}{4}\\ 0.0, & \text{for } \frac{3N_l+N_s}{4}\le n<N_l\end{cases}$$

The windowed time-domain values can be calculated with the formula explained in a).

f) LPD_START_SEQUENCE:

The LPD_START_SEQUENCE is needed to obtain a correct overlap and add for a block transition from a ONLY_LONG_SEQUENCE to a LPD_SEQUENCE.

Window length N_l and N_s is set to 2048 (1920) and 256 (240) respectively.

If window_shape=1the window for LPD_START_SEQUENCE is given as follows:

$$W(n)=\begin{cases}W_{LEFT,N_l}(n), & \text{for } 0\le n<\frac{N_l}{2}\\ 1.0, & \text{for } \frac{N_l}{2}\le n<\frac{3N_l-N_s}{4}\\ W_{\mathrm{KBD_RIGHT},\frac{N_s}{2}}\left(n+\frac{N_s}{4}-\frac{3N_l-N_s}{4}\right), & \text{for } \frac{3N_l-N_s}{4}\le n<\frac{3N_l}{4}\\ 0.0, & \text{for } \frac{3N_l}{4}\le n<N_l\end{cases}$$

If window_shape=0 the window for LPD_START_SEQUENCE looks like:

$$W(n)=\begin{cases}W_{LEFT,N_l}(n), & \text{for } 0\le n<\frac{N_l}{2}\\ 1.0, & \text{for } \frac{N_l}{2}\le n<\frac{3N_l-N_s}{4}\\ W_{\mathrm{SIN_RIGHT},\frac{N_s}{2}}\left(n+\frac{N_s}{4}-\frac{3N_l-N_s}{4}\right), & \text{for } \frac{3N_l-N_s}{4}\le n<\frac{3N_l}{4}\\ 0.0, & \text{for } \frac{3N_l}{4}\le n<N_l\end{cases}$$

The windowed time-domain values can be calculated with the formula explained in a).

g) STOP__1152_SEQUENCE:

The STOP__1152_SEQUENCE is needed to obtain a correct overlap and add for a block transition from a LPD_SEQUENCE to ONLY_LONG_SEQUENCE.

Window length N_l and N_s is set to 2048 (1920) and 256 (240) respectively.

If window_shape=1 the window for STOP__1152_SEQUENCE is given as follows:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+N_s}{4}\\ 1.0, & \text{for } \frac{N_l+2N_s}{4}\le n<\frac{2N_l+3N_s}{4}\\ W_{KBD_RIGHT,N_l}\left(n+\frac{N_l}{2}-\frac{2N_l+3N_s}{4}\right), & \text{for } \frac{2N_l+3N_s}{4}\le n<N_l+\frac{3N_s}{4}\\ 0.0, & \text{for } N_l+\frac{3N_s}{4}\le n<N_l+N_s\end{cases}$$

If window_shape=0 the window for STOP__1152_SEQUENCE looks like:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{2N_l+3N_s}{4}\\ W_{SIN_RIGHT,N_l}\left(n+\frac{N_l}{2}-\frac{2N_l+3N_s}{4}\right), & \text{for } \frac{2N_l+3N_s}{4}\le n<N_l+\frac{3N_s}{4}\\ 0.0, & \text{for } N_l+\frac{3N_s}{4}\le n<N_l+N_s\end{cases}$$

The windowed time-domain values can be calculated with the formula explained in a).

h) STOP_START__1152_SEQUENCE:

The STOP_START__1152_SEQUENCE is needed to obtain a correct overlap and add for a block transition from a LPD_SEQUENCE to a EIGHT_SHORT_SEQUENCE when just a ONLY_LONG_SEQUENCE is needed.

Window length N_l and N_s is set to 2048 (1920) and 256 (240) respectively.

If window_shape=1 the window for STOP_START_SEQUENCE is given as follows:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{3N_l}{4}+\frac{N_s}{2}\\ W_{KBD_RIGHT,N_s}\left(n+\frac{N_s}{2}-\frac{3N_l}{4}+\frac{N_s}{2}\right), & \text{for } \frac{3N_l}{4}+\frac{N_s}{2}\le n<\frac{3N_l}{4}+N_s\\ 0.0, & \text{for } \frac{3N_l}{4}+N_s\le n<N_l+N_s\end{cases}$$

If window shape=0 the window for STOP_START_SEQUENCE looks like:

$$W(n)=\begin{cases}0.0, & \text{for } 0\le n<\frac{N_l}{4}\\ W_{LEFT,N_s}\left(n-\frac{N_l}{4}\right), & \text{for } \frac{N_l}{4}\le n<\frac{N_l+2N_s}{4}\\ 1.0, & \text{for } \frac{N_l+2N_s}{4}\le n<\frac{3N_l}{4}+\frac{N_s}{2}\\ W_{SIN_RIGHT,N_s}\left(n+\frac{N_s}{2}-\frac{3N_l}{4}+\frac{N_s}{2}\right), & \text{for } \frac{3N_l}{4}+\frac{N_s}{2}\le n<\frac{3N_l}{4}+N_s\\ 0.0, & \text{for } \frac{3N_l}{4}+N_s\le n<N_l+N_s\end{cases}$$

The windowed time-domain values can be calculated with the formula explained in a).

2.3.3 Overlapping and Adding with Previous Window Sequence

Besides the overlap and add within the EIGHT_SHORT window_sequence the first (left) part of every window_sequence is overlapped and added with the second (right) part of the previous window_sequence resulting in the final time domain values $out_{i,n}$. The mathematic expression for this operation can be described as follows.

In case of ONLY_LONG_SEQUENCE, LONG_START_SEQUENCE, EIGHT_SHORT_SEQUENCE, LONG_STOP_SEQUENCE, STOP_START_SEQUENCE, LPD_START_SEQUENCE:

$$out_{i,n} = z_{i,n} + z_{i-1,n+\frac{N}{s}};$$

$$\text{for } 0 \le n < \frac{N}{2},$$

$$N = 2048(1920)$$

And in case of STOP__1152_SEQUENCE, STOP_START__1152_SEQUENCE:

$$out_{i,n} = z_{i,n} + z_{i-1,n+\frac{N_1}{2}+\frac{3N_s}{4}};$$

$$\text{for } 0 \le n < \frac{N_1}{2},$$

$$N_1 = 2048,$$

$$N_s = 256$$

In case of LPD_START_SEQUENCE, the next sequence is a LPD_SEQUENCE. A SIN or KBD window is apply on the left part of the LPD_SEQUENCE to have a good overlap and add.

$$W_{SIN_LEFT,N}(n) = \sin\left(\frac{\pi}{N}\left(n+\frac{1}{2}\right)\right) \text{ for } 0 \le n < \frac{N}{2} \text{ With } N = 128$$

In case of STOP__1152_SEQUENCE, STOP_START__1152_SEQUENCE the previous sequence is a LPD_SEQUENCE. A TDAC window is apply on the right part of the LPD_SEQUENCE to have a good overlap and add.

3.1 Windowing and Block Switching

Depending on the window_shape element different oversampled transform window prototypes are used, the length of the oversampled windows is $$N_{os}=2\cdot n_\text{long}\cdot os_\text{factor_win}$$

For window_shape=1, the window coefficients are given by the Kaiser-Bessel derived (KBD) window as follows:

$$W_{KBD}\left(n-\frac{N_{os}}{2}\right) = \sqrt{\frac{\sum_{p=0}^{N_{os}-n-1}[W(p,\alpha)]}{\sum_{p=0}^{N_{os}/2}[W(p,\alpha)]}} \text{ for } \frac{N_{os}}{2} \le n < N_{os}$$

where: W', Kaiser-Bessel kernel window function, see also [5], is defined as follows:

$$W'(n,\alpha) = \frac{I_0\left[\pi\alpha\sqrt{1.0-\left(\frac{n-N_{os}/4}{N_{os}/4}\right)}\right]}{I_0[\pi\alpha]} \text{ for } 0 \le n < \frac{N_{os}}{2}$$

$$I_0[x] = \sum_{k=0}^{\infty}\left[\frac{\left(\frac{x}{2}\right)^k}{k!}\right]^2$$

α=kernel window alpha factor, α=4

Otherwise, for window_shape=0, a sine window is employed as follows:

$$W_{SIN}\left(n-\frac{N_{os}}{2}\right) = \sin\left(\frac{\pi}{N_{os}}\left(n+\frac{1}{2}\right)\right) \text{ for } \frac{N_{os}}{2} \le n < N_{os}$$

For all kinds of window_sequences the used protoype for the left window part is the determined by the window shape of the previous block. The following formula expresses this fact:

$$\text{left_window_shape}[n] = \begin{cases} W_{KBD}[n], & \text{if window_shape_previous_block} = 1 \\ W_{SIN}[n], & \text{if window_shape_previous_block} = 0 \end{cases}$$

Likewise the prototype for the right window shape is determined by the following formula:

$$\text{right_window_shape}[n] = \begin{cases} W_{KBD}[n], & \text{if window_shape} = 1 \\ W_{SIN}[n], & \text{if window_shape} = 0 \end{cases}$$

Since the transition lengths are already determined, it only has to be differentiated between EIGHT_SHORT_SEQUENCES and all other: a)EIGHT SHORT SEQUENCE:

The following c-code like portion describes the windowing and internal overlap-add of a EIGHT_SHORT_SEQUENCE:

```
tw_windowing_short(X[ ][ ],z[ ],first_pos,last_pos,warpe_trans_len_left,warped_trans_len_r
ight,left_window_shape[ ],right_window_shape[ ]){
  offset = n_long – 4*n_short – n_short/2;
  tr_scale_l = 0.5*n_long/warped_trans_len_left*os_factor_win;
  tr_pos_l = warped_trans_len_left+(first_pos-n_long/2)+0.5)*tr_scale_l;
  tr_scale_r = 8*os_factor_win;
  tr_pos_r = tr_scale_r/2;
  for ( i = 0 ; i < n_short ; i++ ) {
    z[i] = X[0][i];
  }
```

-continued

```
for(i=0;i<first_pos;i++)
   z[i] = 0.;
for(i=n_long-1-first_pos;i>=first_pos;i--) {
   z[i] *= left_window_shape[floor(tr_pos_1)];
   tr_pos_1 += tr_scale_1;
}
for(i=0;i<n_short;i++) {
   z[offset+i+n_short]=
         X[0][i+n_short]*right_window_shape[floor(tr_pos_r)];
   tr_pos_r +=tr_scale_r;
}
offset +=n_short;
for ( k = 1 ; k < 7 ; k++) {
   tr_scale_1 = n_short*os_factor_win;
   tr_pos_1 = tr_scale_1/2;
   tr_pos_r = os_factor_win*n_long-tr_pos_1;
   for ( i = 0 ; i < n_short ; i++) {
      z[i + offset] +=X[k][i]*right_window_shape[floor(tr_pos_r)];
      z[offset + n_short + i] =
         X[k][n_short + i]*right_window_shape[floor(tr_pos_1)];
      tr_pos_1 += tr_scale_1;
      tr_pos_r −= tr_scale_1;
   }
   offset +=n_short;
}
tr_scale_1 = n_short*os_factor_win;
tr_pos_1 = tr_scale_1/2;
for ( i = n_short − 1 ; i >= 0 ; i-- ) {
   z[i + offset] += X[7][i]*right_window_shape[(int) floor(tr_pos_1)];
   tr_pos_1 += tr_scale_1;
}
   for ( i = 0 ; i < n_short ; i++) {
   z[offset + n_short + i] = X[7][n_short + i];
}
tr_scale_r = 0.5*n_long/warpedTransLenRight*os_factor_win;
tr_pos_r = 0.5*tr_scale_r+.5;
tr_pos_r = (1.5*n_long-(float)wEnd-0.5+warpedTransLenRight)*tr_scale_r;
for(i=3*n_long-1-last_pos ;i<=wEnd;i++) {
   z[i] *=right_window_shape[floor(tr_pos_r)];
   tr_pos_r +=tr_scale_r;
}
for(i=lsat_pos+1;i<2*n_long;i++)
   z[i] = 0.;
```

b) all others:

```
tw_windowing_long(X[ ][ ],z[ ],first_pos,last_pos,warpe_trans_len_left,warped_trans_len_ri
ght,left_window_shape[ ]right_window_shape[ ]){
   for(i=0;i<first_pos;i++)
      z[i] = 0.;
   for(i=last_pos+1;i<N;i++)
      z[i] = 0.;
   tr_scale = 0.5*n_long/warped_trans_len_left*os_factor_win;
   tr_pos = (warped_trans_len_left+first_pos-N/4)+0.5)*tr_scale;
   for(i=N/2-1-firstpos;i>=firstpos;i--) {
      z[i] = X[0][i]*left_window_shape[floor(tr_pos)]);
      tr_pos += tr_scale;
   }
   tr_scale = 0.5*n_long/warped_trans_len_right*os_factor_win;
   tr_pos = (3*N/4-last_pos-0.5+warped_trans_len_right)*tr_scale;
   for(i=3*N/2-1-last_pos;i<=last_pos;i++) {
      z[i] = X[0][i]*right_window_shape[floor(tr_pos)]);
      tr_pos += tr_scale;
   }
}
```

4. MDCT Based TCX 4.1 Tool Description

When the core_mode is equal to 1 and when one or more of the three TCX modes is selected as the "linear prediction-domain" coding, i.e. one of the 4 array entries of mod[ ] is greater than 0, the MDCT based TCX tool is used. The MDCT based TCX receives the quantized spectral coefficients from the arithmetic decoder. The quantized coefficients are first completed by a comfort noise before applying an inverse MDCT transformation to get a time-domain weighted synthesis which is then fed to the weighting synthesis LPC-filter 4.2 Definitions

| | |
|---|---|
| lg | Number of quantized spectral coefficients output by the arithmetic decoder |

-continued

| | |
|---|---|
| noise_factor | Noise level quantization index |
| noise level | Level of noise injected in reconstructed spectrum |
| noise[ ] | Vector of generated noise |
| global_gain | Re-scaling gain quantization index |
| g | Re-scaling gain |
| rms | Root mean square of the synthesized time-domain signal, x[ ], |
| x[ ] | Synthetized time-domain signal |

4.3 Decoding Process

The MDCT-based TCX requests from the arithmetic decoder a number of quantized spectral coefficients, lg, which is determined by the mod[ ] and last_lpd_mode values. These two values also define the window length and shape which will be applied in the inverse MDCT. The window is composed of three parts, a left side overlap of L samples, a middle part of ones of M samples and a right overlap part of R samples. To obtain an MDCT window of length 2*lg, ZL zeros are added on the left and ZR zeros on the right side as indicated in FIG. 14G for Table 3/FIG. 14F.

TABLE 3

Number of Spectral Coefficients as a Function of last_lpd_mode and mod[ ]

| Value of last_lpd_mode | value of mod[x] | Number lg of spectral coefficients | ZL | L | M | R | ZR |
|---|---|---|---|---|---|---|---|
| 0 | 1 | 320 | 160 | 0 | 256 | 128 | 96 |
| 0 | 2 | 576 | 288 | 0 | 512 | 128 | 224 |
| 0 | 3 | 1152 | 512 | 128 | 1024 | 128 | 512 |
| 1 . . . 3 | 1 | 256 | 64 | 128 | 128 | 128 | 64 |
| 1 . . . 3 | 2 | 512 | 192 | 128 | 384 | 128 | 192 |
| 1 . . . 3 | 3 | 1024 | 448 | 128 | 896 | 128 | 448 |

The MDCT window is given by $$W(n)=\begin{cases}0 & \text{for } 0\le n<ZL\\ W_{SIN_LEFT,L}(n-ZL) & \text{for } ZL\le n<ZL+L\\ 1 & \text{for } ZL+L\le n<ZL+L+M\\ W_{SIN_RIGHT,R}(n-ZL-L-M) & \text{for } ZL+L+M\le n<ZL+L+M+R\\ 0 & \text{for } ZL+L+M+R\le n<21\ \text{g}\end{cases}$$

The quantized spectral coefficients, quant[ ], delivered by the arithmetic decoder are completed by a comfort noise. The level of the injected noise is determined by the decoded noise_ factor as follows:

$$\text{noise_level}=0.0625*(8-\text{noise_factor})$$

A noise vector, noise[ ], is then computed using a random function, random_sign( ), delivering randomly the value −1 or +1.

$$\text{noise}[i]=\text{random_sign}(\ )*\text{noise_level};$$

The quant[ ] and noise[ ] vectors are combined to form the reconstructed spectral coefficients vector, r[ ], in a way that the runs of 8 consecutive zeros in quant[ ] are replaced by the components of noise[ ]. A run of 8 non-zeros are detected according to the formula:

$$\begin{cases} rl[i]=1 \text{ for } i\in[0,\ 1\ \text{g}/6[\\ rl[1\ \text{g}/6+i]=\sum_{k=0}^{7}\left|\text{quant}[1\ \text{g}/6+8.\lfloor i/8\rfloor+k]\right| \text{ for } i\in[0,\ 7.1\ \text{g}/6[\end{cases}$$

One obtains the reconstructed spectrum as follows:

$$r[i]=\begin{cases}\text{quant}[i] \text{ if } rl[i]=1\\ \text{noise}[i] \text{ otherwise}\end{cases}$$

Prior to applying the inverse MDCT a spectrum de-shaping is applied according to the following steps:

1. calculate the energy $E_m$, of the 8-dimensional block at index m for each 8-dimensional block of the first quarter of the spectrum
2. compute the ratio $R_m=\text{sqrt}(E_m/E_I)$, where I is the block index with the maximum value of all $E_m$
3. if $R_m<0.1$, then set $R_m=0.1$
4. if $R_m<R_{m-I}$, then set $R_m=R_{m-I}$ Each 8-dimensional block belonging to the first quarter of spectrum are then multiplying by the factor $R_m$.

The reconstructed spectrum is fed in an inverse MDCT. The non-windowed output signal, x[ ], is re-scaled by the gain, g, obtained by an inverse quantization of the decoded global_gain index:

$$g=10^{global_gain/28/(2.rms)}$$

Where rms is calculated as:

$$\text{rms}=\sqrt{\frac{\sum_{i=1\ \text{g}/2}^{3*1\ \text{g}/2-1}x^2[i]}{L+M+R}}$$

The rescaled synthesized time-dome signal is then equal to:

$$x_w[i]=x[i]\cdot g$$

After rescaling the windowing and overlap add is applied.

The reconstructed TCX target x(n) is then filtered through the zero-state inverse weighted synthesis filter $\hat{A}(z)(1-\alpha z^{-1})/(\hat{A}(z/\lambda)$ to find the excitation signal which will be applied to the synthesis filter. Note that the interpolated LP filter per subframe is used in the filtering. Once the excitation is determined, the signal is reconstructed by filtering the excitation through synthesis filter $1/\hat{A}(z)$ and then de-emphasizing by filtering through the filter $1(1-0.68z^{-1})$ as described above.

Note that the excitation is also needed to update the ACELP adaptive codebook and allow to switch from TCX to ACELP in a subsequent frame. Note also that the length of the TCX synthesis is given by the TCX frame length (without the overlap): 256, 512 or 1024 samples for the mod[ ] of 1,2 or 3 respectively.

Normative References

[1] ISO/IEC 11172-3:1993, Information technology—Coding of moving pictures and associated audio for digital storage media at up to about 1.5 Mbit/s, Part 3: Audio.

[2] ITU-T Rec.H.222.0(1995) I ISO/IEC 13818-1:2000, Information technology—Generic coding of moving pictures and associated audio information:—Part 1: Systems.

[3] ISO/IEC 13818-3:1998, Information technology—Generic coding of moving pictures and associated audio information:—Part 3: Audio.

[4] ISO/IEC 13818-7:2004, Information technology—Generic coding of moving pictures and associated audio information:—Part 7: Advanced Audio Coding (AAC).

[5] ISO/IEC 14496-3:2005, Information technology—Coding of audio-visual objects—Part 1: Systems

[6] ISO/IEC 14496-3:2005, Information technology—Coding of audio-visual objects—Part 3: Audio

[7] ISO/IEC 23003-1:2007, Information technology—MPEG audio technologies—Part 1: MPEG Surround

[8] 3GPP TS 26.290 V6.3.0, Extended Adaptive Multi-Rate—Wideband (AMR-WB+) codec; Transcoding functions

[9] 3GPP TS 26.190, Adaptive Multi-Rate—Wideband (AMR-WB) speech codec; Transcoding functions

[10] 3GPP TS 26.090, Adaptive Multi-Rate (AMR) speech codec; Transcoding functions Definitions Definitions can be found in ISO/IEC 14496-3, subpart 1, subclause 1.3 (Terms and definitions) and in 3GPP TS 26.290, section 3 (Definitions and abbreviations).

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Audio encoder for encoding an audio signal, comprising:

a first coding branch for encoding an audio signal using a first coding algorithm to acquire a first encoded signal, the first coding branch comprising the first converter for converting an input signal into a spectral domain;

a second coding branch for encoding an audio signal using a second coding algorithm to acquire a second encoded signal, wherein the first coding algorithm is different from the second coding algorithm, the second coding branch comprising a domain converter for converting an input signal from an input domain into an output domain, and a second converter for converting an input signal into a spectral domain;

a switch for switching between the first coding branch and the second coding branch so that, for a portion of the audio input signal, either the first encoded signal or the second encoded signal is in an encoder output signal;

a signal analyzer for analyzing the portion of the audio signal to determine, whether the portion of the audio signal is represented as the first encoded signal or the second encoded signal in the encoder output signal, wherein the signal analyzer is furthermore configured for variably determining a respective time/frequency resolution of the first converter and the second converter, when the first encoded signal or the second encoded signal representing the portion of the audio signal is generated; and an output interface for generating an encoder output signal comprising the first encoded signal and the second encoded signal and information indicating the first encoded signal and the second encoded signal, and information indicating the time/frequency resolution applied for encoding the first encoded signal and for encoding the second encoded signal.

2. Audio encoder in accordance with claim 1, in which the signal analyzer is configured for classifying the portion of the audio signal as a speech-like audio signal or a music-like audio signal and for performing a transient detection in case of a music signal for determining the time/frequency resolution of the first converter or for performing an analysis-by-synthesis processing for determining the time/frequency resolution of the second converter.

3. Audio encoder in accordance with claim 1, in which the first converter and the second converter comprise a variable windowed transform processor comprising a window function with a variable window size and a transform function with a variable transform length, and wherein the signal analyzer is configured for controlling, based on the signal analysis, the window size and /or the transform length.

4. Audio encoder in accordance with claim 1, in which the second encoder branch comprises a first processing branch for processing an audio signal in the domain determined by the domain converter, and a second processing branch comprising the second converter, wherein the signal analyzer is configured for sub-dividing the portion of the audio signal into a sequence of sub-portions, and wherein the signal analyzer is configured for determining the time/frequency resolution of the second converter depending on the position of the sub-portion processed by the first processing branch with respect to a sub-portion of the portion processed by the second processing branch.

5. Audio encoder in accordance with claim 4, in which the first processing branch comprises an ACELP encoder, in which the second processing branch comprises an MDCT-TCX processing device, in which the signal analyzer is configured for setting the time resolution of the second converter to a first value determined by a length of a sub-portion or a second value determined by a length of the sub-portion multiplied by an integer value greater than one, wherein the second value is lower than the first value.

6. Audio encoder in accordance with claim 1, in which the signal analyzer is configured for determining a signal classification in a constant raster covering a plurality of equally sized blocks of audio samples, and for sub-dividing a block into a variable number of blocks depending on the audio signal, wherein a length of the sub-block determines the first time/frequency resolution or the second time/frequency resolution.

7. Audio encoder in accordance with claim 1, in which the second coding branch comprises:

a first processing branch for processing an audio signal;

a second processing branch, the second processing branch comprising the second converter; and a further switch for switching between the first processing branch and the second processing branch so that, for a portion of the audio signal input into the second coding branch, either a first processed signal or a second processed signal is in the second encoded signal.

8. Method of audio encoding an audio signal, comprising:

encoding, in a first coding branch, an audio signal using a first coding algorithm to acquire a first encoded signal, the first coding branch comprising the first converter for converting an input signal into a spectral domain;

encoding, in a second coding branch, an audio signal using a second coding algorithm to acquire a second encoded signal, wherein the first coding algorithm is different from the second coding algorithm, the second coding branch comprising a domain converter for converting an input signal from an input domain into an output domain, and a second converter for converting an input signal into a spectral domain;

switching between the first coding branch and the second coding branch so that, for a portion of the audio input signal, either the first encoded signal or the second encoded signal is in an encoder output signal;

analyzing the portion of the audio signal to determine, whether the portion of the audio signal is represented as the first encoded signal or the second encoded signal in the encoder output signal, variably determining a respective time/frequency resolution of the first converter and the second converter, when the first encoded signal or the second encoded signal representing the portion of the audio signal is generated; and generating an encoder output signal comprising the first encoded signal and the second encoded signal and information indicating the first encoded signal and the second encoded signal, and information indicating the time/frequency resolution applied for encoding the first encoded signal and for encoding the second encoded signal.

9. Audio decoder for decoding an encoded signal, the encoded signal comprising a first encoded signal, a second encoded signal, an indication indicating the first encoded signal and the second encoded signal, and a time/frequency resolution information to be used for decoding the first encoded signal and the second encoded audio signal, comprising:

a first decoding branch for decoding the first encoded signal using a first controllable frequency/time converter, the first controllable frequency/time converter being configured for being controlled using the time/frequency resolution information for the first encoded signal to acquire a first decoded signal;

a second decoding branch for decoding the second encoded signal using a second controllable frequency/time converter, the second controllable frequency/time converter being configured for being controlled using the time/frequency resolution information for the second encoded signal;

a controller for controlling the first frequency/time converter and the second frequency/time converter using the time/frequency resolution information;

a domain converter for generating a synthesis signal using the second decoded signal; and a combiner for combining the first decoded signal and the synthesis signal to acquire a decoded audio signal.

10. Audio decoder in accordance with claim 9, in which the second decoding branch comprises a first inverse processing branch for inverse processing a first processed signal being additionally comprised in the encoded signal to acquire a first inverse processed signal;

wherein the second controllable frequency/time converter is located in a second inverse processing branch configured for inverse processing the second encoded signal in a domain identical to the domain of the first inverse processed signal to acquire a second inverse processed signal;

a further combiner for combining the first inverse processed signal and the second inverse processed signal to acquire a combined signal; and wherein the combined signal is input into the combiner.

11. Audio decoder in accordance with claim 9, in which the first frequency/time converter and the second frequency/time converter are time domain aliasing cancellation converters comprising an overlap/add unit for canceling a time-domain aliasing comprised in the first encoded signal and the second encoded signal.

12. Audio decoder in accordance with claim 9, in which the encoded signal comprises coding mode information identifying, whether an encoded signal is the first encoded signal and the second encoded signal, and wherein the decoder further comprises an input interface for interpreting the coding mode information to determine, whether the encoded signal is to be fed either into the first decoding branch or into the second decoding branch.

13. Audio decoder in accordance with claim 9, in which the first encoded signal is arithmetically encoded, and wherein the first coding branch comprises an arithmetic decoder.

14. Audio decoder in accordance with claim 9, in which the first coding branch comprises a dequantizer comprising a non-uniform dequantization characteristic for canceling a result of a non-uniform quantization applied when generating the first encoded signal, wherein the second coding branch comprises a dequantizer using a dequantization characteristic being different from the non-uniform dequantization characteristic, or wherein the second coding branch does not comprise a dequantizer at all.

15. Audio decoder in accordance with claim 9, in which the controller is configured for controlling the first frequency/time converter and the second frequency/time converter by applying, for each converter, a discrete frequency/time resolution of a number of possible different discrete frequency/time resolutions, the number of possible different frequency/time resolutions being higher for the second converter compared to the number of possible different frequency/time resolutions for the first converter.

16. Audio decoder in accordance with claim 9, in which the domain converter is an LPC synthesis processor generating the synthesis signal using a PC filter information, the LPC filter information being comprised in the encoded signal.

17. Method of audio decoding an encoded signal, the encoded signal comprising a first encoded signal, a second encoded signal, an indication indicating the first encoded signal and the second encoded signal, and a time/frequency resolution information to be used for decoding the first encoded signal and the second encoded audio signal, comprising:

decoding, by a first decoding branch, the first encoded signal using a first controllable frequency/time converter, the first controllable frequency/time converter being configured for being controlled using the time/frequency resolution information for the first encoded signal to acquire a first decoded signal;

decoding, by a second decoding branch, the second encoded signal using a second controllable frequency/time converter, the second controllable frequency/time converter being configured for being controlled using the time/frequency resolution information for the second encoded signal;

controlling the first frequency/time converter and the second frequency/time converter using the time/frequency resolution information;

generating, by a domain converter, a synthesis signal using the second decoded signal; and combining the first decoded signal and the synthesis signal to acquire a decoded audio signal.

18. A non-transitory storage medium having stored thereon a computer program for performing, when running on a processor, a method of audio encoding an audio signal, comprising:

encoding, in a first coding branch, an audio signal using a first coding algorithm to acquire a first encoded signal, the first coding branch comprising the first converter for converting an input signal into a spectral domain;

encoding, in a second coding branch, an audio signal using a second coding algorithm to acquire a second encoded signal, wherein the first coding algorithm is different from the second coding algorithm, the second coding branch comprising a domain converter for converting an input signal from an input domain into an output domain, and a second converter for converting an input signal into a spectral domain;

switching between the first coding branch and the second coding branch so that, for a portion of the audio input signal, either the first encoded signal or the second encoded signal is in an encoder output signal;

analyzing the portion of the audio signal to determine, whether the portion of the audio signal is represented as the first encoded signal or the second encoded signal in the encoder output signal, variably determining a respective time/frequency resolution of the first converter and the second converter, when the first encoded signal or the second encoded signal representing the portion of the audio signal is generated; and generating an encoder output signal comprising the first encoded signal and the second encoded signal and information indicating the first encoded signal and the second encoded signal, and information indicating the time/frequency resolution applied for encoding the first encoded signal and for encoding the second encoded signal or the method of audio decoding an encoded signal, the encoded signal comprising a first encoded signal, a second encoded signal, an indication indicating the first encoded signal and the second encoded signal, and a time/frequency resolution information to be used for decoding the first encoded signal and the second encoded audio signal, comprising:

decoding, by a first decoding branch, the first encoded signal using a first controllable frequency/time converter, the first controllable frequency/time converter being configured for being controlled using the time/ frequency resolution information for the first encoded signal to acquire a first decoded signal;

decoding, by a second decoding branch, the second encoded signal using a second controllable frequency/time converter, the second controllable frequency/time converter being configured for being controlled using the time/frequency resolution information for the second encoded signal;

controlling the first frequency/time converter and the second frequency/time converter using the time/frequency resolution information;

generating, by a domain converter, a synthesis signal using the second decoded signal; and combining the first decoded signal and the synthesis signal to acquire a decoded audio signal.

* * * * *